US005558332A

United States Patent [19]

Cook

[11] Patent Number: 5,558,332

[45] **Date of Patent: *Sep. 24, 1996**

[54] GOLF CLUB HEAD

[75] Inventor: Raymon W. Cook, San Antonio, Tex.

[73] Assignee: Kliker Golf Company, Inc., San Antonio, Tex.

[ * ] Notice: The term of this patent shall not extend beyond the expiration date of Pat. No. 5,308,067

[21] Appl. No.: 236,345

[22] Filed: May 2, 1994

Related U.S. Application Data

[63] Continuation-in-part of Ser. No. 2,598, Jan. 11, 1993, Pat. No. 5,308,067.

[51] Int. Cl.[6] ..... A63B 53/04

[52] U.S. Cl. ..... 473/341; 473/252; 473/253; 473/350

[58] Field of Search ..... 273/167 R, 167 A, 273/167 D, 167 E, 167 F, 167 G, 167 H, 168, 171, 172, 173, 164.1, 162 R, 78–79, 80.1, 80.2, 77 R, 193 R, 169, 167 J

[56] References Cited

U.S. PATENT DOCUMENTS

| | | | |
|---|---|---|---|
| D. 222,280 | 10/1971 | Cook . | |
| D. 222,752 | 12/1971 | Cook . | |
| D. 235,568 | 6/1975 | Cook . | |
| D. 236,517 | 8/1975 | Cook . | |
| D. 238,087 | 12/1975 | Cook . | |
| D. 238,285 | 12/1975 | Ross . | |
| D. 247,791 | 4/1978 | Monteleone | 273/164.1 |
| D. 248,181 | 6/1978 | Cervantes | 273/164.1 |
| 3,042,405 | 7/1962 | Solheim . | |
| 3,061,310 | 10/1962 | Giza . | |
| 3,516,674 | 6/1970 | Scarborough . | |
| 3,578,332 | 5/1971 | Caldwell . | |
| 3,814,437 | 6/1974 | Winquist | 273/167 R |
| 3,841,640 | 10/1974 | Gaulocher . | |
| 3,880,430 | 4/1975 | McCabe | 273/164.1 |
| 3,884,468 | 5/1975 | Cook . | |
| 3,923,308 | 12/1975 | Mills . | |
| 3,931,975 | 1/1976 | Cook . | |
| 3,954,270 | 5/1976 | Cook . | |
| 3,955,819 | 5/1976 | Yokich | 273/164.1 |
| 4,113,249 | 9/1978 | Beery . | |
| 4,121,832 | 10/1978 | Ebbing . | |
| 4,444,395 | 4/1984 | Reiss . | |
| 4,655,459 | 4/2987 | Antonious . | |
| 4,693,478 | 9/1987 | Long . | |
| 4,756,535 | 7/1988 | Bradley . | |
| 4,834,387 | 5/1989 | Waites et al. . | |
| 4,979,744 | 12/1990 | Alcala . | |
| 5,308,067 | 5/1994 | Cook | 273/164.1 |

OTHER PUBLICATIONS

Manual of Steel Construction, Eighth Edition, by American Institute of Steel Construction, Inc., Copyright 1980, pp. (b–8) and (6–9).

Advertisements of HMI II Putter by Slotline Golf, 1992.

*Primary Examiner*—Sebastiano Passaniti

*Attorney, Agent, or Firm*—Gunn, Lee & Miller, P.C.

[57] ABSTRACT

An improved golf club head wherein 70%–97% of the total head weight is within ¾"–1" of the heel and toe ends of the head. The golf club head is provided with an echo chamber for improving audible feedback to the golfer. Upper and lower overhangs extending from the echo chamber enhance the feedback. The golf club head is further provided with a variation of offset hosels and improved alignment indices. The structural arrangement of the dense metal end blocks allows for the adjustment of the club swing weight without disassembly and reassembly of the club head.

21 Claims, 34 Drawing Sheets

GOLF CLUB HEAD

The present application is a continuation-in-part of U.S. patent application Ser. No. 08/002,598, filed Jan. 11, 1993, now U.S. Pat. No. 5,308,067.

FIELD OF THE INVENTION

The subject of the invention relates to an improvement to golf clubs and more particularly a golf club head wherein 70%–97% of the total head weight is within ¾"–1" of the heel end and toe end of the head. Further, the club head provides a unite audible feedback to the golfer. Further yet, as an additional aid to the golfer specially configured alignment indices are provided to improve visual alignment of the putter head with the ball. Various bent shaft configurations further improve putting accuracy.

BACKGROUND OF THE INVENTION

Those who have played the game of golf are well aware that putting often accounts for nearly half the golfer's total score. Although there are a wide variety of putters available to golfers, they still seek improved designs that will assist them in lowering their total score.

Golf putter heads have been designed to impart a rolling motion to the golf ball for short distances. The putter is specifically constructed for use in striking the golf ball accurately toward the cup once it has reached the putting green. Typically, the general construction of a golf club includes a grip portion adapted to be grasped by the golfer, a shaft extending linearly downward from the grip portion, to a club head at the end of the shaft opposite the grip portion. Typically, the club head extends traversely to the shaft and the shaft has a neck portion located at one end thereof, which is connected by a hosel to the shaft.

The golfer addresses the golf ball by placing the club adjacent to the ball. The golfer then swings the club in a short, sweeping arc for a desired, but seldom achieved, perfect swing.

Such a perfect swing would include contacting the "sweet spot" of the putter face. The sweet spot is the spot on the putter face about which there is zero torque. Striking the golf ball at a point off the sweet spot may open or close the face of the club and cause the ball to travel off line. Putter heads are designed to reduce the torque imparted to the putter head when striking the ball off the sweet spot. The feel of the putter as it strikes the golf ball is an important design feature. A putter with a good feel will provide better control and impart confidence to the golfer. The applicant has found that the feel of the putter is a function of the size of the sweet spot or hitting area, as well as the balance of the putter face which strikes the golf ball. Thus, it is the object of this invention to provide a putter head that will reduce the torque created when the putter head strikes the ball off the sweet spot of the face, to produce better feel and control.

The present invention provides for a club head, and more particularly a putter head, that is unique in a number of ways, resulting in an enhanced sweet spot yielding better control and feel.

The golfer seeks a unique design that provides that the overall balance of the putter head (both static and dynamic), the zero torque line, and the perfect sweet spot are all aligned with the geometric center of the putter face and head. That is, a point on the putter face or head where there is an equal amount of weight from a line or point drawn on the front of the putter face across the top and to the back of the putter head. The present invention discloses an embodiment of a putter head having a suspended face plate—that is, a face plate attached to the head at only the heel and toe ends thereof. Further, an embodiment is provided in which the faceplate is more fully suspended.

Golfers, in addition to relying upon the "feel" of the putter head striking the ball to provide control and confidence, further rely upon the sound of the putter head striking the ball.

Recognition for the need of a pleasing clicking sound as an audible feedback to the golfer has been given very little attention. When a golf ball is struck by a golfing iron with a solid impact, a clean, clear, clicking sound should be produced. There is very little, if any, clicking sound generated when a golf ball is struck with a conventional golf putter.

Sound, feel, touch and control are extremely important in controlling a putt. In the past, a limited number of putters have been designed to produce a sound when hitting the golf ball. U.S. Pat. No. 3,042,405 discloses that a sharp ringing bell tone or a ring with a clear note may be produced. This type of ringing sound has not been acceptable to most golfers. The present invention yields the definite, different click sound; a pleasing sound found more acceptable to golfers. The unique magnified, loud clicking sound is the result of the rearwardly open echo chamber arrangement formed in the putter head. This sound is a definite advantage to the golfer. The clicking sound improves the golfer's awareness as to how hard he is hitting the ball and results in better judgment on how hard to hit the ball for different putt distances. Thus, the clicking sound gives the golfer more insight on feel and touch and teaches or assists the golfer in controlling the ball.

There are many blind golfers who enjoy the game of golf. A given distance for an iron or wood shot can be achieved with guided instruction and the selection of the proper club. But in putting, the blind golfer generally uses the same putter for each putt, regardless of the distance. Putting with accuracy is much more difficult in such cases. A sightless golfer should have more than just touch and feel in his golf putting, he should be provided with a controllable feedback sound. The sound made by the present invention when striking the ball is a loud, clear, pleasing sound. This sound transmits a message to the golfer as to how hard he has hit the ball and thereby teaches him how hard he should hit the ball for any intended distance.

As previously indicated, most putters are designed with a specific "sweet spot." A "sweet spot" is a defined point in the putter face which, when the putter contacts the ball, the ball will roll straight and on the line the golfer has chosen, assuming the ball is not acted upon by another outside force.

If the correct line has been selected but the ball is struck at a point other than the exact "sweet spot," this may produce a twisting of the putter and the ball will roll on a line different than the intended line and the putt is missed.

Good judgment must be exercised on every putt. The most important factors in putting judgment are in determining the accurate line that the ball should roll and the distance of the putt. Two factors effecting distance are: (1) striking the ball with the correct force; and (2) striking the ball at the exact "sweet spot" in the putter face. A golfer is inclined to believe that he hit the ball with insufficient force when he leaves a putt short rather than believe that he missed the sweet spot. On a subsequent putt, the golfer then overcompensates by hitting the ball harder. If the first putt was missed due to not hitting the sweet spot, it is quite likely he will miss the subsequent putt because the ball was hit too hard.

In the present invention when approximately 80% to in excess of 95% of the total weight of the putter head is located within ¾" of the heel and toe ends, a sweet spot or hitting area of 2" with zero torque is created. When the putter head is 4¼" long and 1½" to 1 13/16" wide, the sweet spot is in the direct center of the total putter head which is 1⅛" on either side of the geometric and dynamic center of the putter head. Thus, the sweet spot actually extends 1" on either side of the geometric and dynamic center of the putter head. Existing putters do not have this advantage.

Keeping the putter face square to the line of intended ball travel is a difficult task. Therefore, alignment lines on the top of the putter head have been provided to assist the golfer in centering the sweet spot, centering the ball and centering the putter face on the line of intended ball travel. Existing alignment lines on previous putters have not been as fully effective. Many putter heads have only one "sighting" line or index. U.S. Pat. No. 4,834,387 discloses three lines of equal width (3 mm or 0.118") with the outside lines corresponding to the diameter of the golf ball. These sightings or alignments are difficult to focus upon.

The present invention provides three wide, distinct alignment lines or indices, spaced wide enough apart to provide enough clearance on each side of the golf ball so the golfer may focus properly on the line of intended travel. The three prominent alignment lines of the present invention provide an effective means to improve the optics involved resulting in improved focus on the correct line the ball is intended to roll along toward the cup. Unlike the lines of U.S. Pat. No. 4,834,387, the center alignment line or index of the present invention is wider than the two outside alignment lines or indices, and the two outside alignment lines are spaced apart a slight distance greater than the diameter of the ball. The clearance between the two outside alignment lines and the ball allows the golfer to see the alignment lines on each side of the ball so clearly that it is easier and more accurate in aligning the putter face and the golf ball on the line of intended ball travel.

Typically, the recreational golfer does not have an opportunity to experiment to determine the best weight of a putter for his particular physical circumstances. The professional golfer has had the advantage of being able to have a putter customized to meet his desires regarding the overall, total weight of the putter. However, such customized weight adjustments had to be made prior to or during assembly of the putter.

Because of the structural arrangement of the present invention, the total putter head weight may be adjusted by the golfer, after the putter has been assembled to include the shaft and grip. This adjustability offers both the recreational and professional golfer the opportunity to customize the total putter weight to his needs after purchase without resorting to disassembly and reassembly.

A shaft in-head mount putter, i.e., one not having a hosel, is not new. However, the shaft bends available in existing putters are generally limited to providing a shaft maximum of ¾" in front of the putter face. It is well known that the golfer putts better when he keeps his hands in front of the ball upon impact.

The shaft of the present invention provides various graduated bends. There is a shaft bend even or flush with the face; one bend ½" in front of the face; one bend 1" in front of the face; and another bend 1½" in front of the face. A shaft bend 1½" offset in front of the putter face is most preferable. The 1½" shaft bend of the present invention is proportioned to the overall dynamics and balance of the present improved putter head. The greater offset a shaft has, especially when mounted directly in the putter head in the heel area, the greater the advantage the golfer has in stroking the ball.

The present 1½" shaft bend allows the golfer's hands to remain low and in front of the putter head when stroking the ball. With his hands 1½" in front of the putter face, the follow through of the stroke is improved and the putter is more easily kept on the desired line that the ball is intended to roll. The 1½" bends help prevent hitting up on the ball at impact thereby reducing torque.

The improved shafts of the present invention are suited to a heel type mount in the putter head, but the shaft is bent far enough forward to still provide the putter a center balance. The forward bend of 1½" bend in front of the putter face does not interfere with the alignment of the golf ball providing a distinct advantage in aligning the putt. Most existing putters, with hosels and which have center balance, interfere with the alignment or sighting of a putt.

The improved putter head of the present invention may be constructed simply in a three-piece assembly, having no separate putter face plate, and still provide a low torque head with approximately 80% of the total putter head weight within ¾" of the heel and toe ends. The unique rearward directed chamber of the present invention allows for this unique construction arrangement.

The specific placement of heel and toe weight blocks within ¾" to 1" of the heel and toe ends of the club head has been found to not only improve putter heads, but may be employed on drivers, irons, woods and wedges. The use of lightweight high strength metals, traditionally used in armaments, aircraft structures, and cryogenic applications, has resulted in the improved club heads discussed below.

SUMMARY OF THE INVENTION

Applicant has provided a unique putter wherein the feel is improved by utilizing a low torque/high moment of inertia design with equally-weighed, very high density masses at the heel and toe of the putter head. The putter head is bilaterally symmetrical .and dynamically balanced at the axis of symmetry. Further, Applicant has provided for a rearwardly directed echo chamber in combination with the foregoing qualities to provide for unique sound feedback means to assist the golfer in determining the accuracy of his putt.

The location of the hollowed out echo chamber (cavity back) in the center frame and heavy brass or bronze end blocks at the extreme heel and toe end, in combination with a thin strong lightweight suspended faceplate, forming a 3/64" space between the faceplate and the echo chamber, provide a loud, clean, clear, clicking sound when striking the golf ball with the putter face.

The particular characteristics of the sound produced is controlled by varying the front opening of the echo chamber by means of either a full curtain or partition to close the front of the opening completely or by utilizing a partial curtain having variations in the configuration of the front opening.

A four-part putter with each separate part being machine milled, constructed of three different type metals and assembled with screws and epoxy is disclosed. An extremely lightweight aluminum frame and the placement of heavy brass or bronze weighted end blocks at the extreme heel and toe ends of the putter places approximately 80% of the total putter head weight within ¾" at the heel and toe ends. The total putter head weight is 349 grams and the weight at the heel and toe is approximately 276 to 279 grams. After the total putter has been assembled, to include shaft and grip, the total putter head weight may be adjusted by the golfer to any weight he desires from 349 grams downward to 314 grams or less without affecting the perfect balance of the total putter head so long as an equal amount of material is removed from the heel and toe ends.

A generally suspended face is provided in the putter by the utilization of ⅜" attachment tabs on the heel and toe ends for engaging the face member.

Each embodiment of the present invention may incorporate three alignment lines on the top of the putter head for centering the ball and centering the putter face on the line of intended ball travel.

Shaft in-head mount putters are provided with four different shaft bends. A 1½" shaft bend in front of the putter face is preferred and is proportioned to the overall dynamics and balance of the putter head.

The three-part putter of the present invention is constructed of two different type metals and assembled with screws and epoxy. An extremely light weight aluminum frame with a rearwardly directed open chamber is utilized. The placement of heavy brass or bronze weighted end blocks at the extreme heel and toe ends results in over 80% of the total putter head weight within ¾" at the heel and toe ends. When the total putter head weight is 349 grams, the weight at the heel and toe is in the range of 286 to 289 grams. End blocks in the three-part embodiment form a part of the putter face.

Figure 8B:
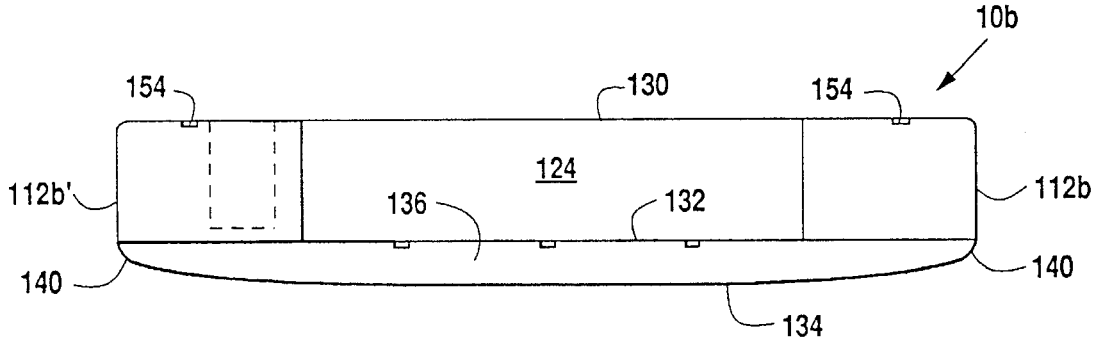
FIG. 8*b* is a rear elevational plan view of a four-piece blade putter head of the present invention having a suspended faceplate.
Figure 7B:
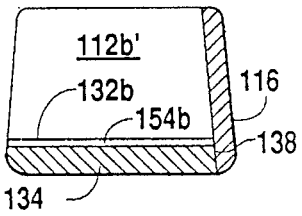
FIG. 7*b* is a cross-sectional view of a four-piece blade putter head of the present invention having a suspended faceplate, taken along line 7*b*—7*b* of FIG. 1*b*.
Figure 8F:
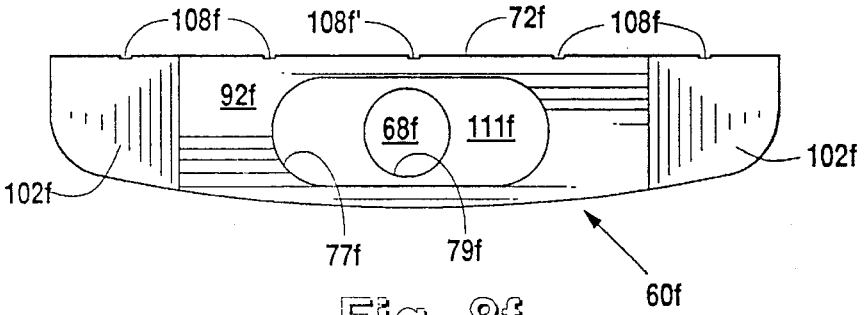
FIG. 8*f* is a rear elevational view of a four-piece mallet putter head of the present invention having a fully suspended faceplate and an echo chamber with a front curtain with a single opening.
Figure 8K:
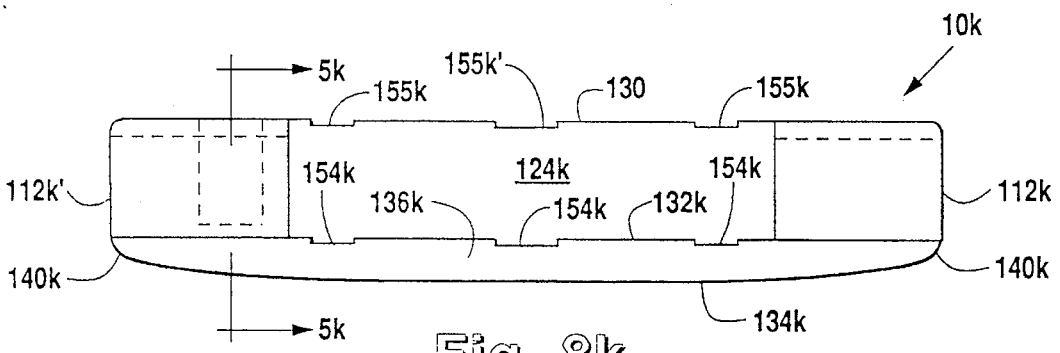
Figure 7K:
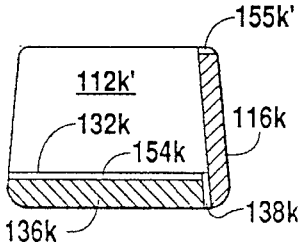
FIG. 7*k* is a cross-sectional view of a four-piece blade putter head of the present invention having an alternative suspended faceplate, and improved alignment lines taken along line 7*k*—7*k* of FIG. 1*k*.

FIG. 8*k* is a rear elevational plan view of a four-piece blade putter head of the present invention having an alternative suspended faceplate, and improved alignment lines.

Figure 8L:
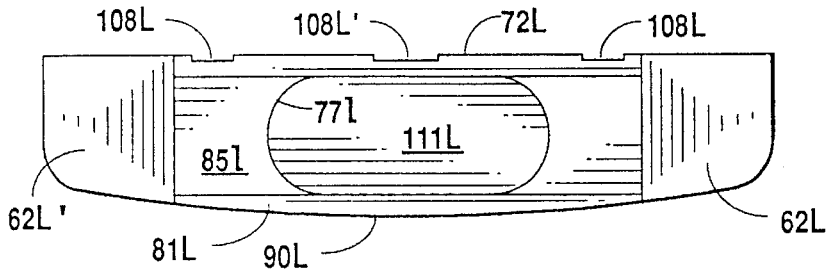

FIG. 8L is a rear elevational view of a three-piece mallet putter head of the present invention having an echo chamber, improved alignment lines, and upper and lower rear overhangs.

Figure 9:
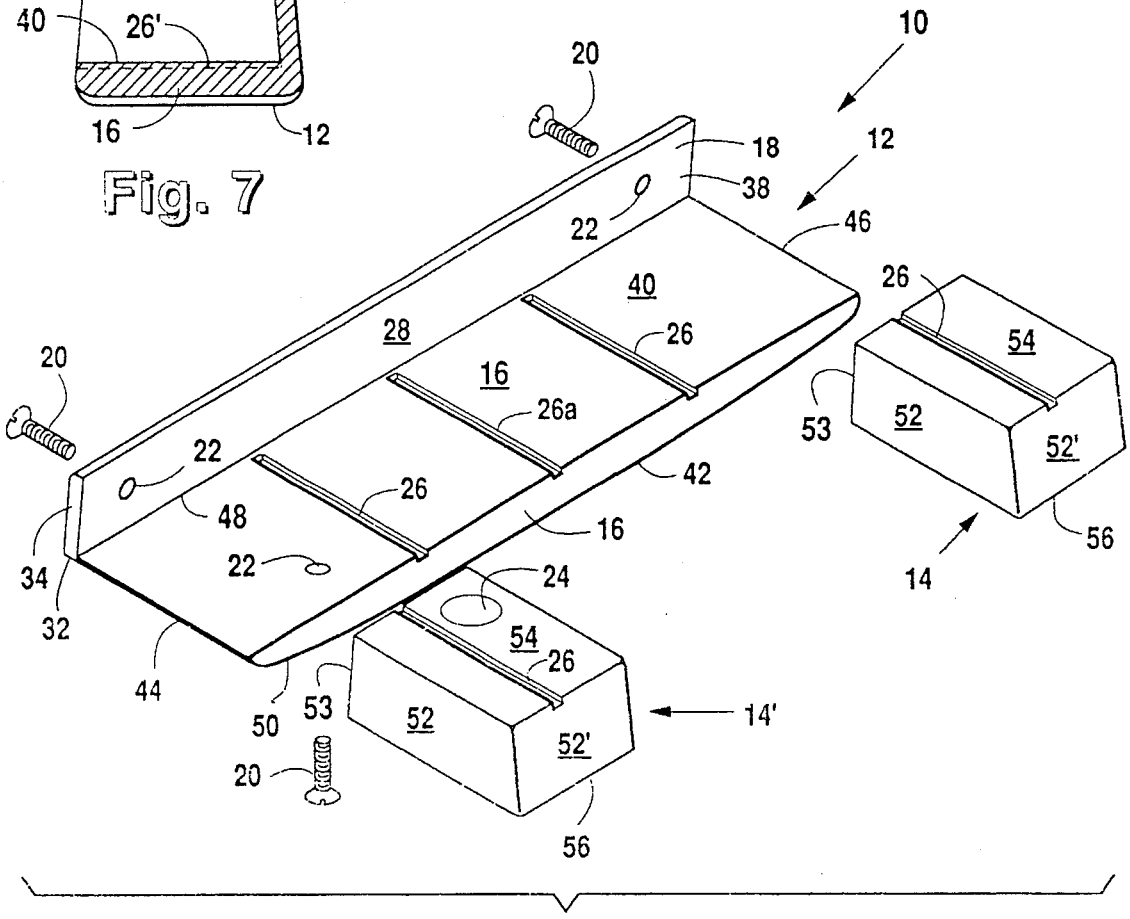
Figure 1A:
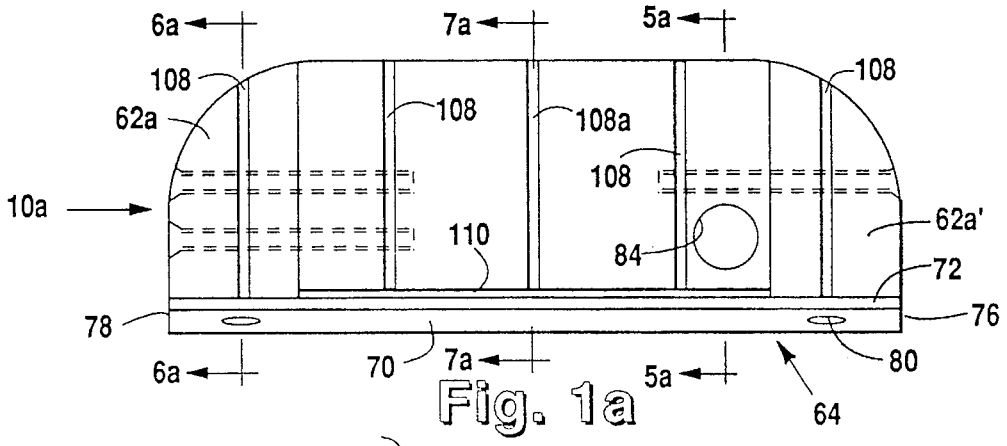
FIG. 1*a* is a top elevational view of a four-piece mallet putter head of the present invention.

FIG. 9 is an exploded perspective view of a three-piece blade putter head of the present invention.

Figure 9A:
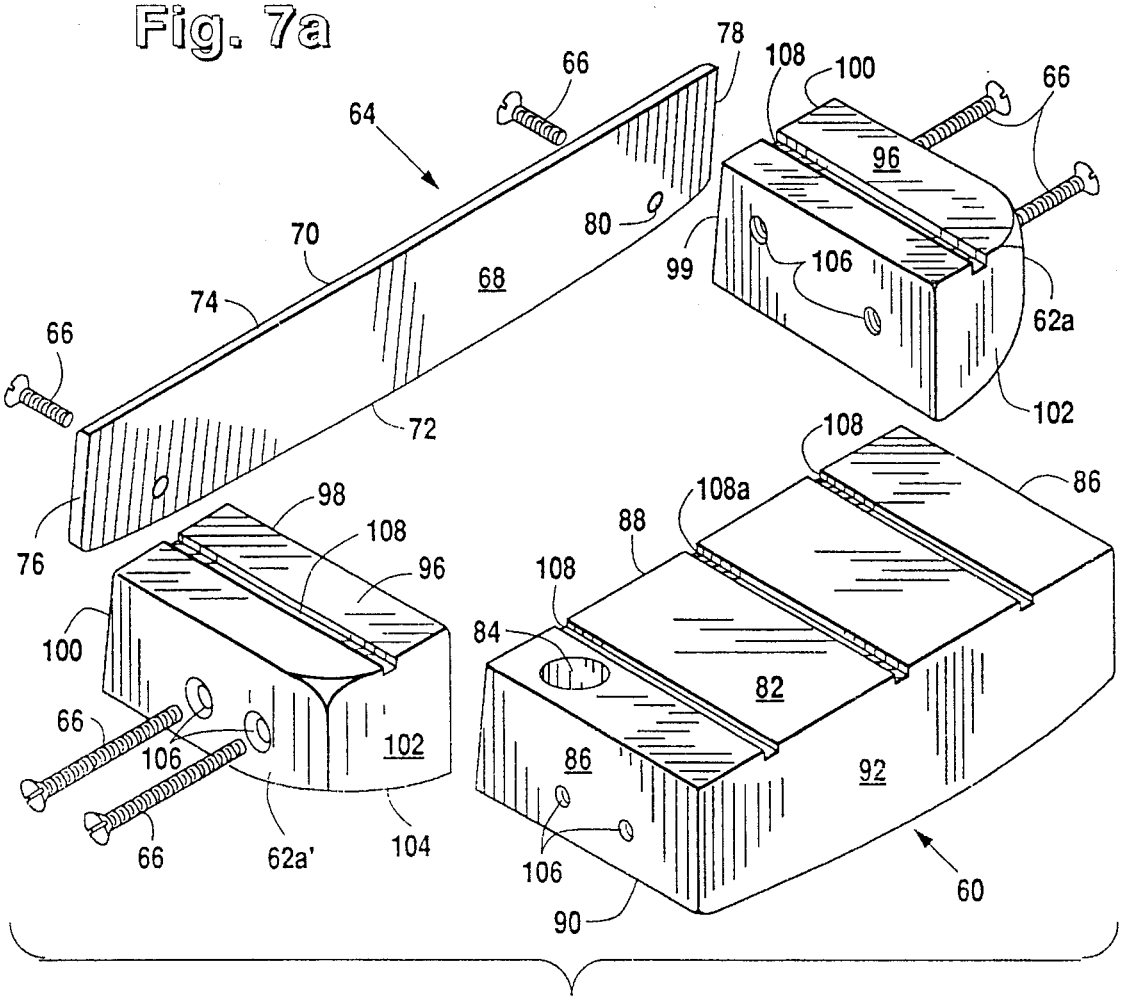

FIG. 9*a* is an exploded perspective view of a four-piece mallet putter head of the present invention.

Figure 9B:
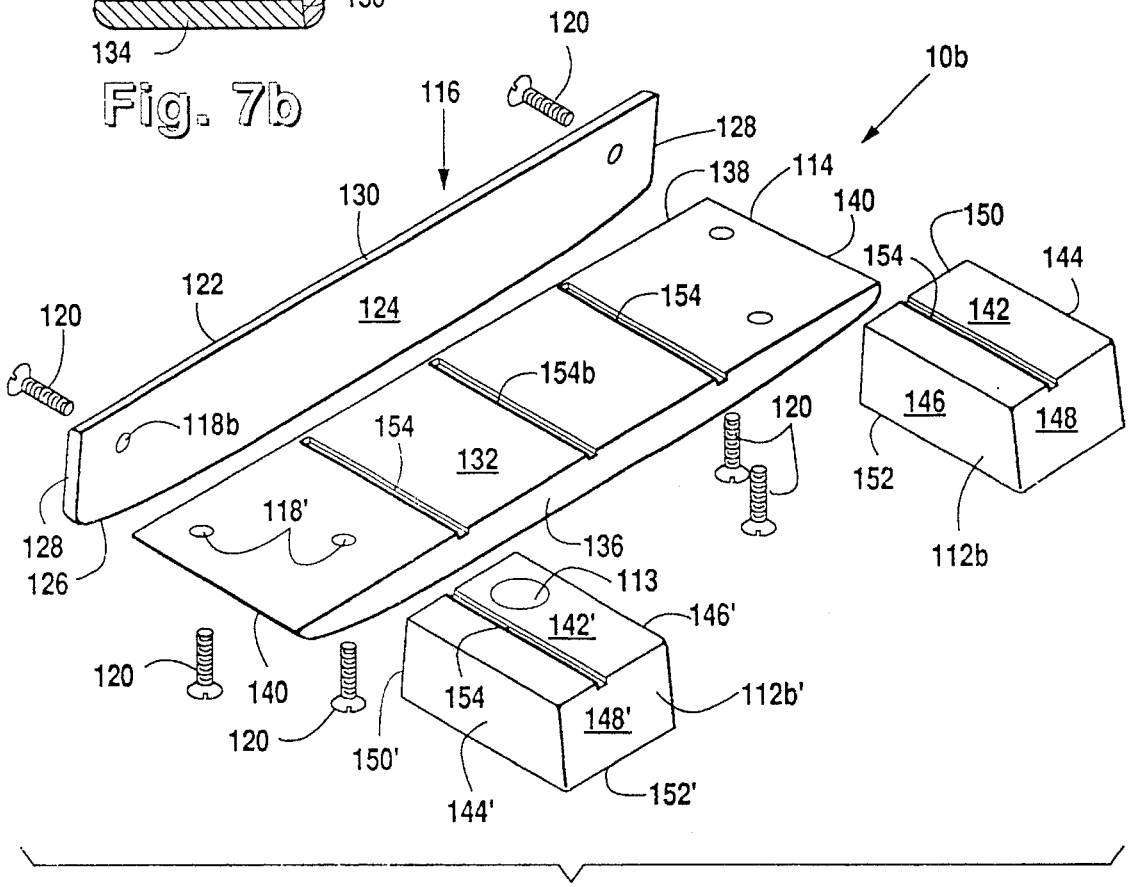
Figure 1C:
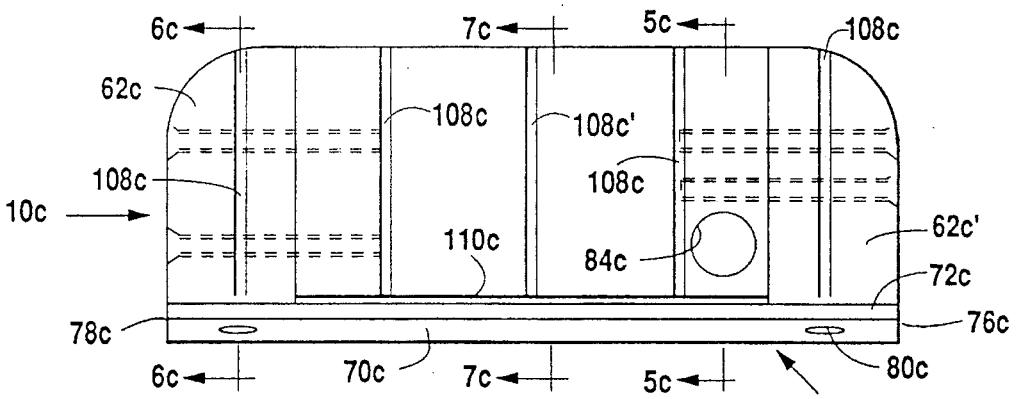
FIG. 1*c* is a top elevational view of a four-piece mallet putter head of the present invention having an echo chamber.
Figure 2C:
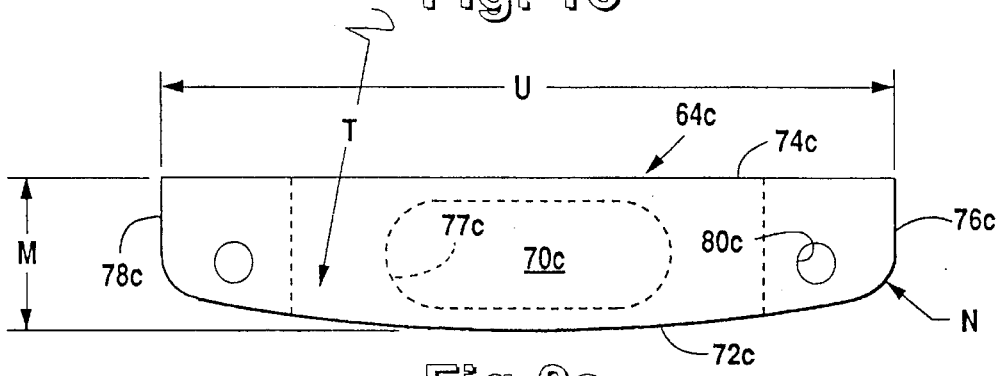
FIG. 2*c* is a front elevational plan view of a four-piece mallet putter head of the present invention having an echo chamber.
Figure 3C:
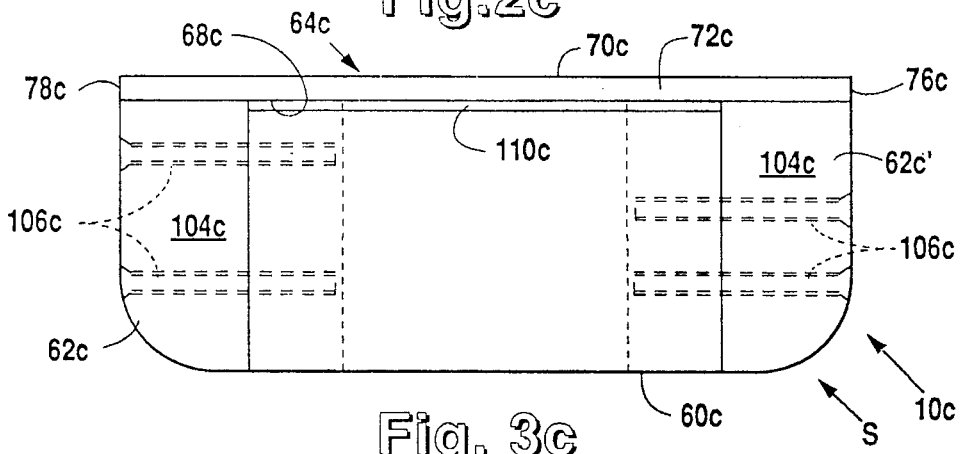
FIG. 3*c* is a bottom plan view of a four-piece mallet putter head of the present invention having an echo chamber.
Figure 4C:
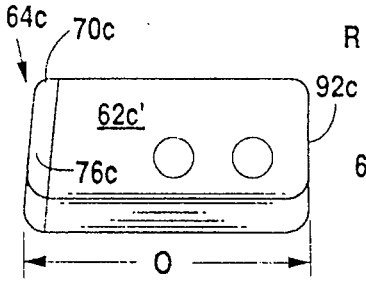
FIG. 4*c* is a heel end view of a four-piece mallet putter head of the present invention having an echo chamber.
Figure 5C:
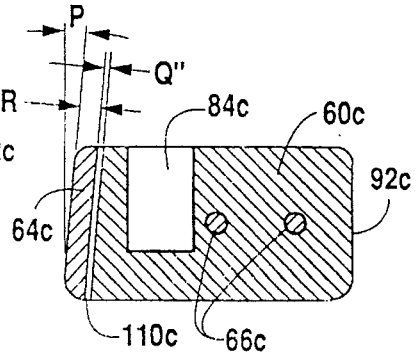
FIG. 5*c* is a cross-sectional view of a four-piece mallet putter head of the present invention having an echo chamber taken along line 5*c*—5*c* of FIG. 1*c*.
Figure 6C:
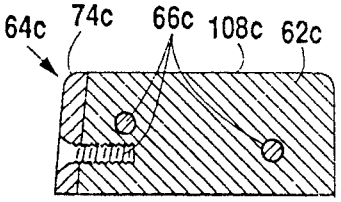
FIG. 6*c* is a cross-sectional view of a four-piece mallet putter head of the present invention having an echo chamber taken along line 6*c*—6*c* of FIG. 1*c*.
Figure 8C:
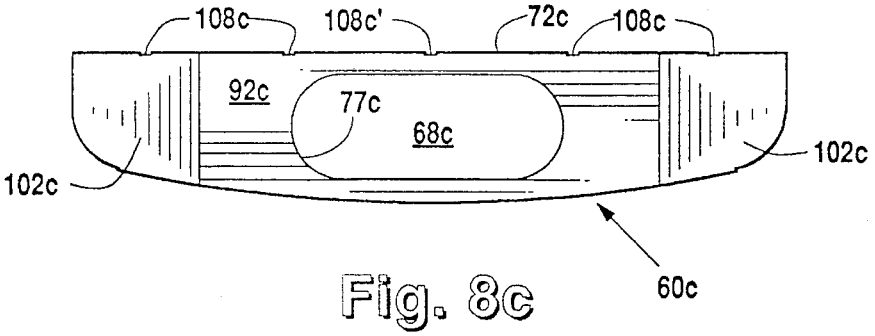
FIG. 8*c* is a rear elevational view of a four-piece mallet putter head of the present invention having an echo chamber.
Figure 7C:
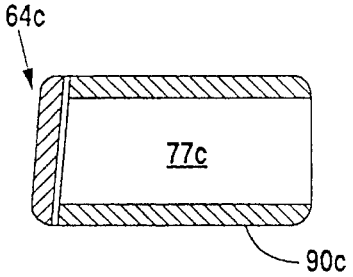
FIG. 7*c* is a cross-sectional view of a four-piece mallet putter head of the present invention having an echo chamber, taken along line 7*c*—7*c* of FIG. 1*c*.

FIG. 9*b* is an exploded perspective view of a four-piece blade putter head of the present invention, having a suspended face plate.

Figure 9C:
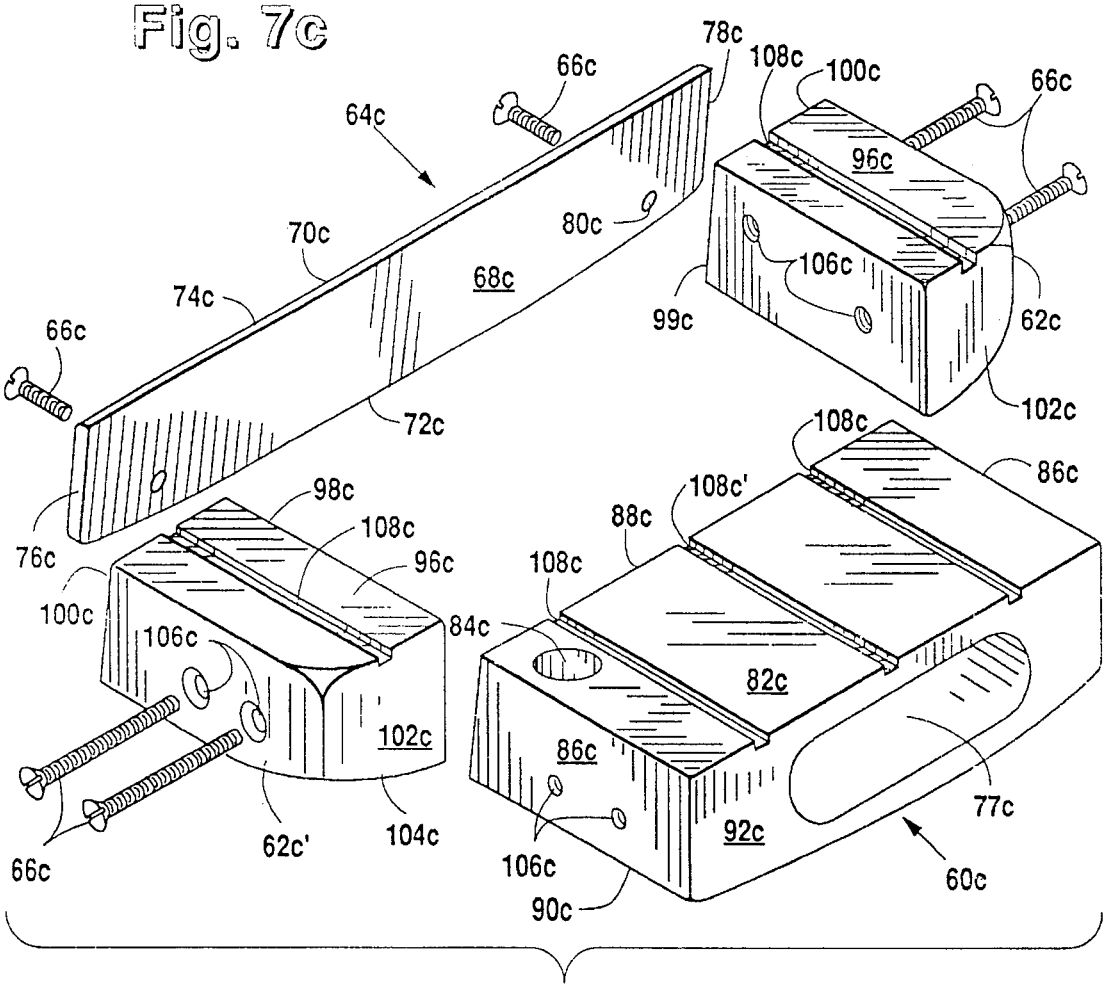

FIG. 9*c* is an exploded perspective view of a four-piece mallet putter head of the present invention having an echo chamber.

Figure 9D:
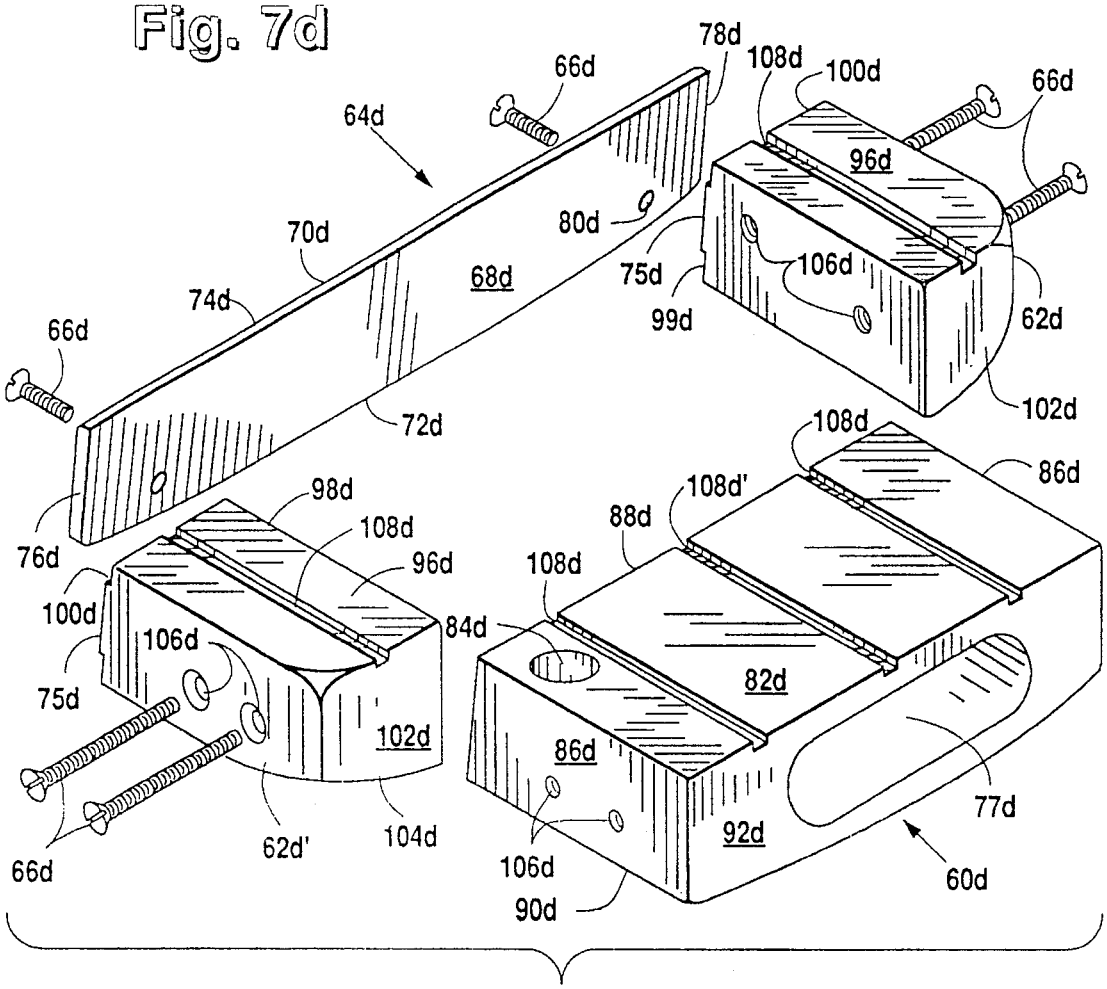
Figure 1E:
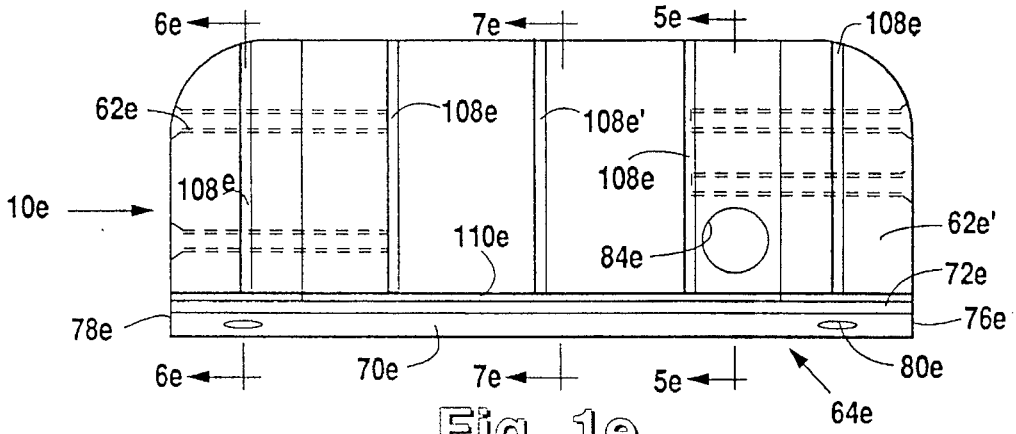
FIG. 1*e* is a top elevational view of a four-piece mallet putter head of the present invention having a fully suspended faceplate and an echo chamber with a front curtain.
Figure 2E:
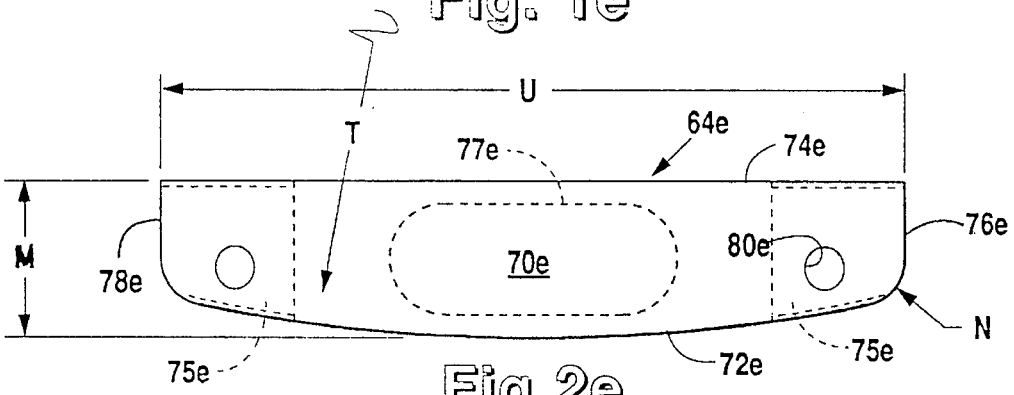
FIG. 2*e* is a front elevational plan view of a four-piece mallet putter head of the present invention having a fully suspended faceplate and an echo chamber with a front curtain.
Figure 3E:
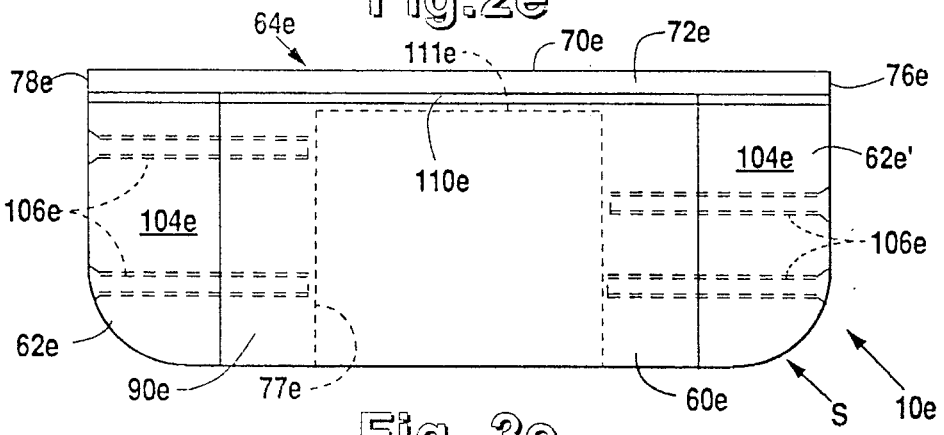
FIG. 3*e* is a bottom plan view of a four-piece mallet putter head of the present invention having a fully suspended faceplate and an echo chamber with a front curtain.
Figure 4E:
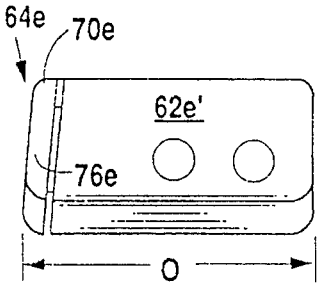
FIG. 4*e* is a heel end view of a four-piece mallet putter head of the present invention having a fully suspended faceplate and an echo chamber with a front curtain.
Figure 5E:
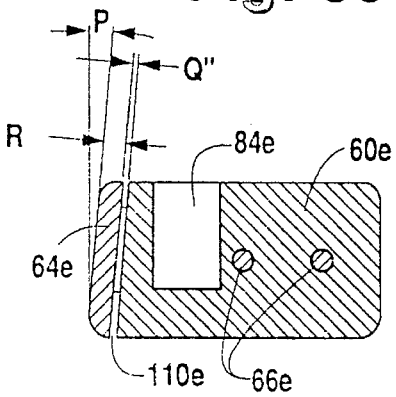
FIG. 5*e* is a cross-sectional view of a four-piece mallet putter head of the present invention having a fully suspended faceplate and an echo chamber with a front curtain taken along line 5*e*—5*e* of FIG. 1*e*.
Figure 6E:
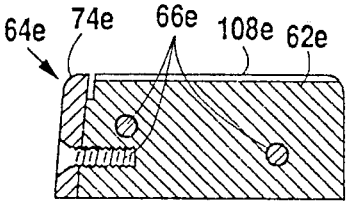
FIG. 6*e* is a cross-sectional view of a four-piece mallet putter head of the present invention having a fully suspended faceplate and an echo chamber with a front curtain taken along line 6*e*—6*e* of FIG. 1*e*.
Figure 8E:
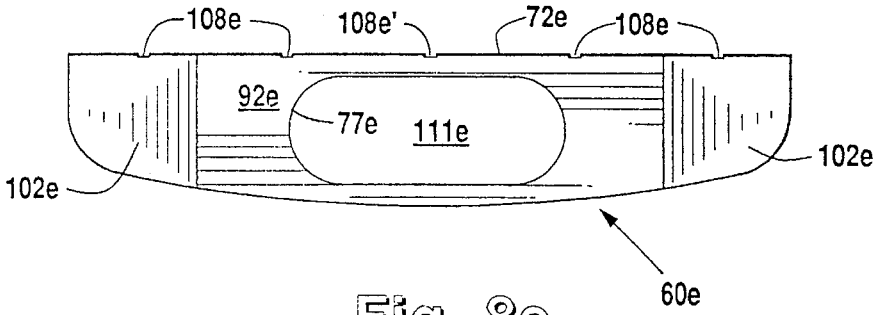
FIG. 8*e* is a rear elevational view of a four-piece mallet putter head of the present invention having a fully suspended faceplate and an echo chamber with a front curtain.

FIG. 9*d* is an exploded perspective view of a four-piece mallet putter head of the present invention having a fully suspended face plate and an echo chamber.

Figure 9E:
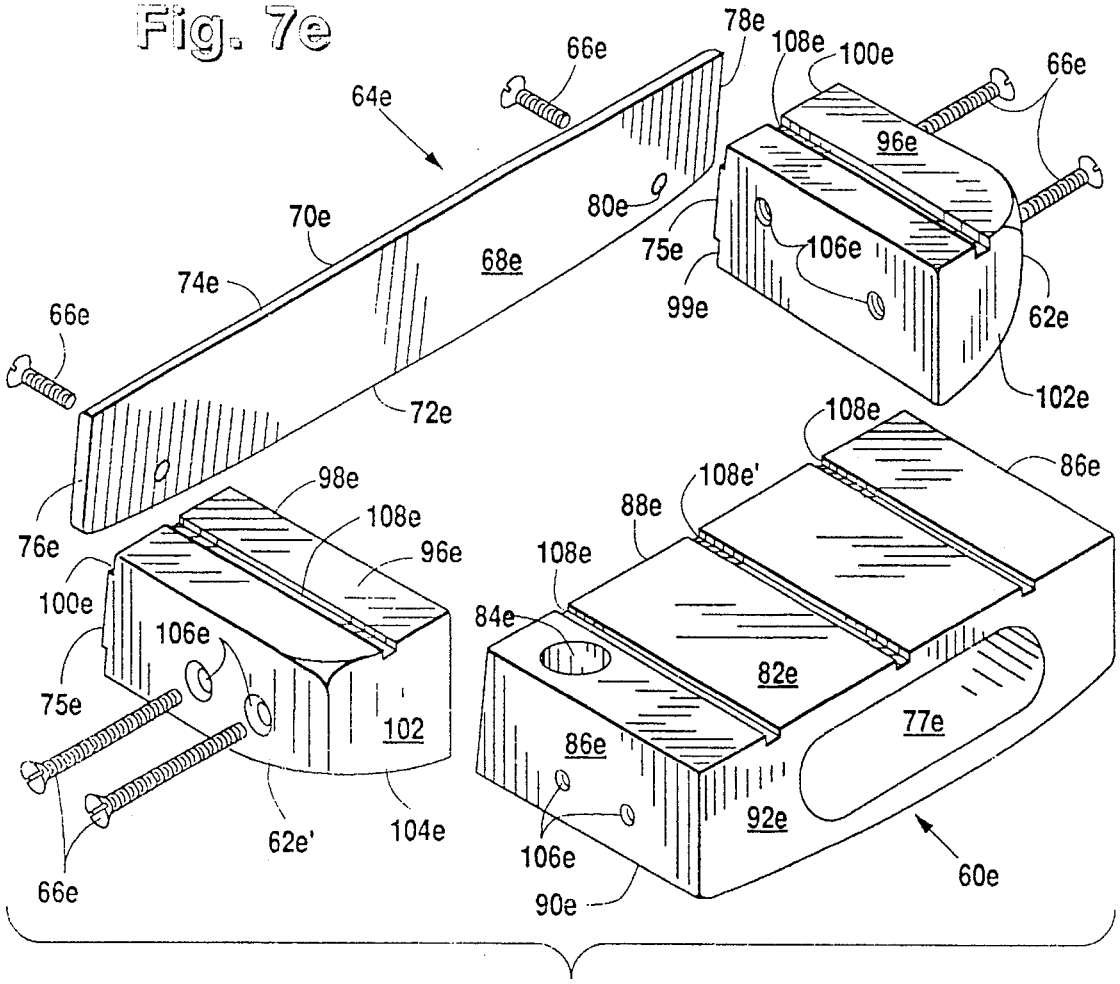
Figure 1F:
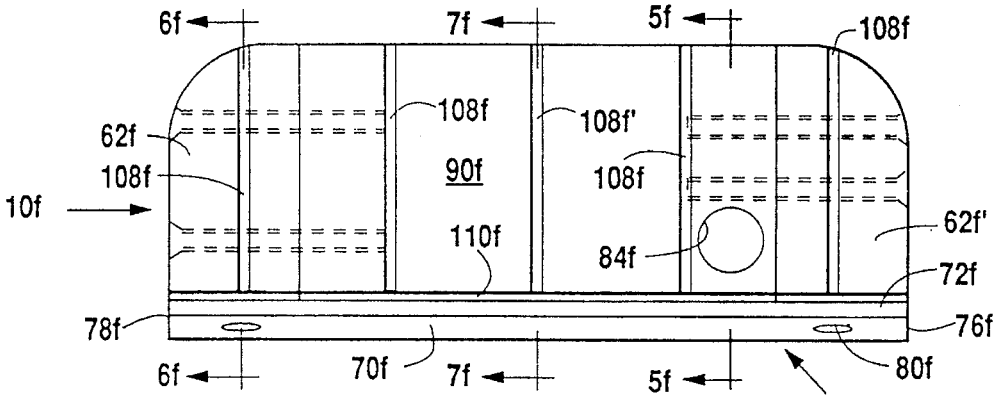
FIG. 1*f* is a top elevational view of a four-piece mallet putter head of the present invention having a fully suspended faceplate and an echo chamber with a front curtain with a single opening.
Figure 2F:
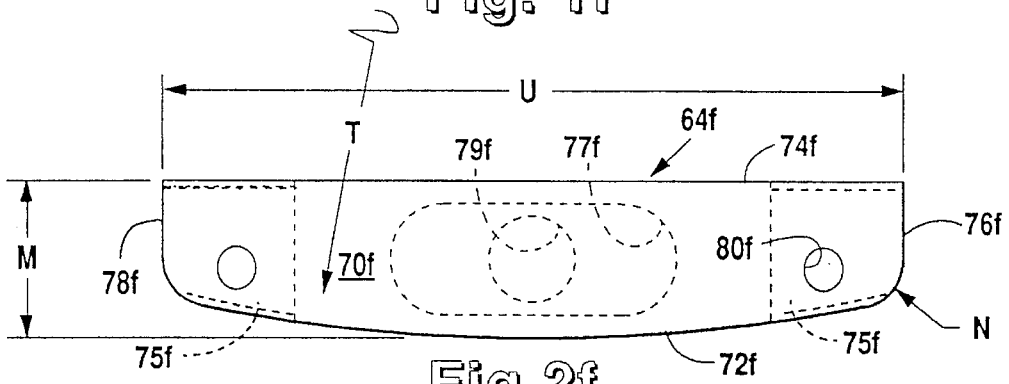
FIG. 2*f* is a front elevational plan view of a four-piece mallet putter head of the present invention having a fully suspended faceplate and an echo chamber with a front curtain with a single opening.
Figure 3F:
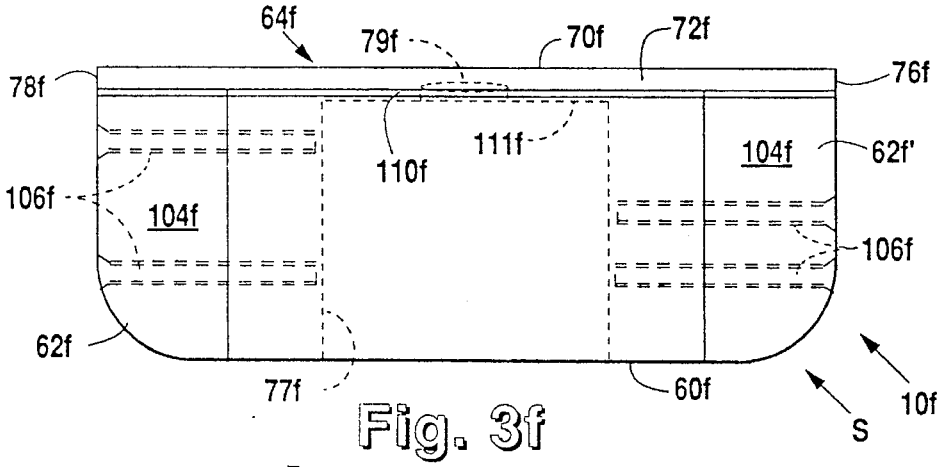
FIG. 3*f* is a bottom plan view of a four-piece mallet putter head of the present invention having a fully suspended faceplate and an echo chamber with a front curtain with a single opening.

FIG. 9*e* is an exploded perspective view of a four-piece mallet putter head of the present invention having a fully suspended faceplate and an echo chamber with a front curtain.

Figure 9F:
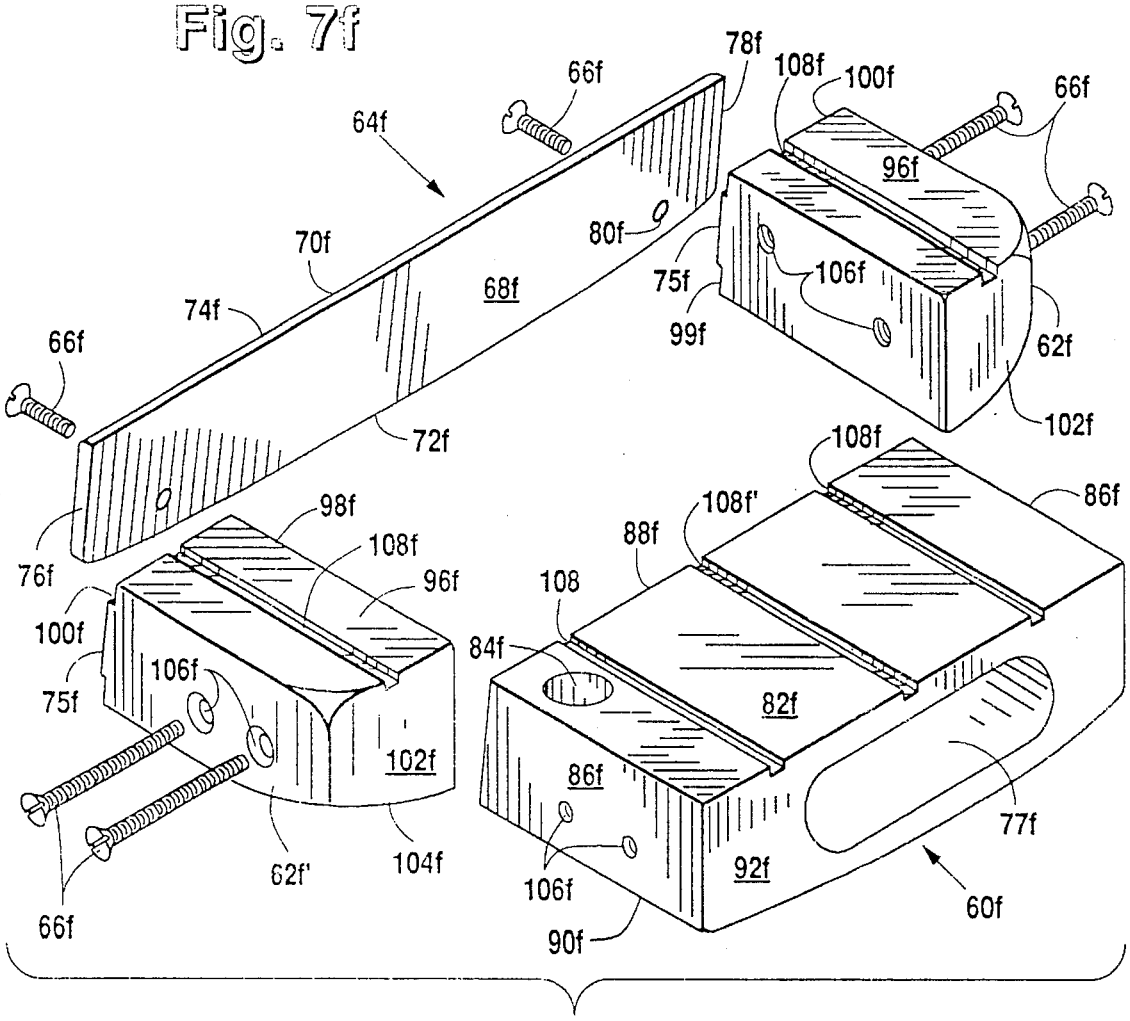
Figure 1G:
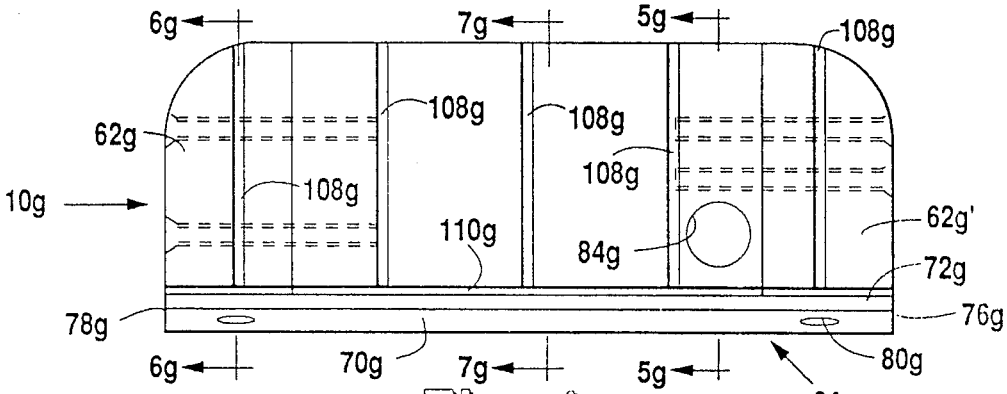
FIG. 1*g* is a top elevational view of a four-piece mallet putter head of the present invention having a fully suspended faceplate and an echo chamber with a front curtain with a plurality of openings.
Figure 2G:
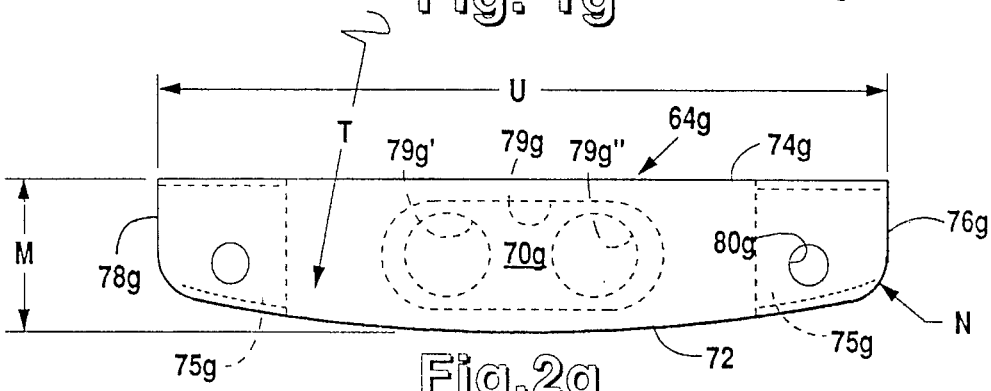
FIG. 2*g* is a front elevational plan view of a four-piece mallet putter head of the present invention having a fully suspended faceplate and an echo chamber with a front curtain with a plurality of openings.
Figure 3G:
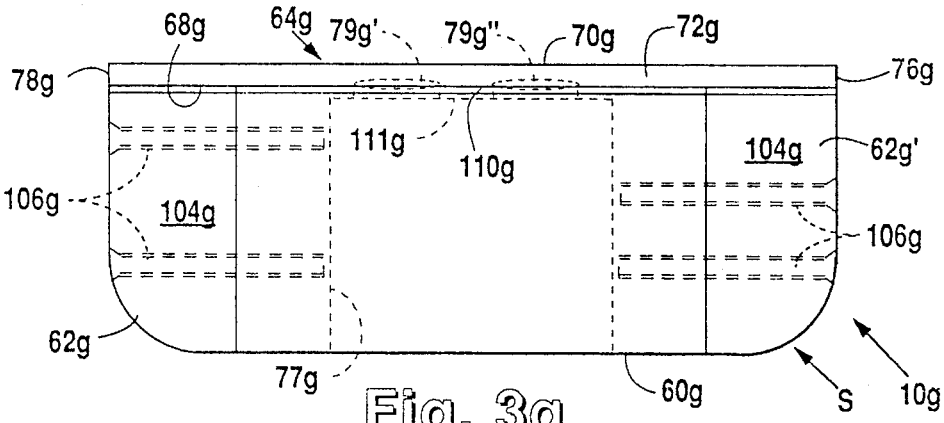
FIG. 3*g* is a bottom plan view of a four-piece mallet putter head of the present invention having a fully suspended faceplate and an echo chamber with a front curtain with a plurality of openings.
Figure 4G:
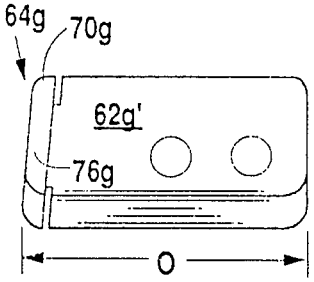
FIG. 4*g* is a heel end view of a four-piece mallet putter head of the present invention having a fully suspended faceplate and an echo chamber with a front curtain with a plurality of openings.
Figure 5G:
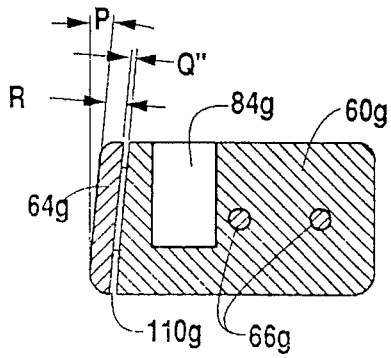
FIG. 5*g* is a cross-sectional view of a four-piece mallet putter head of the present invention having a fully suspended faceplate and an echo chamber with a front curtain with a plurality of openings taken along line 5*g*—5*g* of FIG. 1*g*.
Figure 6G:
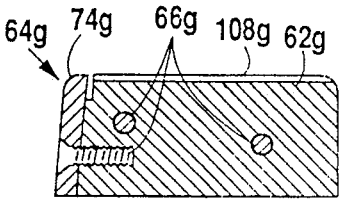
FIG. 6*g* is a cross-sectional view of a four-piece mallet putter head of the present invention having a fully suspended faceplate and an echo chamber with a front curtain with a plurality of openings taken along line 6*g*—6*g* of FIG. 1*g*.
Figure 8G:
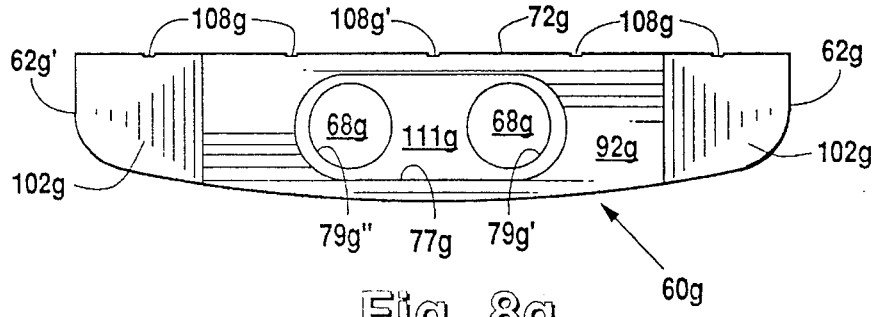
FIG. 8*g* is a rear elevational view of a four-piece mallet putter head of the present invention having a fully suspended faceplate and an echo chamber with a front curtain with a plurality of openings.
Figure 7G:
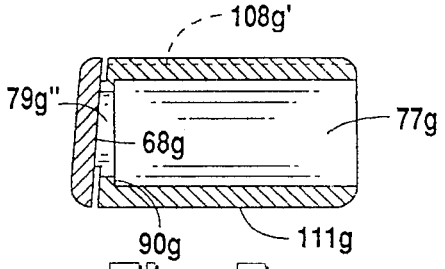
FIG. 7*g* is a cross-sectional view of a four-piece mallet putter head of the present invention having a fully suspended faceplate and an echo chamber with a front curtain with a plurality of openings taken along line 7*g*—7*g* of FIG. 1*g*.

FIG. 9*f* is an exploded perspective view of a four-piece mallet putter head of the present invention having a fully suspended faceplate and an echo chamber with a front curtain with a single opening.

Figure 9G:
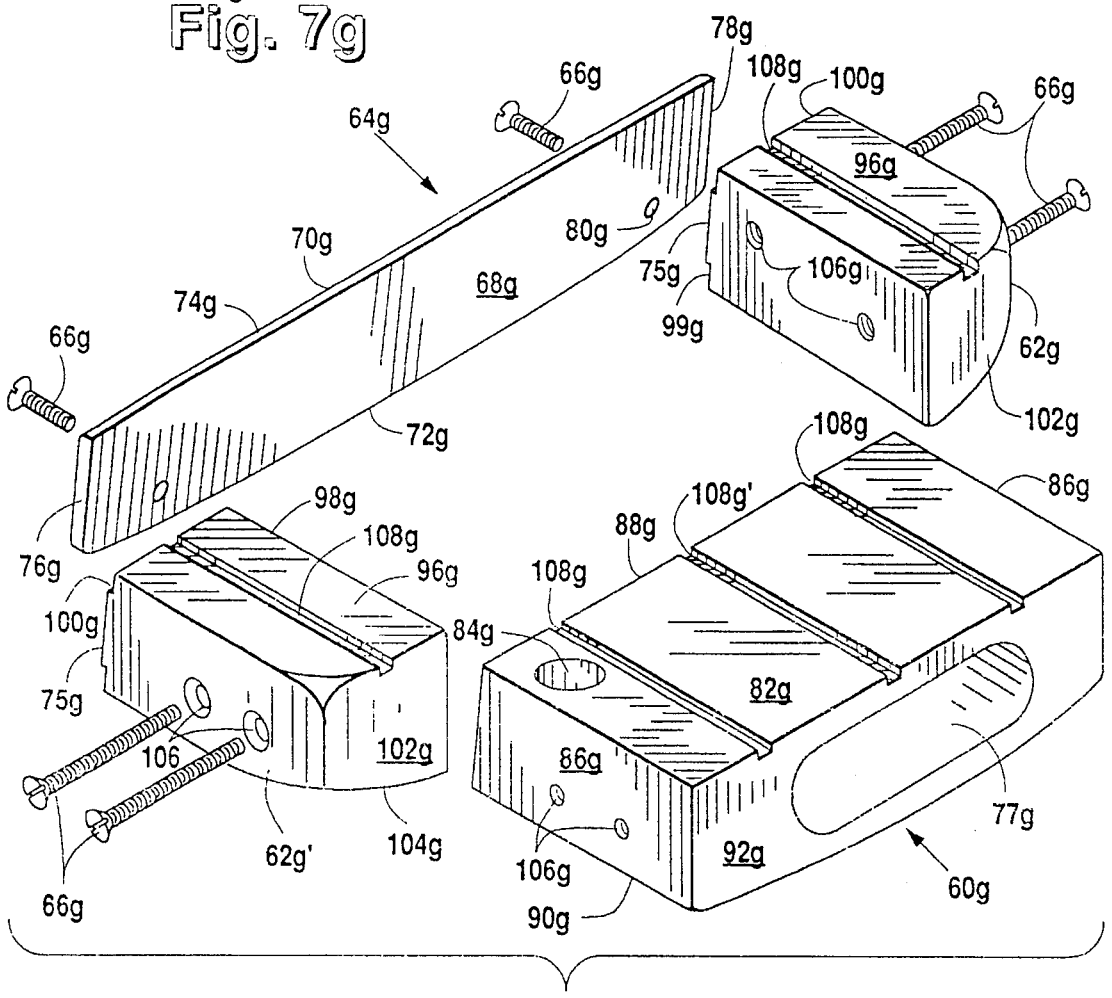

FIG. 9*g* is an exploded perspective view of a four-piece mallet putter head of the present invention having a fully suspended faceplate and an echo chamber with a front curtain with a plurality of openings.

Figure 9H:
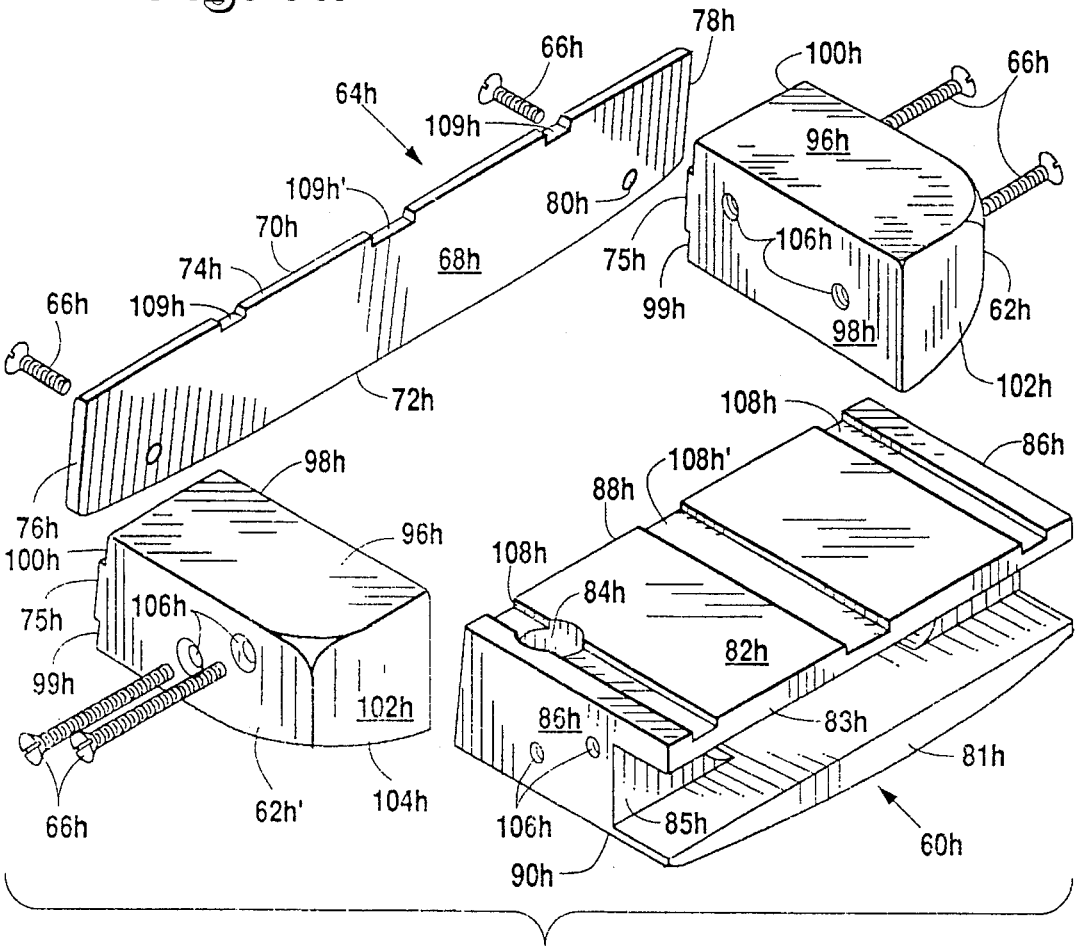
Figure 1I:
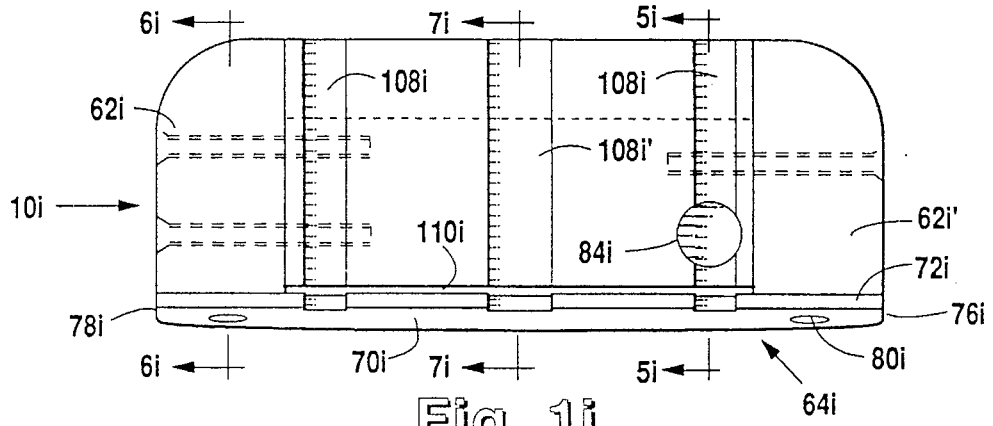
FIG. 1*i* is a top elevational view of a four-piece mallet putter head of the present invention having a suspended faceplate, an echo chamber with a front curtain, improved alignment lines, and upper and lower rear overhangs.
Figure 2I:
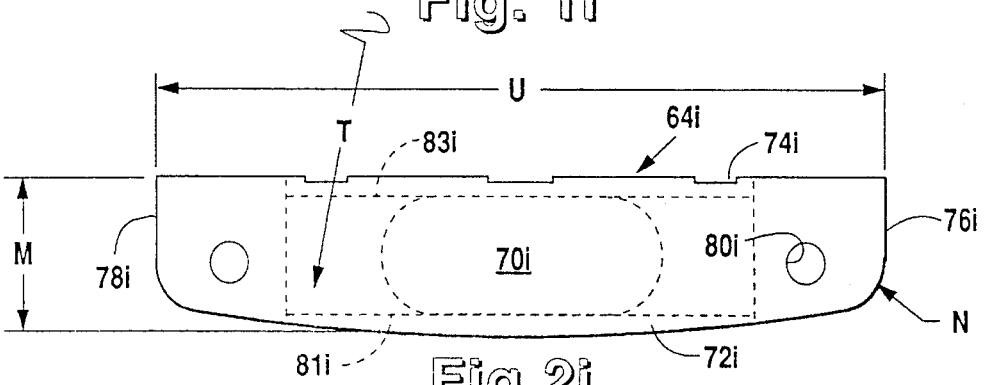
FIG. 2*i* is a front elevational plan view of a four-piece mallet putter head of the present invention having a suspended faceplate, an echo chamber with a front curtain, improved alignment lines, and upper and lower rear overhangs.
Figure 3I:
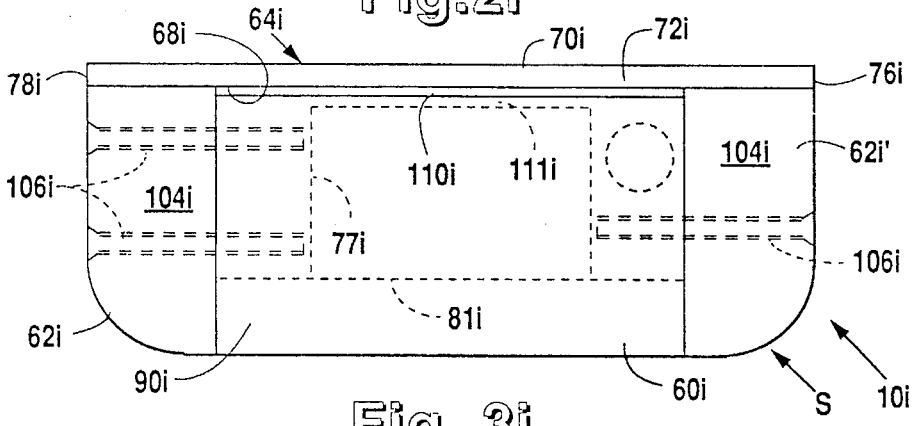
FIG. 3*i* is a bottom plan view of a four-piece mallet putter head of the present invention having a suspended faceplate, an echo chamber with a front curtain, improved alignment lines, and upper and lower rear overhangs.
Figure 4I:
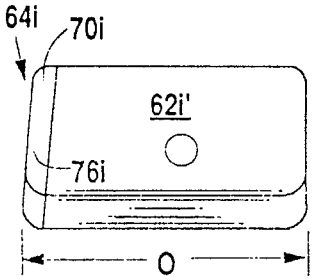
FIG. 4*i* is a heel end view of a four-piece mallet putter head of the present invention having a suspended faceplate, an echo chamber with a front curtain, improved alignment lines, and upper and lower rear overhangs.
Figure 5I:
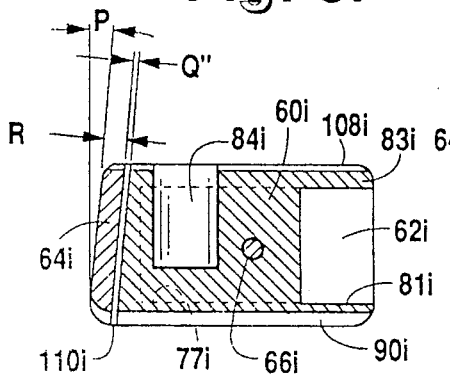
FIG. 5*i* is a cross-sectional view of a four-piece mallet putter head of the present invention having a suspended faceplate, an echo chamber with a front curtain, improved alignment lines, and upper and lower rear overhangs taken along line 5*i*—5*i* of FIG. 1.
Figure 6I:
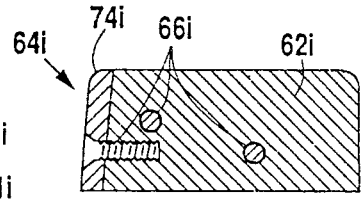
FIG. 6*i* is a cross-sectional view of a four-piece mallet putter head of the present invention having a suspended faceplate, an echo chamber with a front curtain, improved alignment lines, and upper and lower rear overhangs taken along line 6*i*—6*i* of FIG. 1*i*.
Figure 8I:
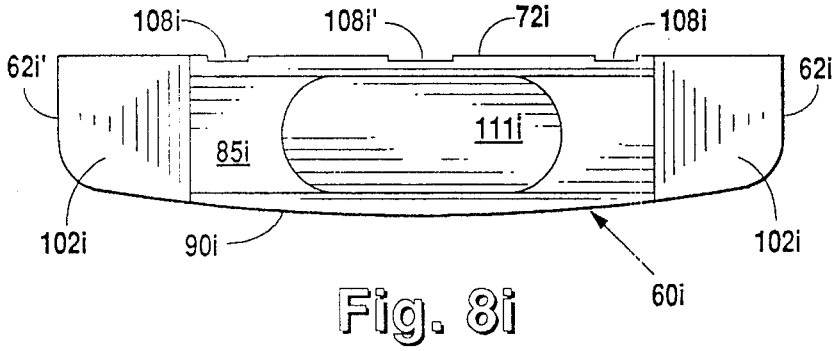
FIG. 8*i* is a rear elevational view of a four-piece mallet putter head of the present invention having a suspended faceplate, an echo chamber with a front curtain, improved alignment lines, and upper and lower rear overhangs.
Figure 7I:
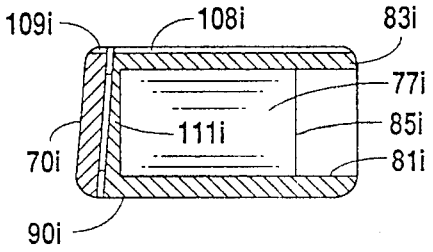
FIG. 7*i* is a cross-sectional view of a four-piece mallet putter head of the present invention having a suspended faceplate, an echo chamber with a front curtain, improved alignment lines, and upper and lower rear overhangs taken along line 7*i*—7*i* of FIG. 1*i*.

FIG. 9*h* is an exploded perspective view of a four-piece mallet putter head of the present invention having a fully suspended faceplate, an echo chambers improved alignment lines, and upper and lower rear overhangs.

Figure 9I:
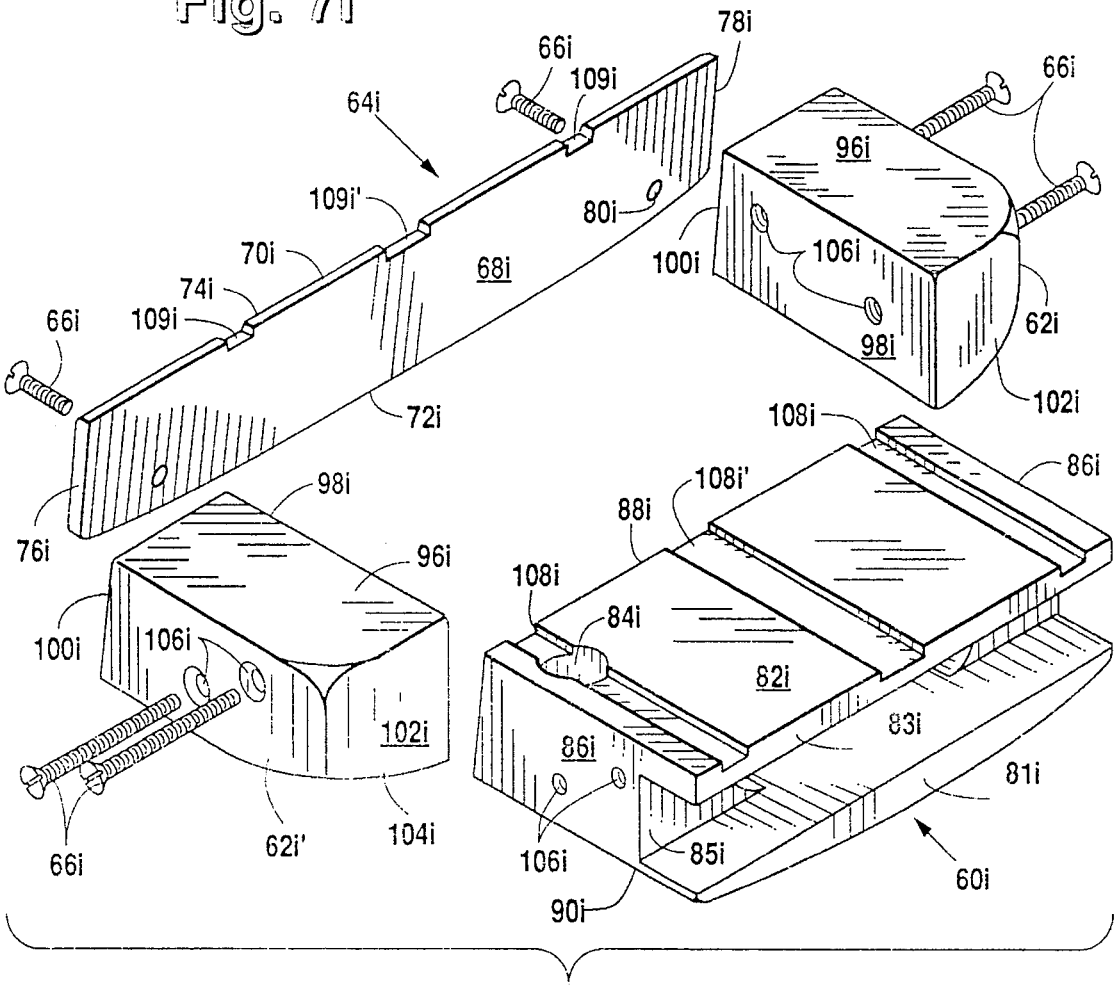
Figure 1J:
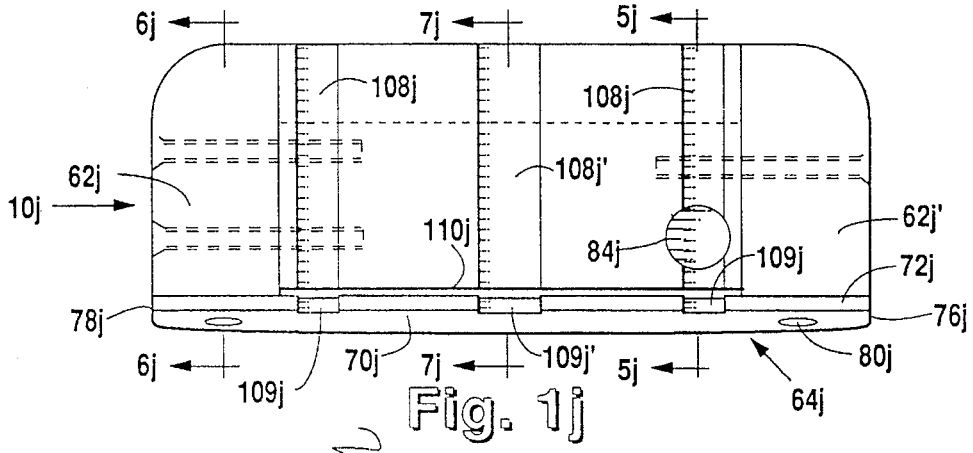
FIG. 1*j* is a top elevational view of a four-piece mallet putter head of the present invention having a suspended faceplate, an echo chamber with a front curtain with a single opening, improved alignment lines, and upper and lower rear overhangs.
Figure 2J:
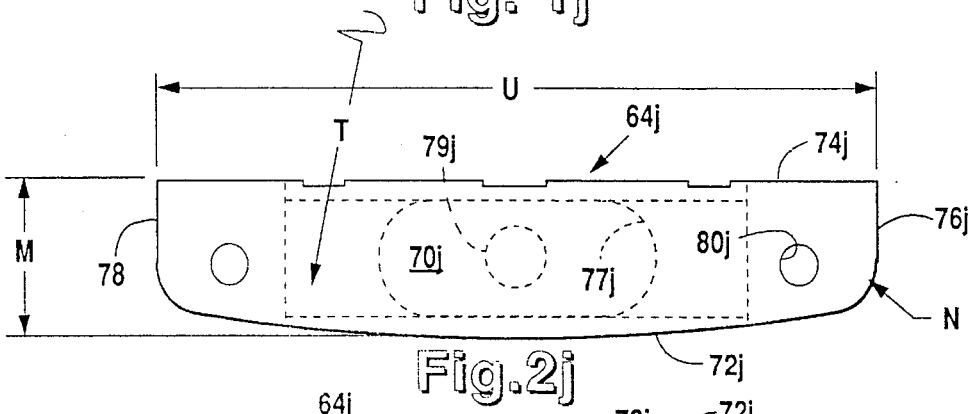
FIG. 2*j* is a front elevational plan view of a four-piece mallet putter head of the present invention having a suspended faceplate, an echo chamber with a front curtain with a single opening, improved alignment lines, and upper and lower rear overhangs.
Figure 3J:
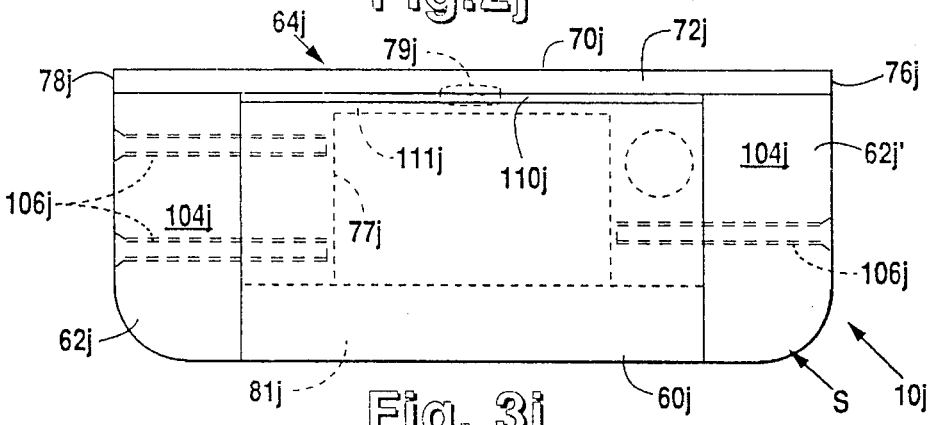
FIG. 3*j* is a bottom plan view of a four-piece mallet putter head of the present invention having a suspended faceplate, an echo chamber with a front curtain with a single opening, improved alignment lines, and upper and lower rear overhangs.
Figure 4J:
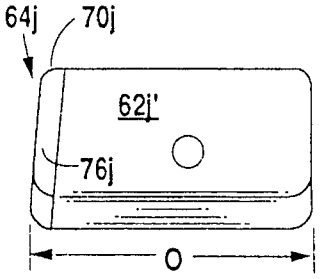
FIG. 4*j* is a heel end view of a four-piece mallet putter head of the present invention having a suspended faceplate, an echo chamber with a front curtain with a single opening, improved alignment lines, and upper and lower rear overhangs.
Figure 5J:
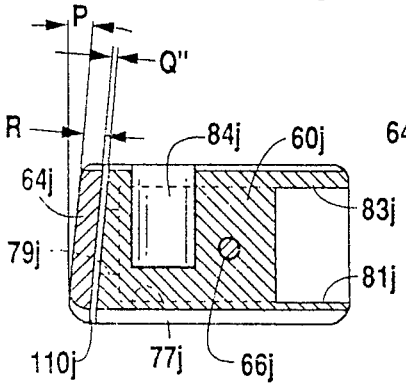
FIG. 5*j* is a cross-sectional view of a four-piece mallet putter head of the present invention having a suspended faceplate, an echo chamber with a front curtain with a single opening, improved alignment lines, and upper and lower rear overhangs taken along line 5*j*—5*j* of FIG. 1*j*.
Figure 6J:
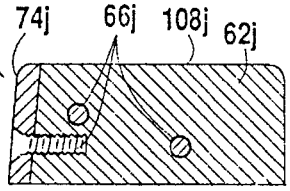
FIG. 6*j* is a cross-sectional view of a four-piece mallet putter head of the present invention having a suspended faceplate, an echo chamber with a front curtain with a single opening, improved alignment lines, and upper and lower rear overhangs taken along line 6*j*—6*j* of FIG. 1*j*.
Figure 8J:
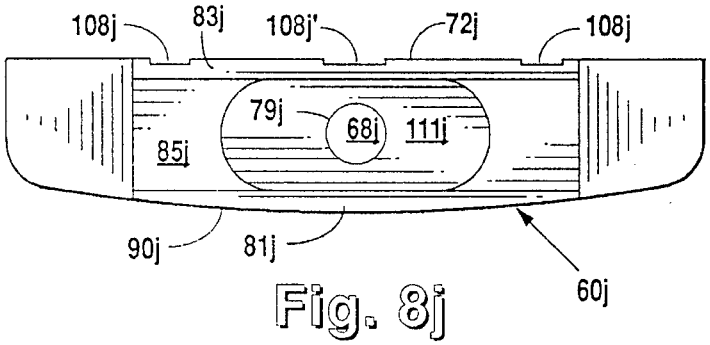
FIG. 8*j* is a rear elevational view of a four-piece mallet putter head of the present invention having a suspended faceplate, an echo chamber with a front curtain with a single opening, improved alignment lines, and upper and lower rear overhangs.
Figure 7J:
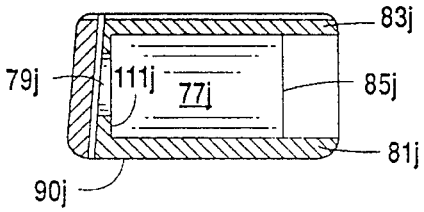
FIG. 7*j* is a cross-sectional view of a four-piece mallet putter head of the present invention having a suspended faceplate, an echo chamber with a front curtain with a single opening, improved alignment lines, and upper and lower rear overhangs taken along line 7*j*—7*j* of FIG. 1*j*.

FIG. 9*i* is an exploded perspective view of a four-piece mallet putter head of the present invention having a suspended faceplate, an echo chamber with a front curtain, improved alignment lines, and upper and lower rear overhangs.

Figure 9J:
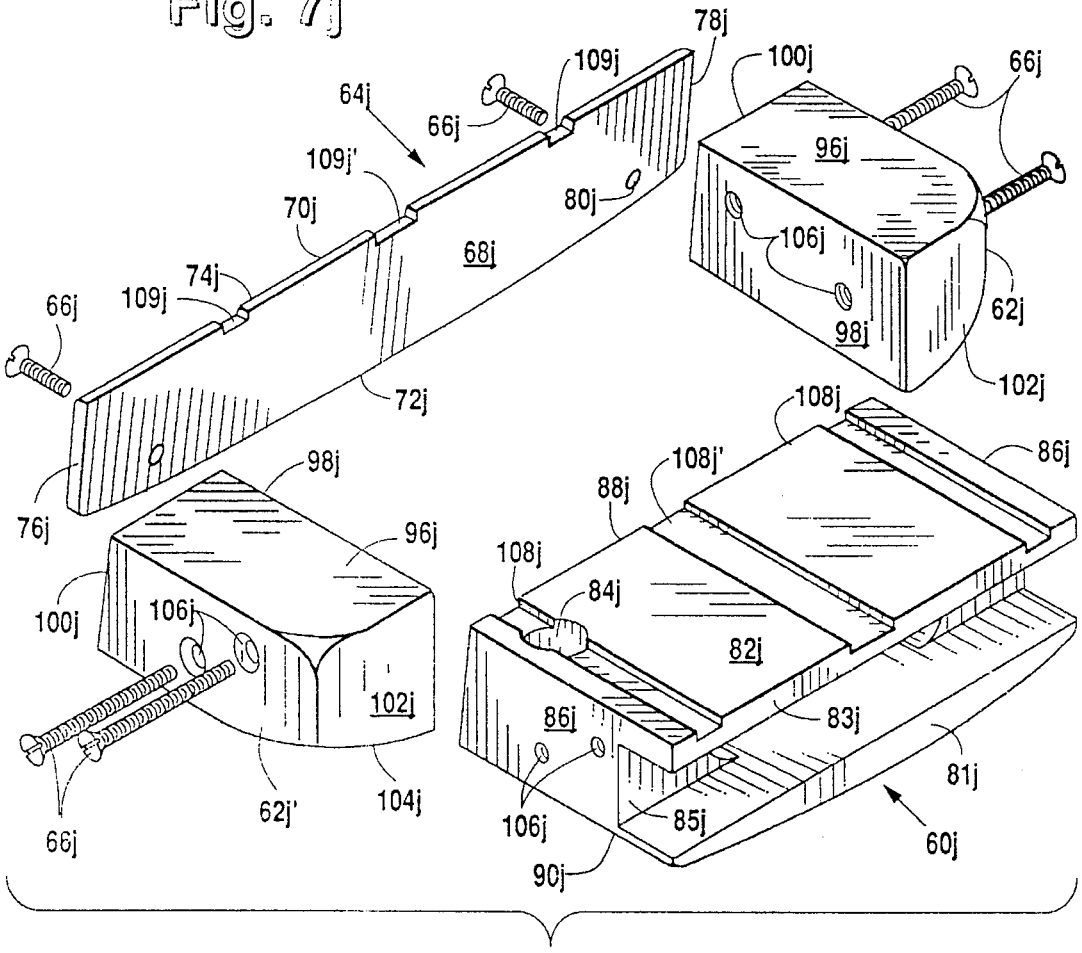
Figure 1K:
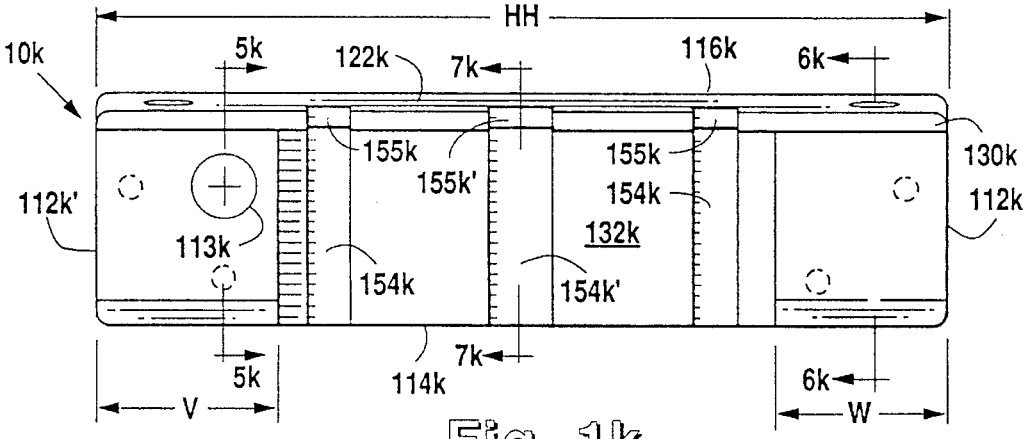
FIG. 1*k* is a top elevational view of a four-piece blade putter head of the present invention having an alternative suspended faceplate, and improved alignment lines.
Figure 2K:
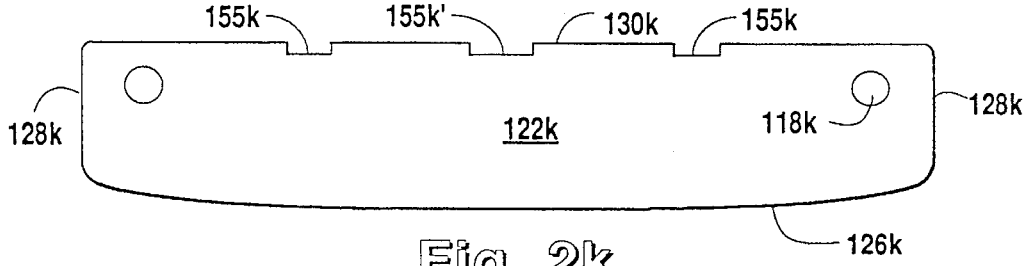
FIG. 2*k* is a front elevational view of a four-piece blade putter head of the present invention having an alternative suspended faceplate, and improved alignment lines.
Figure 3K:
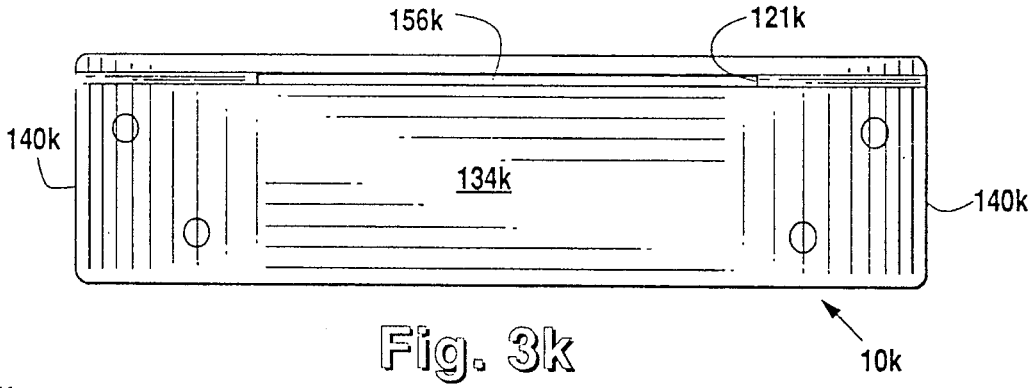
FIG. 3*k* is a bottom view of a four-piece blade putter head of the present invention having an alternative suspended faceplate, and improved alignment lines.
Figure 4K:
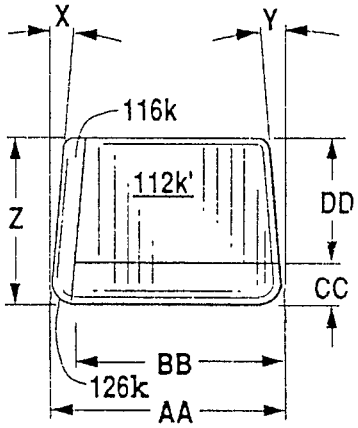
FIG. 4*k* is a heel end view of a four-piece blade putter head of the present invention having an alternative suspended faceplate, and improved alignment lines.
Figure 5K:
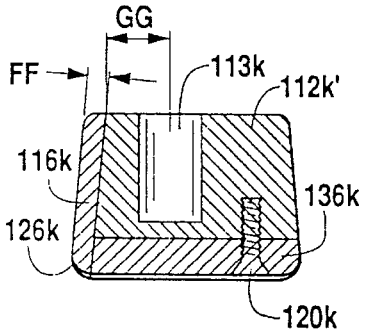
FIG. 5*k* is a cross-sectional view of a four-piece blade putter head of the present invention having an alternative suspended faceplate, and improved alignment lines taken along line 5*k*—5*k* of FIG. 1*k*.
Figure 6K:
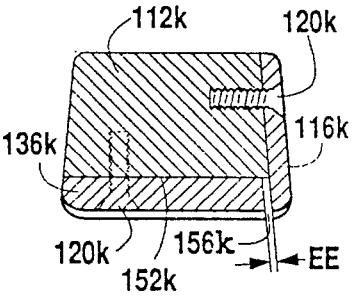
FIG. 6*k* is a cross-sectional view of a four-piece blade putter head of the present invention having an alternative suspended faceplate, and improved alignment lines taken along line 6*k*—6*k* of FIG. 1*k*.

FIG. 9*j* is an exploded perspective view of a four-piece mallet putter head of the present invention having a suspended faceplate, an echo chamber with a front curtain with a single opening, improved alignment lines, and upper and lower rear overhangs.

Figure 9K:
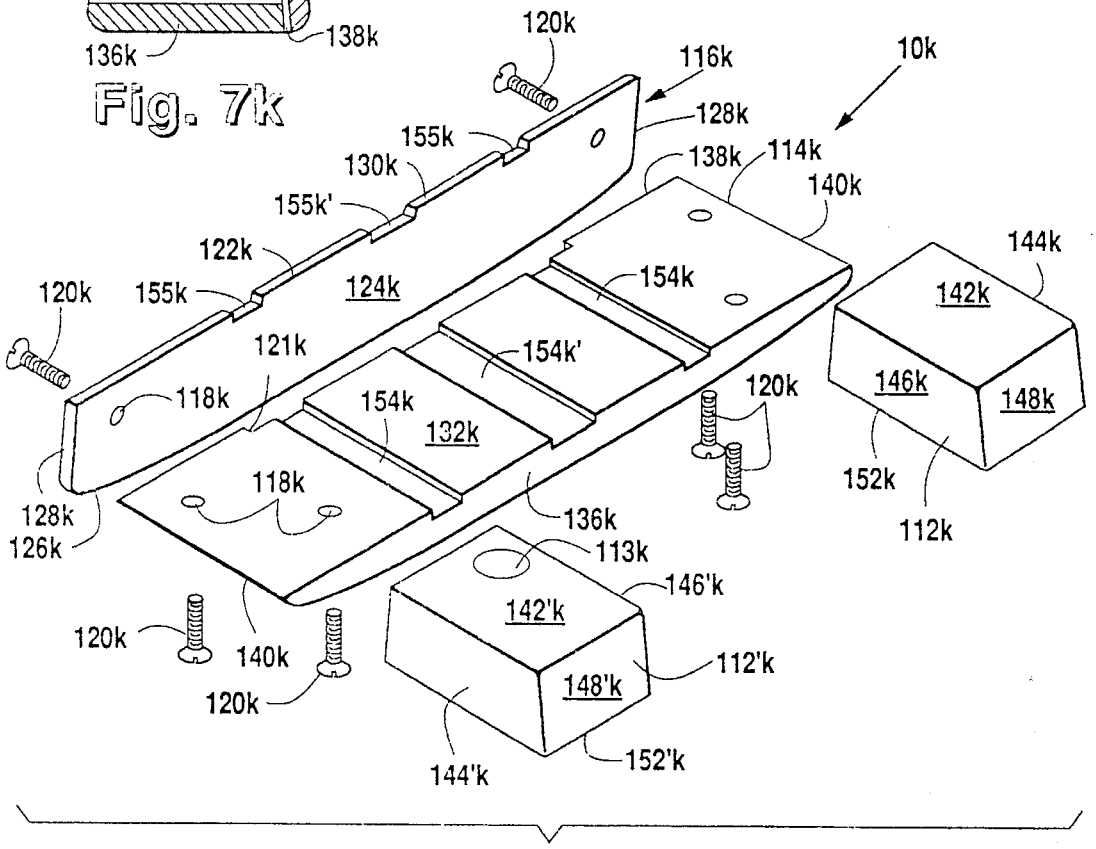
Figure 1L:
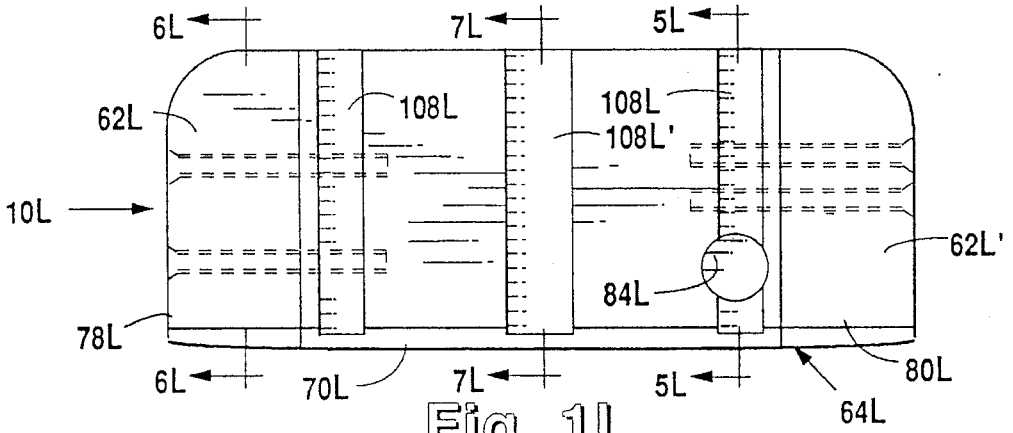
FIG. 1L is a top elevational view of a three-piece mallet putter head of the present invention having an echo chamber, improved alignment lines, and upper and lower rear overhangs.
Figure 2L:
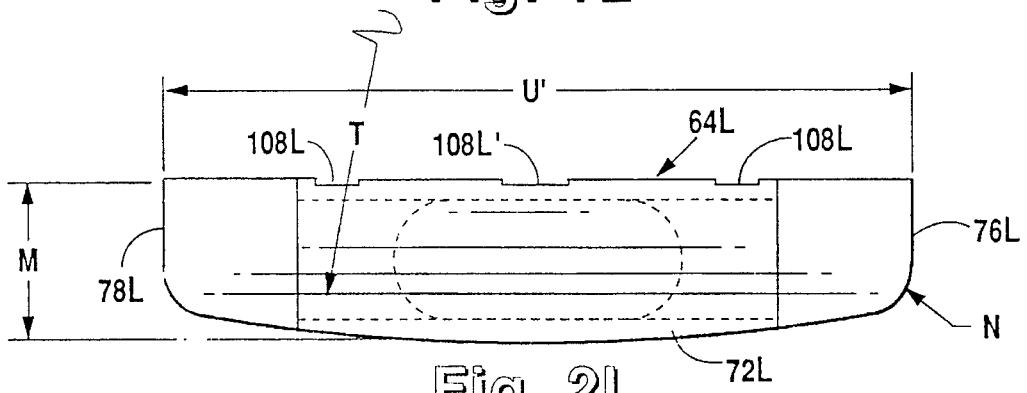
FIG. 2L is a front elevational plan view of a three-piece mallet putter head of the present invention having an echo chamber, improved alignment lines, and upper and lower rear overhangs.
Figure 3L:
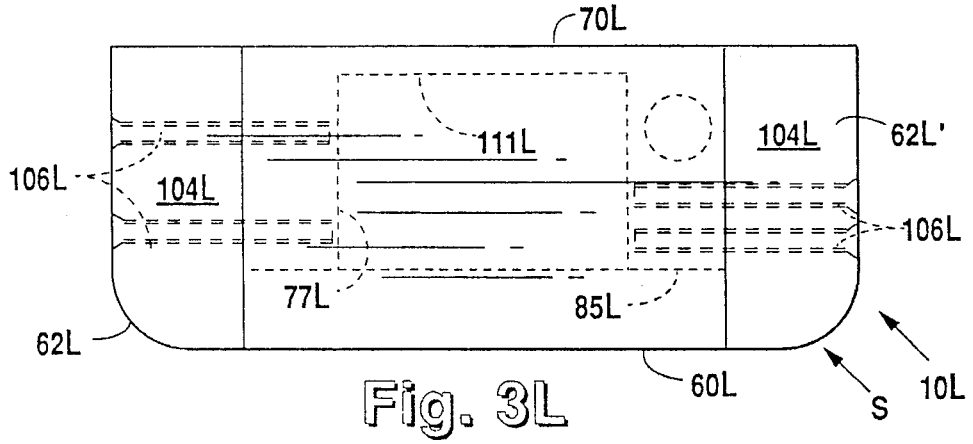
FIG. 3L is a bottom plan view of a three-piece mallet putter head of the present invention having an echo chamber, improved alignment lines, and upper and lower rear overhangs.
Figure 4L:
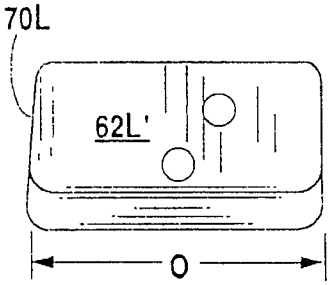
FIG. 4L is a heel end view of a three-piece mallet putter head of the present invention having an echo chamber, improved alignment lines, and upper and lower rear overhangs.
Figure 5L:
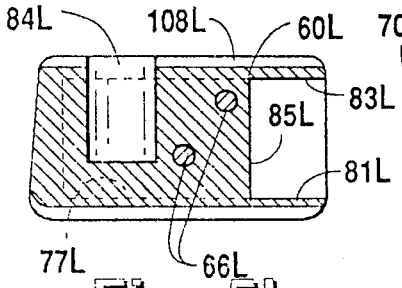
FIG. 5L is a cross-sectional view of a three-piece mallet putter head of the present invention having an echo chamber, improved alignment lines, and upper and lower rear overhangs taken along line 5L—5L of FIG. 11.
Figure 6L:
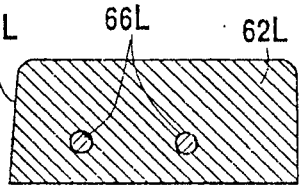
FIG. 6L is a cross-sectional view of a three-piece mallet putter head of the present invention having an echo chamber, improved alignment lines, and upper and lower rear overhangs taken along line 6L—6L of FIG. 1L.

FIG. 9*k* is an exploded perspective view of a four-piece blade putter head of the present invention having an alternative suspended faceplate, and improved alignment lines.

Figure 9L:
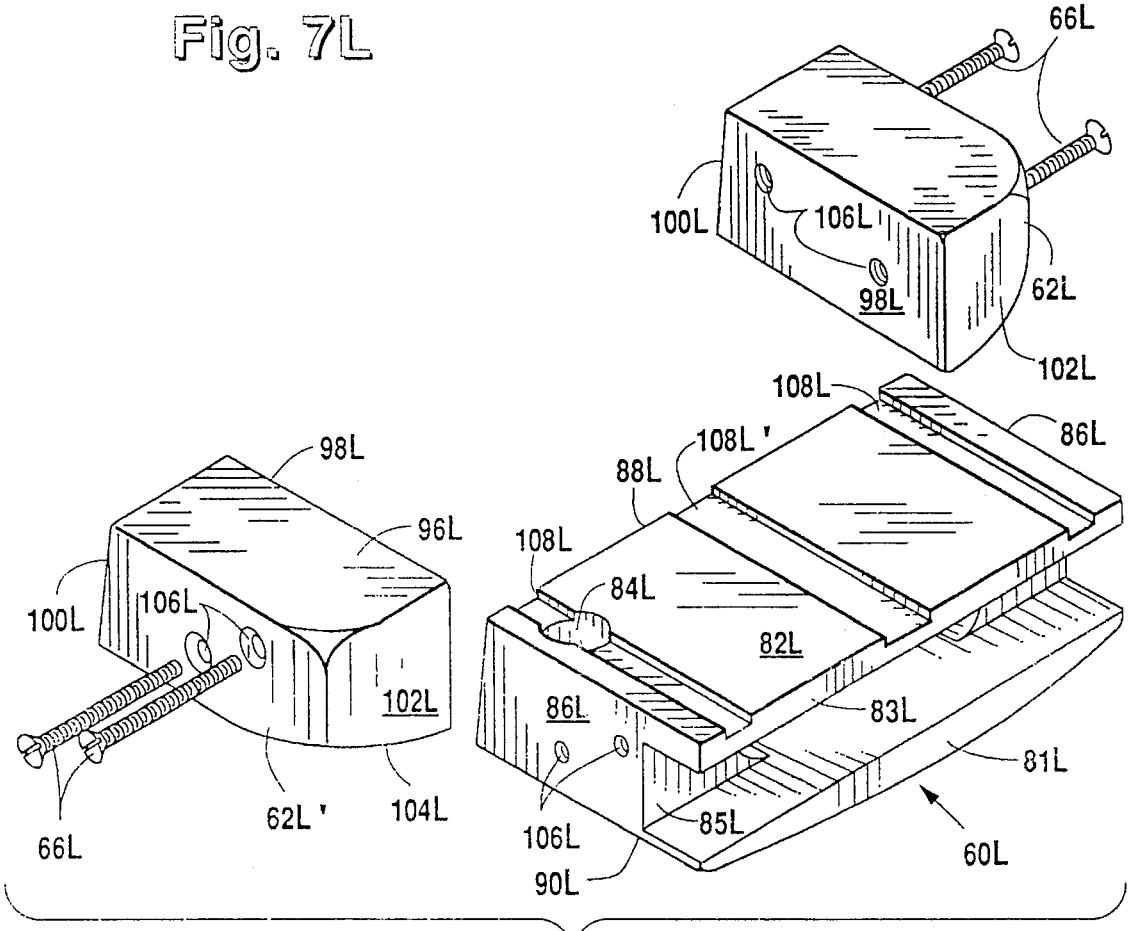

FIG. 9L is an exploded perspective view of a three-piece mallet putter head of the present invention having an echo chamber, improved alignment lines, and upper and lower rear overhangs.

Figure 10:
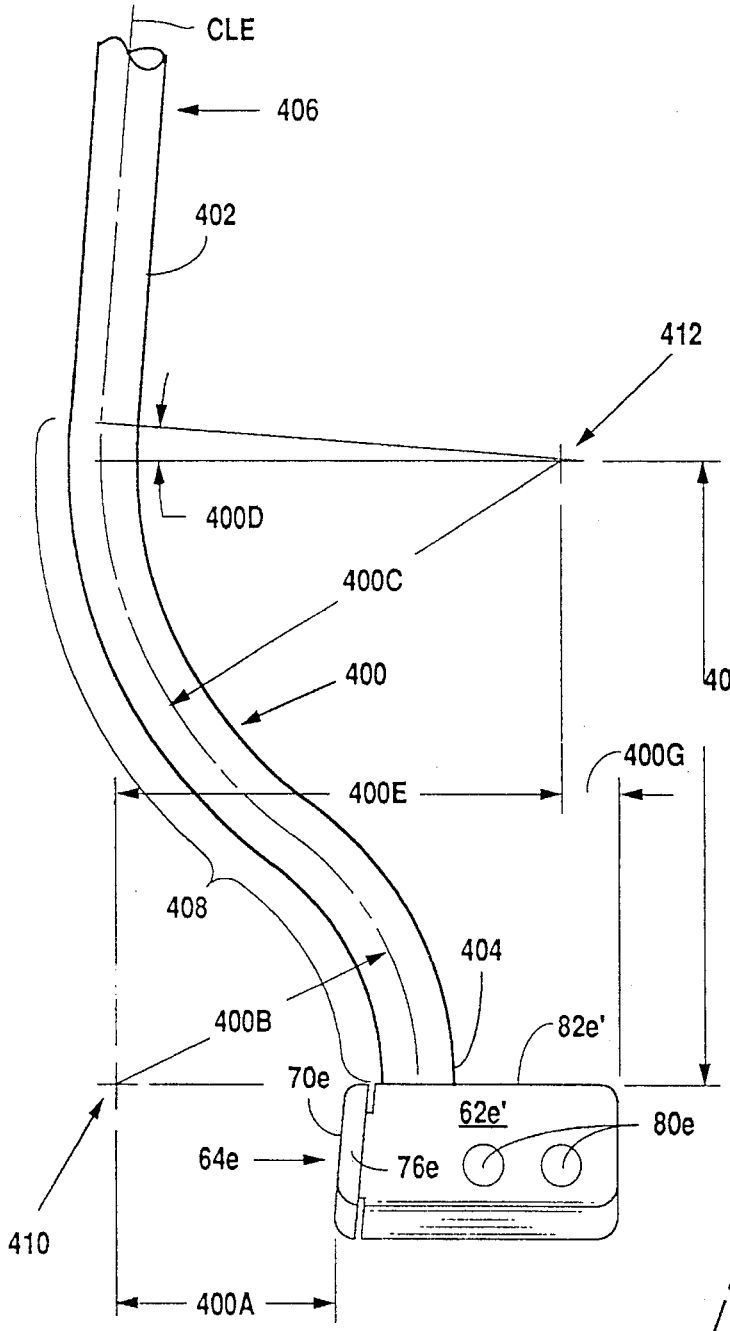

FIG. 10 is a heel end elevational view of a four-piece mallet putter head of the present invention having a fully suspended faceplate, an echo chambers, improved alignment lines, and a bent shaft.

Figure 11:
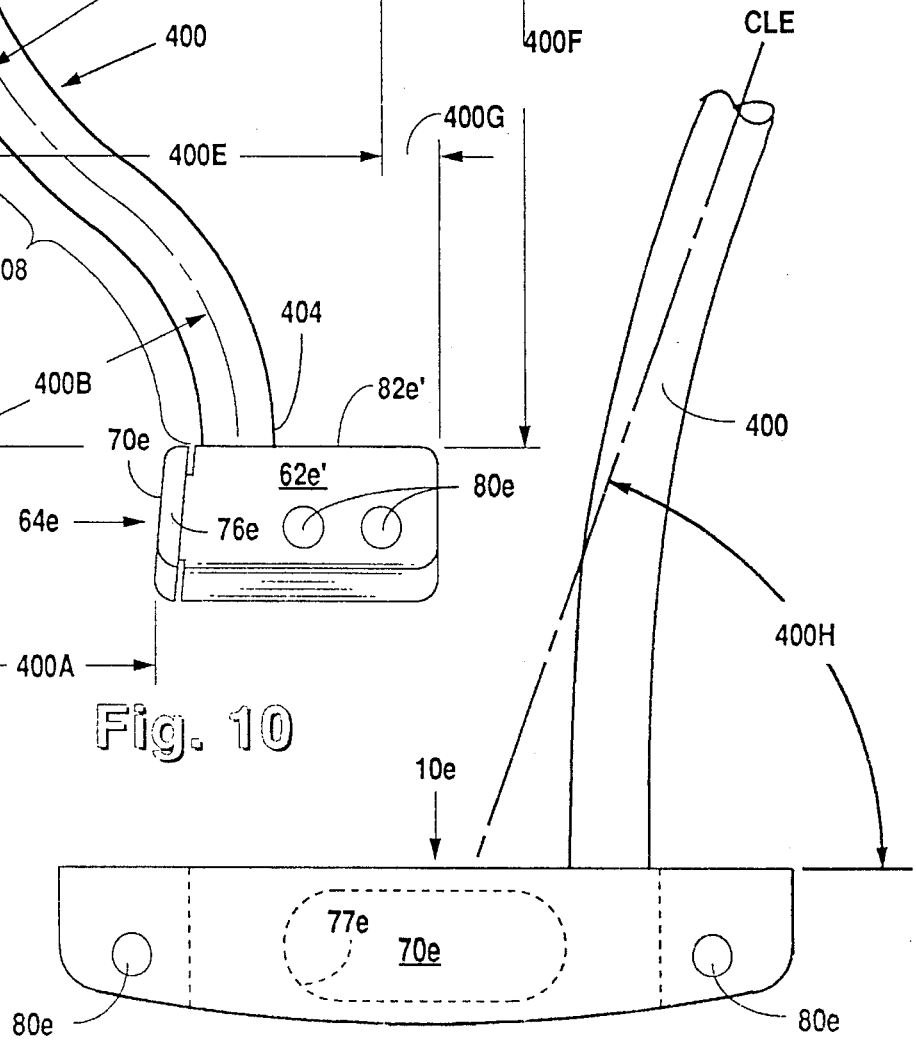

FIG. 11 is a front elevational plan view of a four-piece mallet putter head of the present invention having a fully suspended faceplate, an echo chamber, improved alignment lines and a bent shaft.

Figure 12:
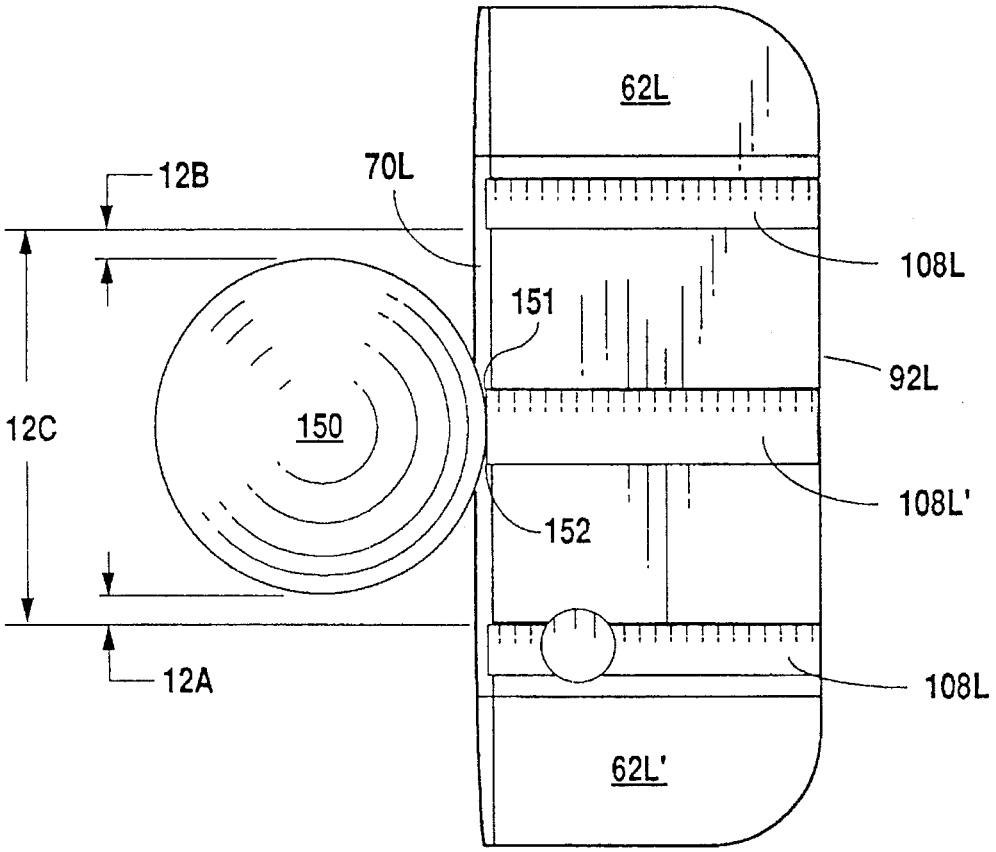

FIG. 12 is a top elevational view of a three-piece mallet putter head of the present invention having improved alignment lines illustrating the relationship of a golf ball properly aligned to the putter head.

Figure 13:
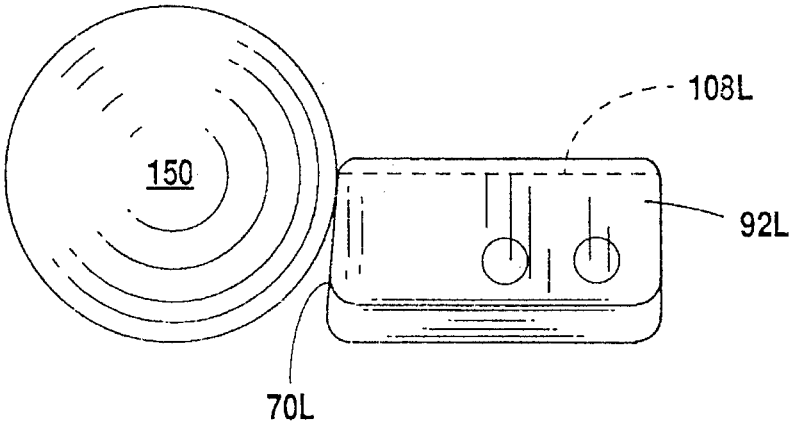

FIG. 13 is a heel end elevational view of a three-piece mallet putter head of the present invention having improved alignment lines illustrating the relationship of a golf ball properly aligned to the putter head.

Figure 14:
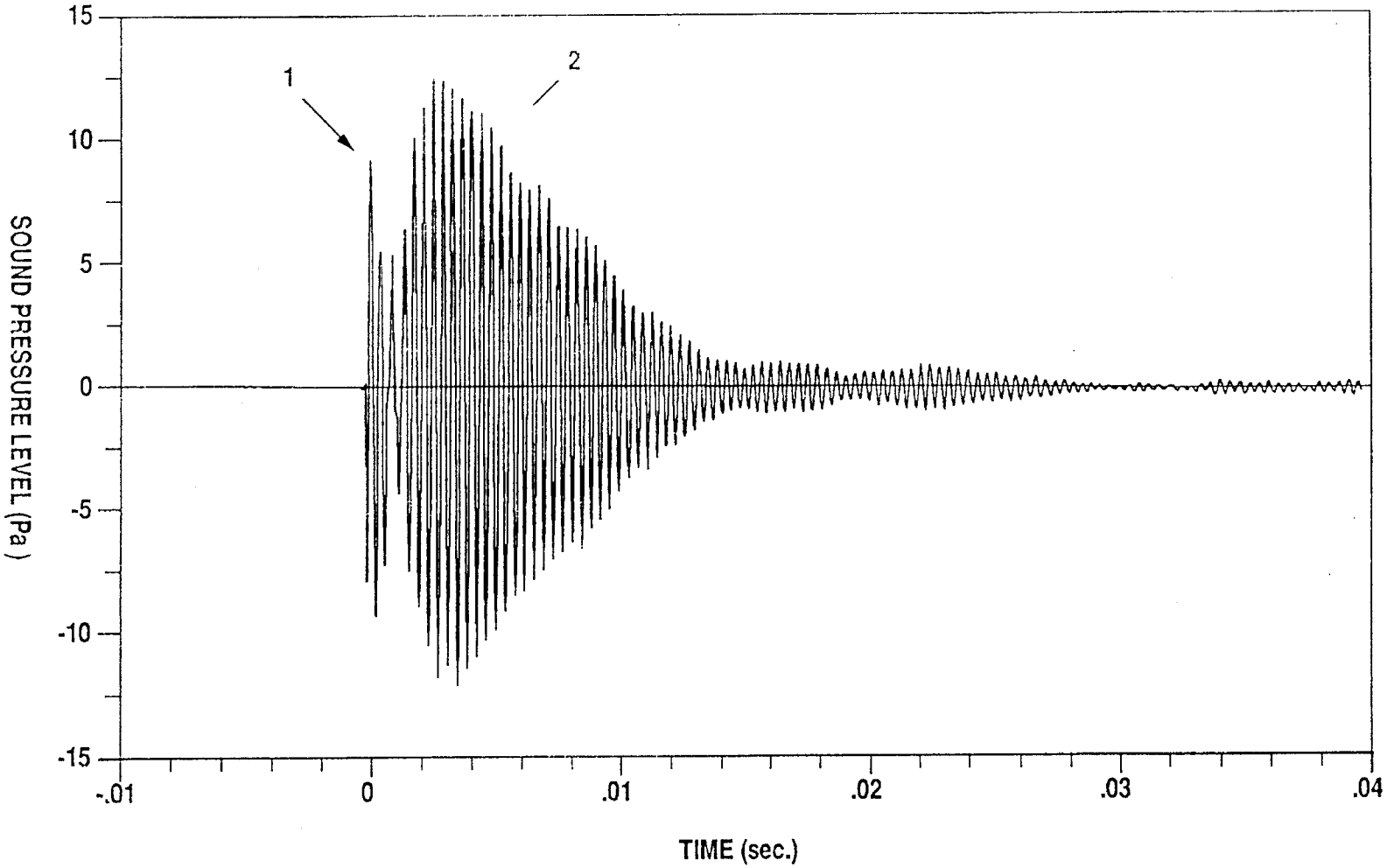

FIG. 14 is a time history acoustic response graph of the putter heads of the present invention embodying a rearwardly extending echo chamber.

DETAILED DESCRIPTION OF THE PREFERRED EMBODIMENT

Numerous embodiments of the present invention are presented in detail below. All embodiments, however, are characterized by the present invention's novel combination of head balance and weight distribution wherein 70%–97 of the total head weight is within ¾"–1" of the heel end and toe end of the club head.

The first embodiment is set forth in FIGS. 1–9, and provides for a three-piece putter head with faceplate integral with a base. The second embodiment is set forth in FIGS. 1*a*–9*a* and provides for a four-piece mallet putter head with a suspended faceplate. The third embodiment is set forth in FIGS. 1*b*–9*b* and provides for a four-piece blade putter head with a suspended faceplate. The fourth embodiment is set forth in FIGS. 1*c*–9*c* and provides for a four-piece mallet putter head with an echo chamber. The fifth embodiment is set forth in FIGS. 1*d*–9*d* and provides for a four-piece mallet-putter head with a fully suspended faceplate and an echo chamber. The sixth embodiment is set forth in FIGS. 1*e*–9*e* and provides for a four-piece mallet putter head with a fully suspended faceplate, an echo chamber with a front curtain on the chamber. The seventh embodiment is set forth in FIGS. 1*f*–9*f* and provides for a four-piece mallet putter head with a fully suspended faceplate and an echo chamber with a front curtain on the chamber and the front curtain having a single opening therein. The eighth embodiment is set forth in FIGS. 1*g*–9*g* and provides for a four-piece mallet putter head having a fully suspended faceplate and an echo chamber with a front curtain on the chamber and the front curtain having a plurality of openings therein. The ninth embodiment is set forth in FIGS. 1*h*–9*h* and provides for a four-piece mallet putter head having a fully suspended faceplate, an echo chamber, improved alignment lines, and upper and lower rear overhangs. The tenth embodiment is set forth in FIGS. 1*i*–9*i* and provides for a four-piece mallet putter head having a suspended faceplate, an echo chamber with a front curtain, improved alignment lines, and upper and lower rear overhangs. The eleventh embodiment is set forth in FIGS. 1*j*–9*j* and provides for a four-piece mallet putter head having a suspended faceplate, an echo chamber with a front curtain with a single opening therein, improved alignment lines, and upper and lower rear overhangs. The twelfth embodiment is set forth in FIGS. 1*k*–9*k* and provides a four-piece blade putter head having an alternative suspended faceplate and improved alignment lines. The thirteenth embodiment is set forth in FIGS. 1L–9L and provides for a three-piece mallet putter head having an echo chamber, improved alignment lines, and upper and lower rear overhangs. The fourteenth embodiment is set forth in FIGS. 1*m*–4*m* and provides a three-piece blade putter head with a narrow faceplate, improved alignment tabs, but there is no bottom plate or bottom section on the putter head. A variation of this fourteenth embodiment has only one alignment tab (FIGS. 5*m*–6*m*). The fifteenth embodiment is set forth in FIGS. 1*n*–4*n* and provides a three-piece blade putter head with a hosel. The sixteenth embodiment is set forth in FIGS. 1*o*–4*o* and provides a three-piece blade putter head with an offset hosel. The seventeenth embodiment is set forth in FIG. 10 and provides a four-piece mallet putter head similar to that disclosed in FIGS. 1*e*–9*e* with a 1½" shaft bend in front of the putter face on a shaft in-head mounted putter.

A number of variations of the basic elements disclosed in this application are envisioned to be combined to provide for improved golf clubs.

FIGS. 1–9 illustrate a putter head (10) of the present invention. More specifically, FIGS. 1–9 provide various views of three-piece putter head (10) comprising generally L-shaped bracket (12), a toe end block (14) and a heel end block (14'). L-shaped bracket (12) is provided with a base (16) and a generally tabular face (18) of uniform thickness. Screws (20) are dimensioned for receipt through walls defining holes (22) of base (16) and face (18) to thread into toe end block (14) and heel end block (14') respectively to complete the assembly of putter head (10). Shaft bore (24) in heel end block (14') is dimensioned for receipt of a shaft of a golf club (not shown).

Indicia (26) are provided for marking across the top surface of putter head (10). Indicia (26) provide assistance to the golfer in aligning his swing with a line between the ball and the cup to help hole the putt. Indicia (26') represents a line about which putter head (10) is geometrically symmetrical and also represents the line which meets face (18) at the sweet spot, around which there is zero torque. Improved wide indicia or wide alignment lines as described below may be marked across the top surface of putter head (10).

Heel end block (14') is 1 3/64" and toe end block (14) is 1" long, shaft bore (24) compensating for the extra dimension of heel end block (14'). That is, toe end block (14) and heel end block (14') are similarly dimensioned, of the same weight or mass, made of material of the same high density, preferably bronze, and located an equal distance outboard from indicia (26'). The putter head (10) is generally bilaterally symmetrical about indicia (26') except for shaft bore (24) compensations, which effects are minimal.

Turning now to the details of L-shaped bracket (12), it may be seen that face (18) is symmetrical about indicia (26'), is generally tabular in nature and has a uniform thickness from top to bottom and side to side. More specifically, L-shaped bracket (12) is comprised of planar rear surface (28) and planar front surface (30). Front surface (30) and rear surface (28) are parallel, thereby providing uniform thickness to face (18). Rear surface (28) and front surface (30) are joined by bottom edge (32), side edge (34), top edge (36) and side edge (38), the edges comprising the perimeter of face (18).

Turning now to the details of base (16) of L-shaped bracket (12), it is seen that base (16) is symmetrical about indicia (26') and provided with a generally planar top surface (40), rear wall (42), side edges (44) and (46) and slightly radiused bottom surface (50). As set forth above, top surface (40) has indicia (26), or improved wider alignment lines described below, inscribed thereon. Moreover, it is seen that base (16) of L-shaped bracket (12) has a front edge (48) which is integral with bottom edge (32) of face (18). As may be appreciated with references to FIGS. 4, 5 and 6, face (18) and base (16) join at an included angle which is slightly less than 90°. This provides loft to the face (18).

Figure 5:
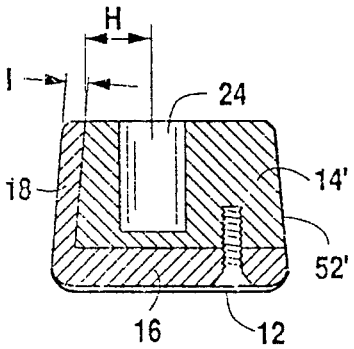
FIG. 5 is a cross-sectional view of a three-piece blade putter head of the present invention taken along line 5—5 of FIG. 8.
Figure 6:
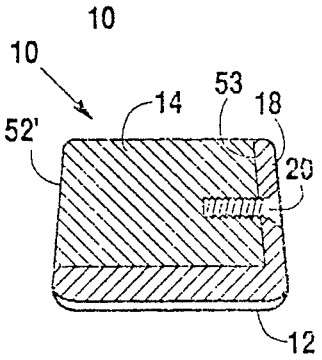
FIG. 6 is a cross-sectional view of a three-piece blade putter head of the present invention taken along line 6—6 of FIG. 1.
Figure 8:
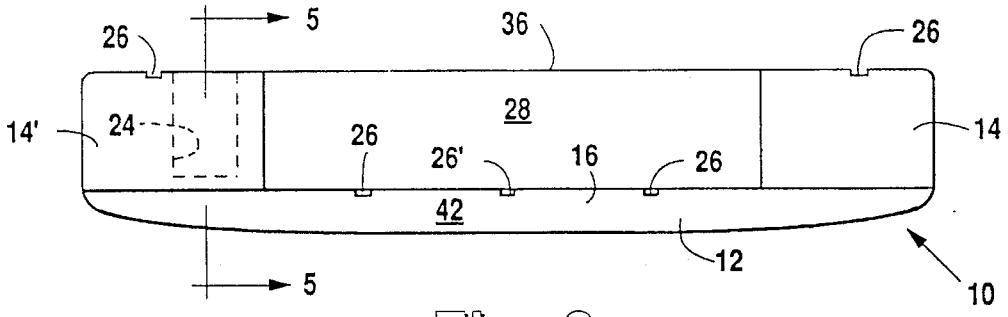
FIG. 8 is a rear elevational plan view of a three-piece blade putter head of the present invention.
Figure 7:
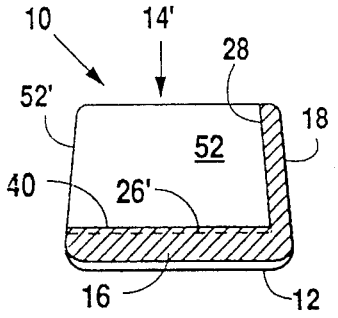
FIG. 7 is a cross-sectional view of a three-piece blade putter head of the present invention taken along line 7—7 of FIG. 1.

The same angle of loft is carried over to rear surfaces (52') of both toe end block (14) and heel end block (14') (see FIGS. 5 and 6). Turn now to the details of end block (14) and (14'). More specifically, end blocks (14) and (14') are provided with planar side walls (52), a planar top surface (54) and a planar bottom surface (56). The included angle between bottom surface (56) of end blocks (14) and (14') and front surface (53) that abuts the back of the face (18) will be the same angle as the loft of face (18).

The preferred material for manufacturing end blocks (14) and (14') is bronze, but any high density metal could be used, preferably having a specific gravity of between 5 and 12. L-shaped bracket (12) is made of aluminum or any other strong, light metal. Bronze has a high density and the location of end blocks (14) and (14') outboard the bilateral axis of symmetry as represented by indicia (26') provides a high moment of inertia about the sweet spot and therefore less torque imparted by the stroke that strikes the golf ball off the sweet spot. Further modifications of this embodiment are discussed below. The preferred dimensions A-L (as found in FIGS. 1, 4 and 5) are set forth in Table I below and provide for approximately 80% of the weight of putter head (10) to be located within one inch of the heel and toe ends.

TABLE I

Figure 1:
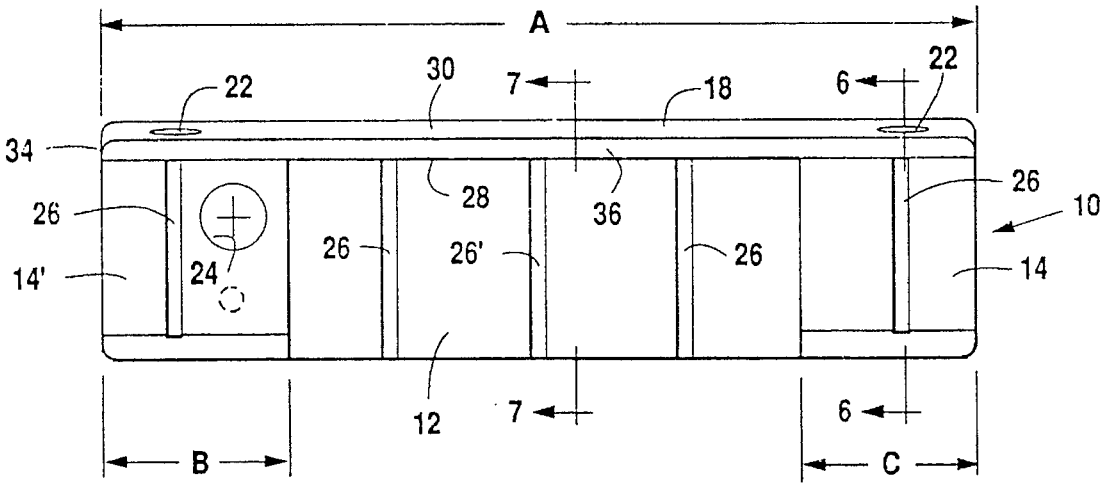
FIG. 1 is a top elevational view of a three-piece blade putter of the present invention.
Figure 2:
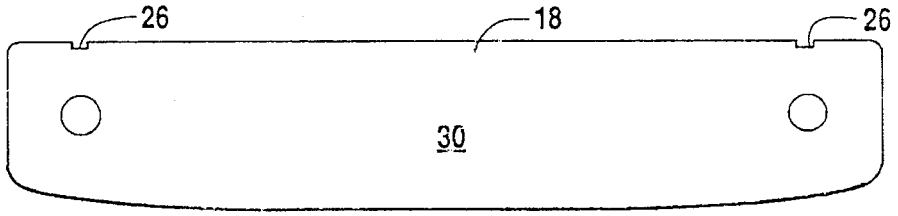
FIG. 2 is a front elevational view of a three-piece blade putter head of the present invention.
Figure 3:
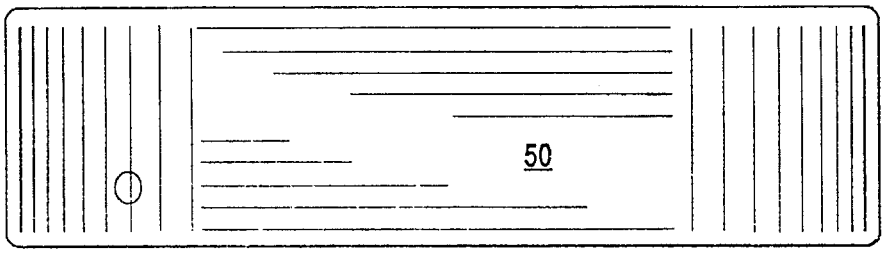
FIG. 3 is a bottom view of a three-piece blade putter of the present invention.
Figure 4:
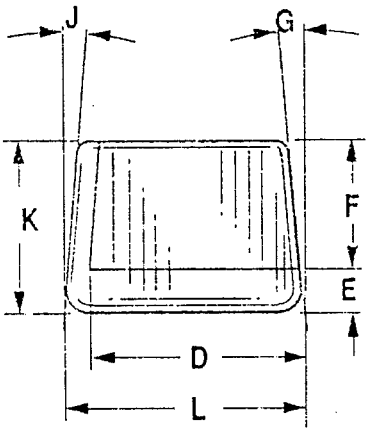
FIG. 4 is a heel end view of a three-piece blade putter head of the present invention.

| LOCATION | | DESCRIPTION | PREFERRED DIMENSION | PREFERRED RANGE |
|---|---|---|---|---|
| FIG. 1 | A | Length of Putter Head | 5" | 3⅝" to 6¾" |
| FIG. 1 | B | Length of Heel End Block | 1 3/64" | ½" to 1½" |
| FIG. 1 | C | Length of Toe End Block | 1" | ⅝" to 1½" |
| FIG. 4 | D | Width of Top Surface of Base | 1¼" | ¾" to 1½" |
| FIG. 4 | E | Thickness of Base | ¼" | ⅛" to ½" |
| FIG. 4 | F | Inside Height of Face | 23/32" | ½" to 1¼" |
| FIG. 4 | G | Trailing Loft of Heel and Toe Blocks | 5° | 0° to +10° |
| FIG. 5 | H | Distance Between Top Edge of Face and Center of Shaft Bore | ⅜" | ⅛" to ½" |
| FIG. 5 | I | Thickness of Face | 7/64" | 3/32" to ½" |
| FIG. 4 | J | Loft of Face | 5° | 0° to +10° |
| FIG. 4 | K | Height of Face | 31/32" | ⅝" to 1½" |
| FIG. 4 | L | Width of Club Base Including Face | 1 23/64" | ⅞" to 1½" |

Turning now to FIGS. 1*a*–9*a*, it is seen that putter head (10*a*) is comprised of four major pieces. That is, four-piece putter head (10*a*) is comprised of frame (60), toe end block (62*a*), heel end block (62*a'*) and face (64). Like the three-piece head, the four pieces are held together by screws (66) to form a single piece unit. Face (64) is generally tabular in nature (see FIG. 2*a*) and has rear surface (68) and front surface (70), the surfaces joined by a perimeter including radiused bottom surface (72), straight sides (76) and (78) and straight top edge (74). One of the novelties of the present invention is that four-piece putter (10*a*) has, as with three-piece putter (10), a uniform thickness to face (64).

Turning now to frame (60), it is seen that the general shape of frame (60) is rectangular having a generally flat top surface (82) with a shaft bore (84) in the aluminum frame therein for connecting putter head (10*a*) to shaft of a golf club. Side walls (86), front wall (88), rear surface (92) (FIG. 9*a*) all being generally flat, and contoured bottom surface (90) complete the general rectangular shape of frame (60).

End blocks (62*a*) and (62*a'*) are similarly dimensioned and of the same weight or mass, having top surface (96) which is generally flat, an inner side wall (98) and a front wall (100). The edge between front wall (100) and inner side wall (98) is front edge (99) as seen in FIG. 9*a*. Planar top surface (96), generally flat bottom surface (104) and curved outer walls (102) complete end blocks (62*a*) and (62*a'*). Toe end block (62*a*) has two threaded bores (106) for receipt of screws (66) therein. Heel end block (62*b*) has one threaded bore (106). These threaded bores extend into side walls (86) of frame to affix end blocks (62*a*) and (62*a'*) in fixed spaced relation about frame (60).

Indicia (108) are inscribed on top surfaces (82) and (96) in a manner similar to those set forth with three-piece putter head (10) above. That is, indicia (108) includes indicia (108*a*) which is a line representing the geometric center (108*a*) of putter head (10*a*). The sweet spot of putter head (10*a*) lies on face (64) adjacent and on line corresponding with an extension of (108*a*) across face (64), again, assisting the golfer in lining up the putt. Moreover, like three-piece putter head (10), four-piece putter head (10*a*) is generally symmetrical about a plane vertically through indica (108*a*). Improved wider indicia as described below may be marked across the top surface of the frame (60) and the top edge of face (64). This provides a sweet spot about which there is zero torque and a high moment of inertia, end blocks (62*a*) and (62*a'*) being made of bronze or similarly dense material. Frame (60) and face (64) are preferably made of aluminum. Face (64) is mounted to end blocks (62*a*) and (62*a'*) such that there is a loft of preferably 5° and generally between 0° and +10°.

Figure 2A:
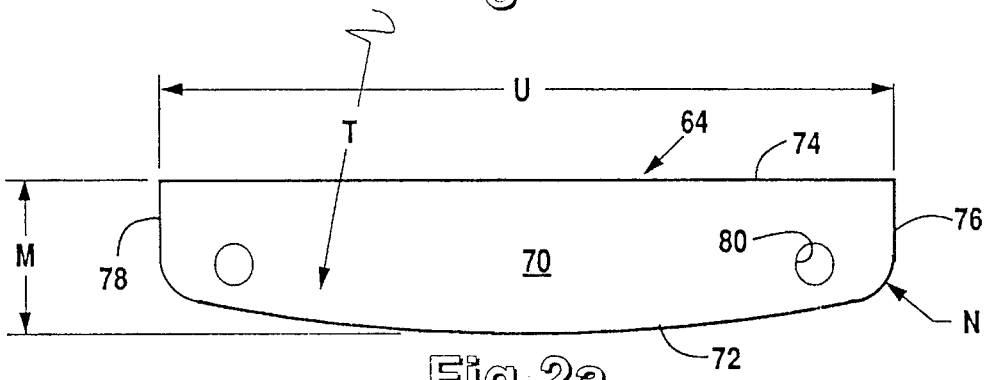
FIG. 2*a* is a front elevational view of a four-piece mallet putter head of the present invention.

The embodiment set forth in FIGS. 1*a*–9*a* provides an additional novelty not found in the three-piece head above. That is, when end blocks (62*a*) and (62*a'*) are affixed to frame (60), front edges (99) of the end blocks are set forward of front wall (88) of the frame to provide a space (110) between rear surface (68) of face (64) and front wall (88) off frame (60). This space is uniform side-to-side and up and down and provides better control and feel to the putter and enhances the feel and control when striking the golf ball. Moreover, it provides for a putter head with a suspended face—that is, a face attached to the putter head at only the removed ends thereof. As seen in FIGS. 2*a* and 9*a*, face (64) has holes (80) at the heel and toe ends thereof, for which to attach to end blocks (62*a*) and (62*a'*).

Preferred dimensions are set forth in Table II below, and when four-piece putter head (10*a*) is constructed according to these teachings, seventy percent (70%) of the weight of the head is within three-quarter inch (¾") of the heel and toe ends. The end blocks are preferably bronze but any high density metal with a specific gravity of between five and twelve may be used.

TABLE II

Figure 3A:
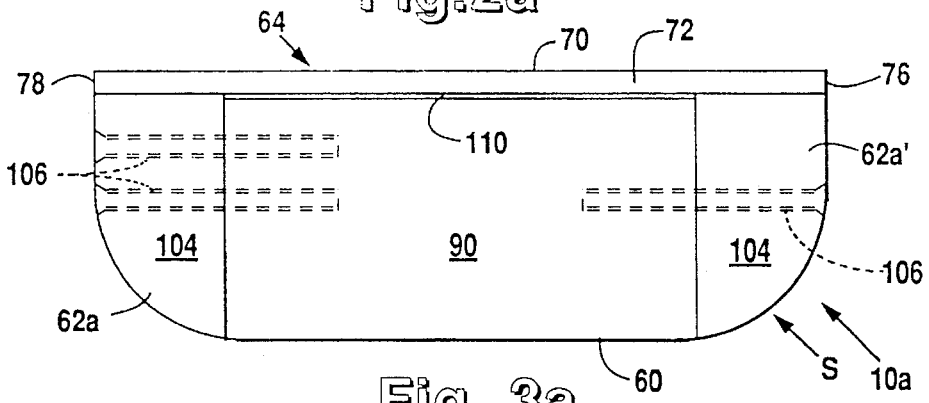
FIG. 3*a* is a bottom plan view of a four-piece mallet putter head of the present invention.
Figure 4A:
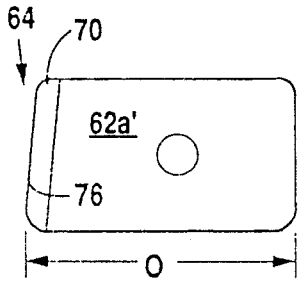
FIG. 4*a* is a heel end view of a four-piece mallet putter head of the present invention.
Figure 5A:
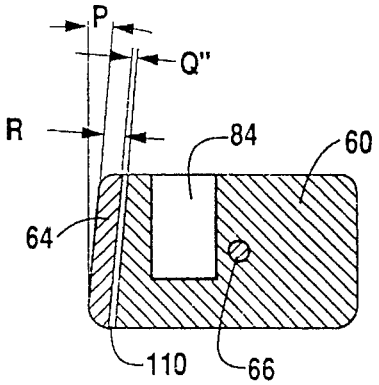
FIG. 5*a* is a cross-sectional view of a four-piece mallet putter head of the present invention taken along line 5*a*—5*a* of FIG. 1*a*.
Figure 6A:
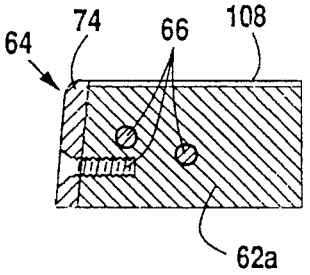
FIG. 6*a* is a cross-sectional view of a four-piece mallet putter head of the present invention taken along line 6*a*—6*a* of FIG. 1*a*.
Figure 8A:
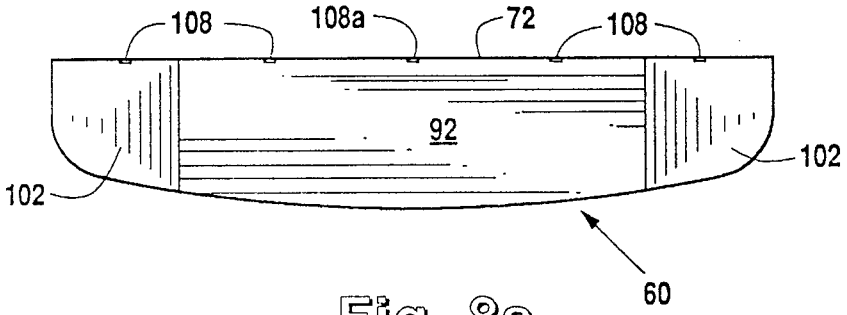
FIG. 8*a* is a rear elevational view of a four-piece mallet putter head of the present invention.
Figure 7A:
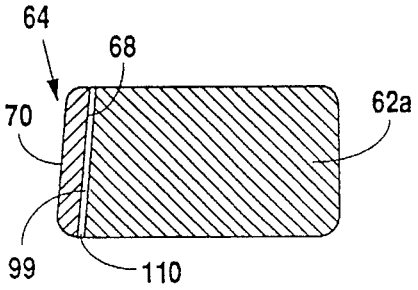
FIG. 7*a* is a cross-sectional view of a four-piece mallet putter head of the present invention taken along line 7*a*—7*a* of FIG. 1*a*.

| LOCATION | | DESCRIPTION | PREFERRED DIMENSION | PREFERRED RANGE |
|---|---|---|---|---|
| FIG. 2a | M | Height of Face | ⅞" | ⅝" to 1½" |
| FIG. 2a | N | Radius of Curvature of Lower Corners of Face | ¼" | ⅛" to ½" |
| FIG. 4a | O | Width of Bottom of Putter Head, Including Face | 1 35/64" | 1" to 2½" |
| FIG. 5a | P | Loft of Face | 5° | 0° to +10° |
| FIG. 5a | Q | Width of Space Between Face and Frame | 3/64" | 1/32" to ¼" |
| FIG. 5a | R | Thickness of Face | 7/64" | 1/32" to ¼" |
| FIG. 3a | S | Radius of Curvature of Heel and Toe End Blocks | ⅞" | ⅜" to 1" |
| FIG. 2a | T | Radius of Curvature of Bottom Edge of Face | 10" | 6" to 12" |
| FIG. 2a | U | Length of Face | 4¼" | 3⅝" to 5¾" |

Here again, as with the other embodiments, slight differences in size exist between the heel and toe end blocks to account for the shaft bore, yet keep the weights or masses the same.

FIGS. 1*b* through 9*b* illustrate a four-piece, suspended face putter head of the present invention (10*b*) As seen in FIG. 9*b* putter head (10*b*) is constructed of four main components: toe end block (112*b*), heel end block (112*b'*), with shaft bore (113) in the top surface thereof, base (114) and face (116). Screw holes (118) (in face) and (118') (in base) are provided as are screws (120) to hold the four pieces together as illustrated.

Figure 2B:
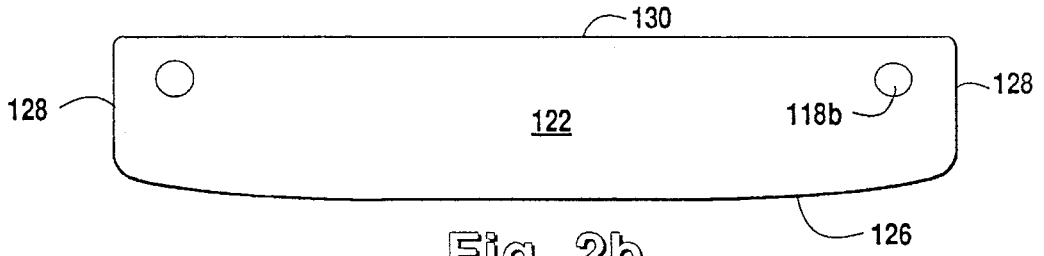
FIG. 2*b* is a front view of a four-piece putter blade head of the present invention, having a suspended faceplate.
Figure 3B:
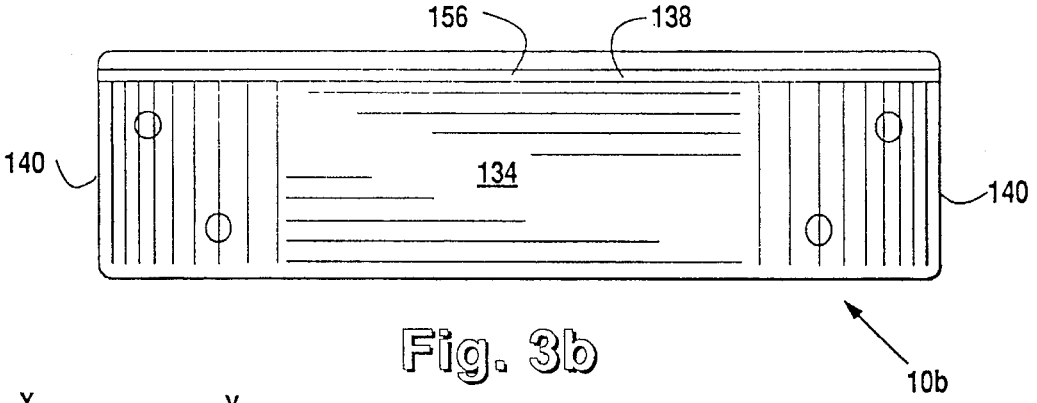
FIG. 3*b* is a bottom view of a four-piece blade putter head of the present invention, having a suspended faceplate.

Turning now to face (116), it is seen that it has a front surface (122) and a rear surface (124), both being planar and parallel, thus providing a uniform thickness thereto. A perimeter of face (116) is comprised of bottom edge (126), side edges (128), top edge (130), meeting to form an outline for face (116) which may be best appreciated in FIG. 2*b*.

Turning now to the details of base (114), it is seen that it is comprised of top surface (132) which is generally planar, and a curved bottom surface (134), rear wall (136) and front wall (138). Side edges (140) complete the structure of base (114). As can be appreciated in FIG. 9*b*, top surface (132) is generally flat, and bottom surface (134) is curved near side edges (140), as best appreciated in FIG. 8*b*.

Turning now to the details of end blocks (112*b*) and (112*b*'), they are seen to be comprised of generally rectangular prisms having top surfaces (142) and (142') which are generally flat, outer walls (144) and (144'), inner walls (146) and (146'), rear walls (148) and (148'), front walls (150) and (150'), and top surfaces (142) and (142'). As with the previous embodiments, face (116) is constructed such that it is provided with a loft in the general range as set forth in Table III below. That is, both toe end block (112*b*) and heel end block (112*b*') have front walls (150) and (150') typically describing an angle of slightly less than 90° with bottom surfaces (152) and (152'), respectively, to provide the loft to face (116). Likewise, trailing loft is provided wherein rear wall surfaces (148) and (148') inscribe an angle of slightly less than 90° with bottom surfaces (152) and (152'), respectively. The face and trailing edge loft can be appreciated with reference to dimensions X and Y in FIG. 4*b*.

Space (156) is provided by attaching blocks (112*b*) and (112*b*') to top surface (132) of base (114) such that front surfaces (150) and (150') of the end blocks are aligned such that they project forward of front wall (138) of base (114). Space (156) provides for a suspended face giving putter head (10*b*) more control and the golfer better feel for the stroke. This embodiment (10*b*) of four-piece putter head provides the high moment of inertia of the earlier described four-piece putter with the positive "feel" provided by face (116) having uniform thickness and space (156). In addition, both embodiments having suspended faces—that is, faces attached to the body of the putter head only at the removed ends thereof, produce a distinctive "click" when striking a golf ball on the sweet spot. A sound of a different pitch is produced when the ball strikes off the sweet spot—thus producing audible feedback to the golfer. Note, however, that the embodiment set forth in FIGS. 1*b*–9*b* discloses a gap or space (156) which runs the full length—preferable 5"—of the faceplate along the bottom while the gap or space runs only between inner walls (146) and (146') at the top. On the suspended face featured in FIGS. 1*a*–9*a*, the gap or space (110) is uniform along the top and bottom and runs only between front edges (99) of end blocks (62*a*) and (62*a*'). This does not provide as loud a "click" as the full-length suspended face.

As with the previous embodiments, end blocks (112*a*) and (112*b*) are of the same weight or mass and are preferably comprised of bronze or brass or a similar metal having high density. Base (114) of face (116) is preferably comprised of aluminum or other alloy being both strong and light.

The preferred dimensions are set forth in Table III below.

TABLE III

Figure 1B:
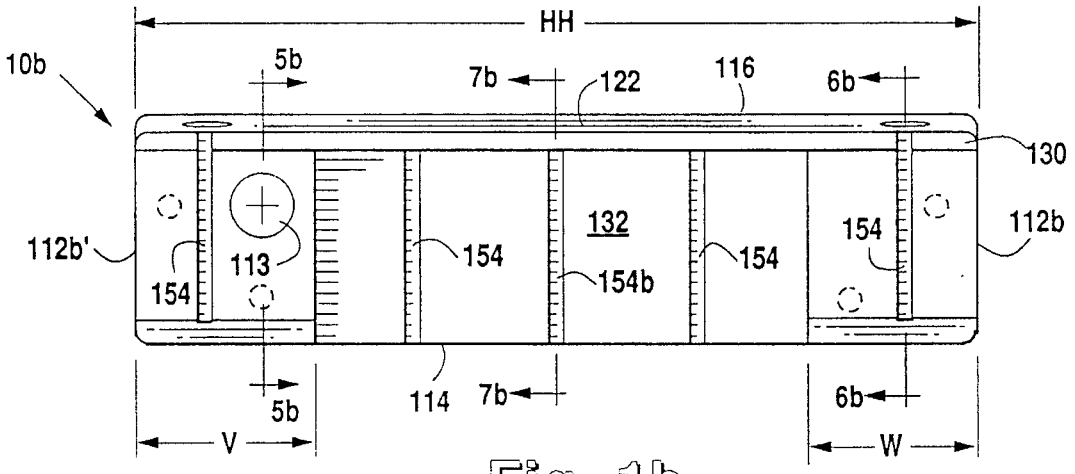
FIG. 1*b* is a top elevational view of a four-piece blade putter head of the present invention, having a suspended face plate.
Figure 4B:
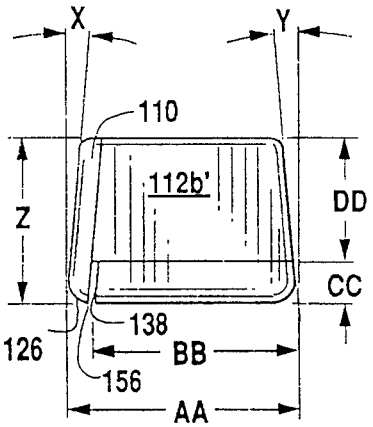
FIG. 4*b* is a heel end view of a four-piece blade putter head of the present invention having a suspended faceplate.
Figure 5B:
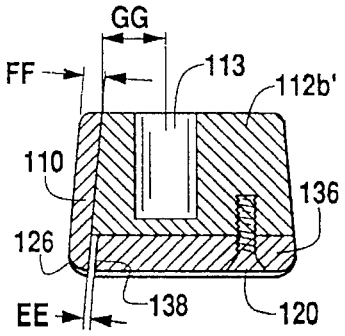
FIG. 5*b* is a cross-sectional view of a four-piece blade putter head of the present invention, having a suspended faceplate, taken along line 5*b*—5*b* of FIG. 8*b*.
Figure 6B:
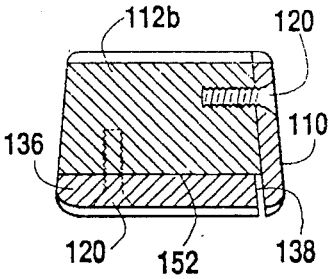
FIG. 6*b* is a cross-sectional view of a four-piece blade putter head of the present invention having a suspended faceplate, taken along line 6*b*—6*b* of FIG. 1*b*.

| LOCATION | | DESCRIPTION | PREFERRED DIMENSION | PREFERRED RANGE |
|---|---|---|---|---|
| FIG. 1b | V | Length of Heel End Block | 1 3/64" | ½" to 1½" |
| FIG. 1b | W | Length of Toe End Block | 1" | ⅝" to 1½" |
| FIG. 4b | X | Loft of Face | 5° | 0° to +10° |
| FIG. 4b | Y | Trailing Loft of Heel and Toe Blocks | 5° | 0° to +10° |
| FIG. 4b | Z | Height of Face | 31/32" | ⅝" to 1½" |
| FIG. 4b | AA | Width of Club Base, Including Face | 1 23/64" | ⅞" to 1½" |
| FIG. 4b | BB | Width of Top Surface Frame | 1¼" | ¾" to 1½" |
| FIG. 4b | CC | Thickness of Frame | ¼" | ⅛" to ½" |
| FIG. 4b | DD | Inside Height of Face | 31/32" | ⅝" to 1½" |
| FIG. 5b | EE | Width of Space Between Face and Frame | 3/64" | 1/32" to ¼" |
| FIG. 5b | FF | Thickness of Face | 7/64" | 1/32" to ¼" |
| FIG. 5b | GG | Distance Between Top Edge of Face and Center of Shaft Bore | ⅜" | ⅛" to ½" |
| FIG. 1b | HH | Length of Face | 5" | 3⅝" to 6¾" |

FIGS. 1*c*–9*c* illustrate a four-piece mallet putter head (10*c*) with a suspended faceplate (64*c*) with an echo chamber (77*c*). Generally, the same reference numeral is used in the embodiment of FIGS. 1*c*–9*c* as those used in FIGS. 1*a*–9*a* with the alphamerical designation changed. As a review of the illustrations of FIGS. 1*c*–9*c* disclose, this "10*c*" embodiment is essentially the same embodiment as the "10*a*" embodiment of FIGS. 1*a*–9*a*. The significant improvement is the formation of an echo chamber (77*c*). The removal of material from the frame (60*c*) allows for an increase in the percentage of the total weight of the putter head from 70% to 80% of the total putter head weight being within ¾" of the heel end and toe end of the putter head.

The center frame (60*c*) is constructed of lightweight aluminum having a density of 2.6989 grams per cubic centimeter with an ultimate tensile strength of 28,000 p.s.i. The face (88*c*) of the frame is milled to a 5° loft. Frame dimensions prior to the milling out of the chamber are 2¾" long, ⅞" deep, 1 7/16" wide at the bottom (60*c*) and 1⅜" wide at the top (82*c*). When the cavity (77*c*) is milled all the way through the center of the aluminum frame (60*c*), approximately 65 grams are removed from the frame weight. The 65 grams removed from the center of the putter is added to the brass or bronze end blocks (62*c* and 62*c*'). The two heavy brass or bronze blocks (62*c* and 62*c*') are ¾" long by 1½" wide at their extreme ends. End blocks (62*c* and 62*c*') are contoured to adjust the total putter head weight to 349 grams. 279 grams or approximately 80% of the total putter head weight is within ¾" of the heel end and the toe end when the echo chamber (77*c*) is milled out.

Faceplate 64*c* is a very thin, strong, plate of tempered aluminum of uniform thickness. The plate (64*c*) may be 7/64" to ⅛" thick. Plate (64*c*) is attached to face (100*c*) of end blocks (62*c* and 62*c*'). The end blocks are set forward of the center frame (60*c*) such that when the faceplate (64*c*) is attached, a 3/64" gap or space (110*c*) is formed and the faceplate has a 5° loft.

The material composition of the faceplate (64*c*) metal is different than the aluminum frame (60*c*). The aluminum alloy faceplate (64*c*) has a ultimate tensile strength of 45,000 p.s.i., with a hardness of 95 BHN, compared to the frame material hardness of 47 BHN. The use of the thin, hard faceplate cooperates in the development of the unique clicking sound of the present invention as will be described below.

The formation of echo chamber (77*c*) not only enables weight to be shifted to the end blocks; it creates a rearwardly extending chamber which tends to amplify the clicking sound of the present invention. By using the audible feedback the golfer is able to determine how hard the ball has been hit, thereby teaching him/her the forces needed on various length putts. As will be seen in further embodiments described below, the placement of sound curtains with or without apertures create unique audible feedback patterns. The variable clicking sounds range from a high intensity to a low intensity which is controllable by the echo chamber pattern used.

Results from acoustic testing indicate that the sound produced when a ball is struck is a definite unique "click" sound which is first produced. With the "10*c*" embodiment of FIGS. 1*c*–9*c*, the chamber (77*c*) is 1 7/16" wide at the bottom, 1 3/8" wide at the top, 1 9/16" long and 5/8" deep. This chamber (77*c*) yields a very loud, clean, clear, clicking sound which may be heard over a distance of 50 yards when the faceplate strikes a ball on a putt of ten feet or over. This sound is approximately 300% greater than the standard or normal type sound of a putter that does not have the chamber. FIG. 14 illustrates a typical time history acoustic response of the putter heads of the present invention embodying a rearwardly extending echo chamber.

The test procedure which resulted in FIG. 14 was to grip a putter shaft in a vice clamp so as to position the back (92*c*) of the putter head (10*c*) approximately six inches above a 1/2 inch acoustic microphone. The microphone was calibrated before testing. A standard golf ball was dropped on the faceplate (64*c*) of the putter head (10*c*) from a height of approximately 6 inches. The microphone measured the resulting acoustic pressure from the impact and the signal was recorded. A single pulse capture method was used.

With the "10*c*" embodiment, the total sound pressure level measured from impact was 100±1 dBA. The overall acoustic energy measurement gives an idea of the relative loudness level achieved. The time history of the sound pressure level measured shows the variation of sound generated from the moment of impact of the putter head to when the sound dies out. FIG. 14 indicates at the moment of impact (time=0 seconds) a large pulse is seen which for embodiment "10*c*" had a pressure of around 10 Pa. This pulse is very short in duration (less than 0.001 seconds in embodiment "10*c*") and dies quickly (to around 5 Pa in embodiment "10*c*"). This pulse is the "click" sound and is indicated by the reference numeral 1 in FIG. 14. Following this pulse a signal is generated (which in embodiment "10*c*" had a maximum amplitude of approximately 12 Pa) and lasts much longer than the "click" sound (from 0.0002 seconds to in excess of 0.02 seconds). This second portion of the signal is the supplemental ringing sound of the putter impact and is indicated by reference numeral 2 in FIG. 14. As will be pointed out further, modifications to the echo chamber result in a controllable variation in the amplitude of the "click" sound with alternative embodiments.

Figure 1D:
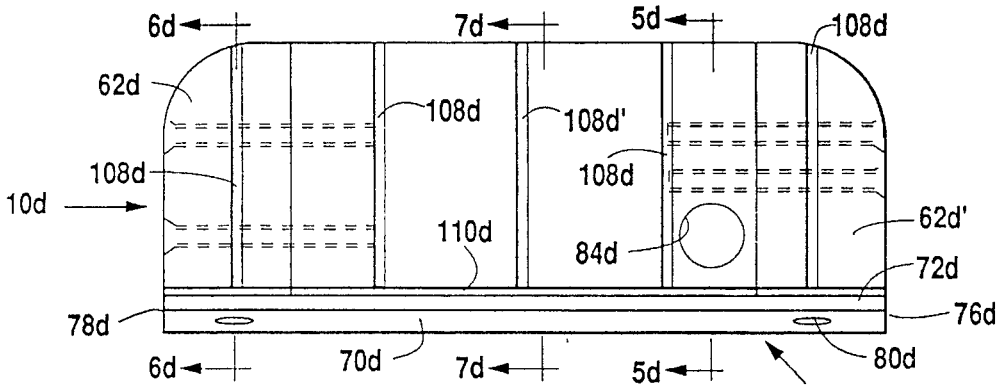
FIG. 1*d* is a top elevational view of a four-piece mallet putter head of the present invention having a fully suspended face plate and an echo chamber.
Figure 2D:
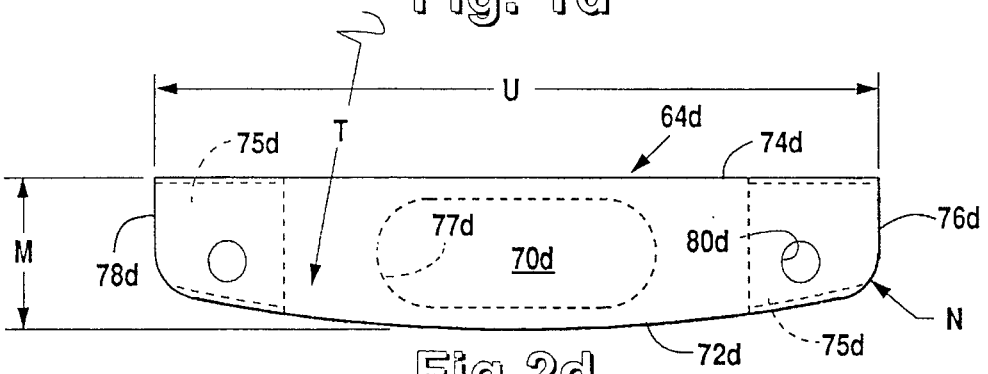
FIG. 2*d* is a front elevational plan view of a four-piece mallet putter head of the present invention having a fully suspended faceplate and an echo chamber.
Figure 3D:
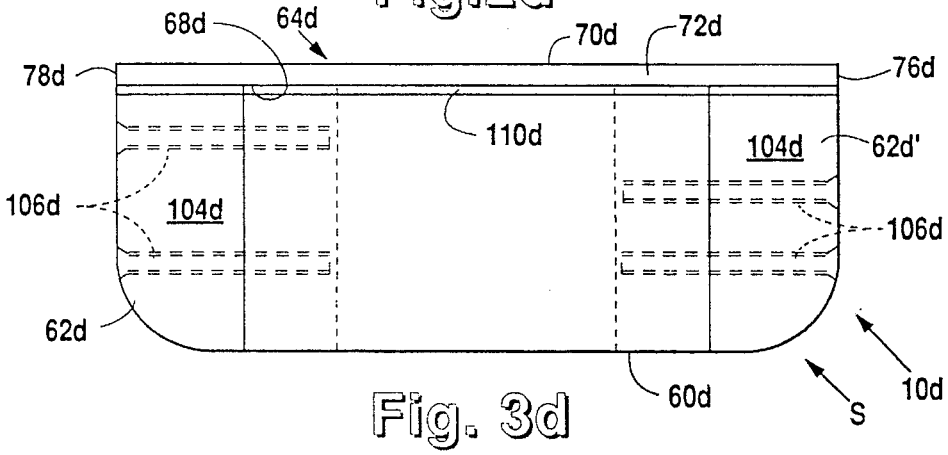
FIG. 3*d* is a bottom plan view of a four-piece mallet putter head of the present invention having a fully suspended faceplate and an echo chamber.
Figure 4D:
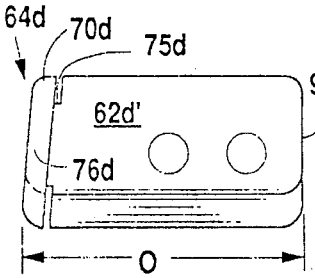
FIG. 4*d* is a heel end view of a four-piece mallet putter head of the present invention having a fully suspended faceplate and an echo chamber.
Figure 5D:
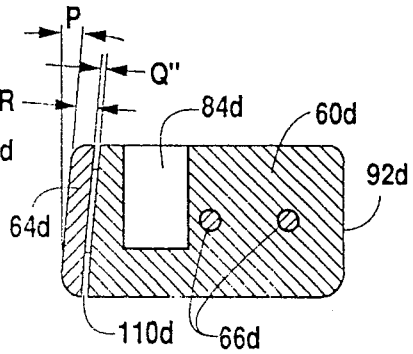
FIG. 5*d* is a cross-sectional view of a four-piece mallet putter head of the present invention having a fully suspended face plate and an echo chamber taken along line 5*d*—5*d* of FIG. 1*d*.
Figure 6D:
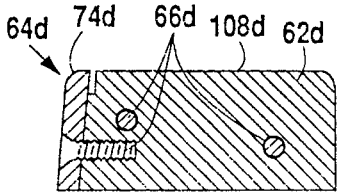
FIG. 6*d* is a cross-sectional view of a four-piece mallet putter head of the present invention having a fully suspended face plate and an echo chamber taken along line 6*d*—6*d* of FIG. 1*d*.
Figure 8D:
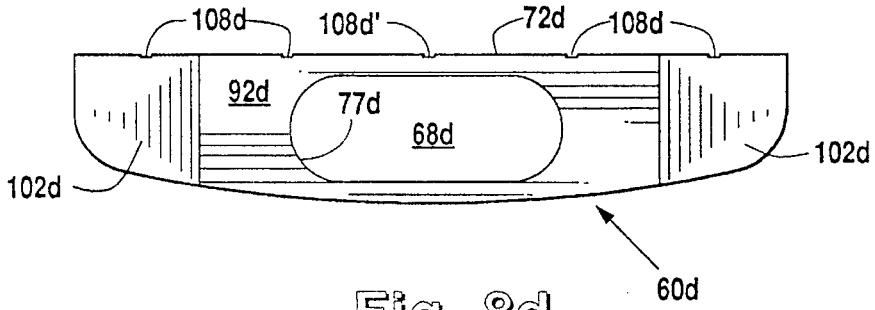
FIG. 8*d* is a rear elevational view of a four-piece mallet putter head of the present invention having a fully suspended faceplate and an echo chamber.
Figure 7D:
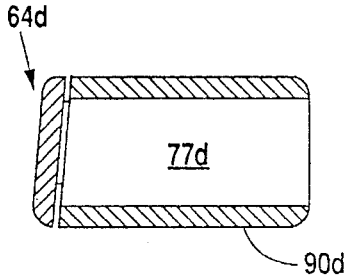
FIG. 7*d* is a cross-sectional view of a four-piece mallet putter head of the present invention having a fully suspended face plate and an echo chamber taken along line 7*d*—7*d* of FIG. 1*d*.

FIGS. 1*d*–9*d* illustrate a four-piece mallet putter head (10*d*) with a more fully suspended faceplate (64*d*) with an echo chamber (77*d*) as noted in FIG. 7*d*. A more fully suspended faceplate (64*d*) is achieved by removal of an upper portion and lower portion of front face (100*d*) of end blocks (62*d* and 62*d*'). The removal of approximately 3/64" of material from the entire top and bottom edges of face 100*d* results in formation of tabs (75*d*) as seen in FIG. 9*d*. The tabs (75*d*) cause the faceplate (64*d*) to have a gap, slot, or space of 3/64" between plate (64*d*) and end blocks (62*d* and 62*d*') extending the full length (U) of the putter head (10*d*) for a depth of approximately 3 to 4 mm as seen in FIGS. 1*d* and 3*d*. The full suspension of the faceplate (64*d*) varies the clicking sound produced.

Figure 7E:
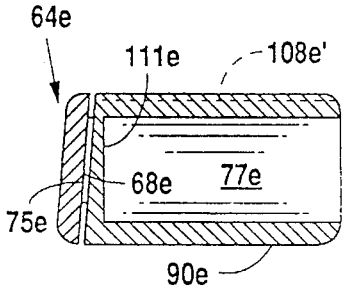
FIG. 7*e* is a cross-sectional view of a four-piece mallet putter head of the present invention having a fully suspended faceplate and an echo chamber with a front curtain taken along line 7*e*—7*e* of FIG. 1*e*.

FIGS. 1*e*–9*e* illustrate a four-piece mallet putter head (10*e*) with a fully suspended faceplate (64*e*), an echo chamber (77*e*), and a sound curtain (111*e*) covering the entire front opening of the echo chamber (77*e*). The fully suspended faceplate (64*e*) and the echo chamber (77*e*) are formed in putter head (10*e*) as previously discussed with the above embodiments. Reference to the "e" series of drawings shows the cooperation of the various elements. The curtain (111*e*) is formed by milling out the frame (60*e*) from the rear wall (92*e*) forward leaving 1/16" of aluminum material at the top, front of the frame (60*e*) and 5/32" at the bottom, front of the frame. This may be clearly seen in FIG. 7*e*. With the "10*e*" embodiment, the total sound pressure level measured for the impact, under the test procedures discussed above, was 89±1 dBA. The acoustic signature for the "10*e*" embodiment showed a pattern very similar to that shown in FIG. 14, but the amplitude of the sound pressure level was reduced to approximately 6 Pa. The "click" preceded the ringing sound which had amplitude of less than 5 Pa.

It has been noted that the clicking sound of the present invention may be controlled by varying the geometry or configuration of the echo chamber. FIGS. 1*f*–9*f* illustrate a four-piece mallet putter head (10*f*), having a fully suspended faceplate (64*f*), an echo chamber (77*f*), and a sound curtain (111*f*) with a single opening (79*f*) in the center of the curtain (111*f*). Curtain 111*f*) is formed as previously discussed above leaving a curtain wall thickness of 1/16" at the top and 5/32" at the bottom. Opening (79*f*) has a 1/2" diameter and exposes the back surface (68*f*) of faceplate (64*f*) directly to echo chamber (77*f*). This may be seen in FIGS. 7*f* and 8*f*. The 1/2" opening resulted in a click amplitude of approximately 7 Pa. The size of the opening (79*f*) may be varied from a diameter equal to the width of the chamber to less than 1/4". Varying the opening size varies the amplitude of the click sound.

Figure 4F:
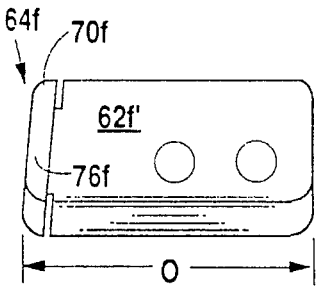
FIG. 4*f* is a heel end view of a four-piece mallet putter head of the present invention having a fully suspended faceplate and an echo chamber with a front curtain with a single opening.
Figure 5F:
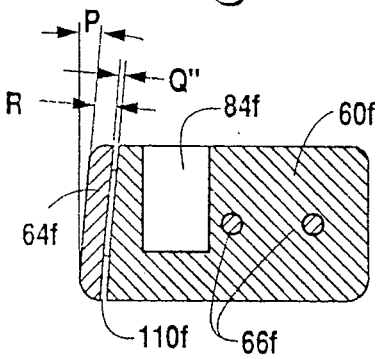
FIG. 5*f* is a cross-sectional view of a four-piece mallet putter head of the present invention having a fully suspended faceplate and an echo chamber with a front curtain with a single opening taken along line 5*f*—5*f* of FIG. 1*f*.
Figure 6F:
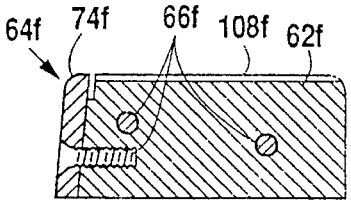
FIG. 6*f* is a cross-sectional view of a four-piece mallet putter head of the present invention having a fully suspended faceplate and an echo chamber with a front curtain with a single opening taken along line 6*f*—6*f* of FIG. 1*f*.
Figure 7F:
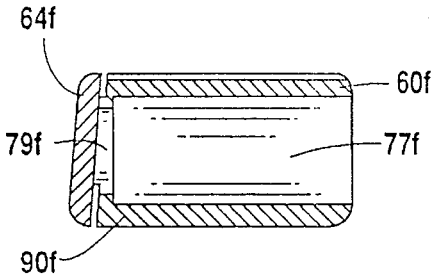
FIG. 7*f* is a cross-sectional view of a four-piece mallet putter head of the present invention having a fully suspended faceplate and an echo chamber with a front curtain with a single opening taken along line 7*f*—7*f* of FIG. 1*f*.

FIG. 7*f* further illustrates that the faceplate (64*f*) is fully suspended away from the frame (60*f*) and is attached only at tabs (75*f*) on the end blocks (see FIG. 4*f*). As with the previously discussed mallet putter heads having an echo chamber, approximately 80%–85% of the total putter head weight is within 3/4" of the heel end and the toe end of the putter head.

A further modification of the present invention may be achieved by varying the number as well as the size of the openings in the curtain. FIGS. 1*g*–9*g* illustrate a four-piece mallet putter head (10*g*) having a fully suspended faceplate (64*g*), an echo chamber (77*g*), a sound curtain (111*g*) with a plurality of openings (79*g*' and 79*g*") in the curtain. With two, 3/8" openings a click amplitude of approximately 7 Pa was achieved. A review of FIGS. 1*g*–9*g* will disclose the cooperation of the various elements of the "10*g*" embodiment.

As with the previously discussed embodiments having an echo chamber, the acoustic signature of the "10*f*" and "10*g*" embodiments follow the pattern of FIG. 14. The total sound pressure levels measured for the impact on the "10*f*" and "10g" embodiments was approximately the same when the "10f" embodiment had a single opening (79f) having ½" diameter and when each of the two openings (79g and 79g") were ⅜" in diameter. This level was determined to be 96±dBA for each of the "10f" and "10g" embodiments.

Thus, in general, the overall amplitude of the impact was loudest for the "10d" embodiment and the softest for the "10e" embodiment. The "10d" embodiment generated approximately 1.6±0.4 times (160±40%) the acoustic energy generated by the "10f" and "10g" embodiments. The "10f" and "10g" embodiments generated approximately 2.2±0.4 times (220±40%) the acoustic energy generated by the "10e" embodiment.

It has been found that in addition to improving a golfer's putting results through the placement of very high percentages of the total putter head weight within ¾" of the heel end and the toe ends of the putter head and the providing of a unique clicking, audible feedback as opposed to a ringing sound, putting results may be improved by the use of wide indices, or alignment lines, on the surface of the putter head, both on the top of the faceplate and the top of the putter frame.

FIGS. 1h–9h illustrate a four-piece mallet putter head (10h) similar in many respects to the "10d" embodiment above with the addition of improved alignment lines (108h and 108h') and lower and upper overhangs (81h and 83h, respectively).

Figure 1H:
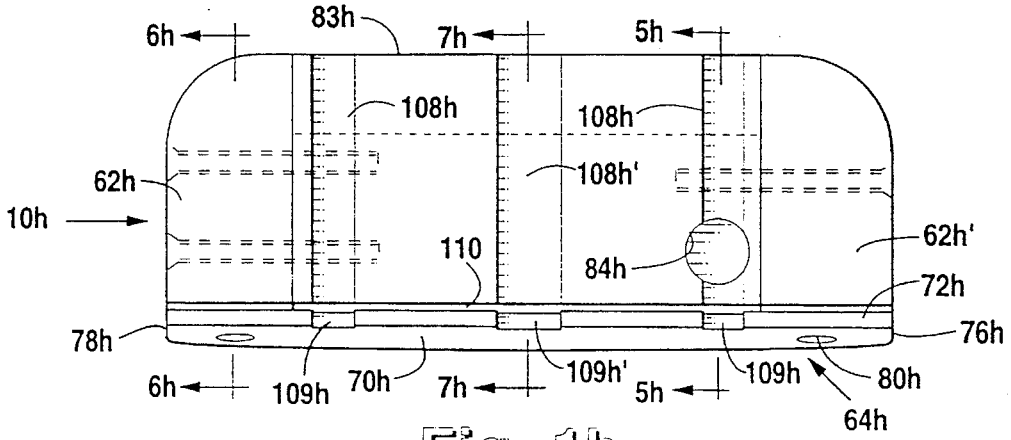
FIG. 1*h* is a top elevational view of a four-piece mallet putter head of the present invention having a fully suspended faceplate, an echo chamber, improved alignment lines, and upper and lower rear overhangs.
Figure 2H:
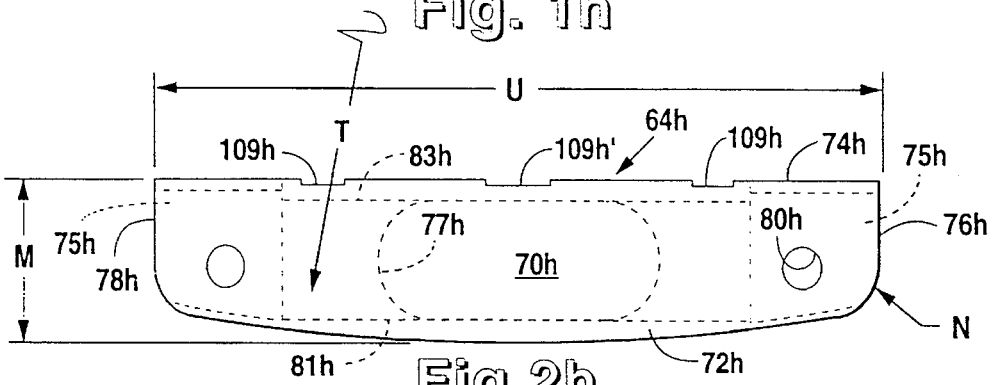
FIG. 2*h* is a front elevational plan view of a four-piece mallet putter head of the present invention having a fully suspended faceplate, an echo chamber, improved alignment lines, and upper and lower rear overhangs.
Figure 3H:
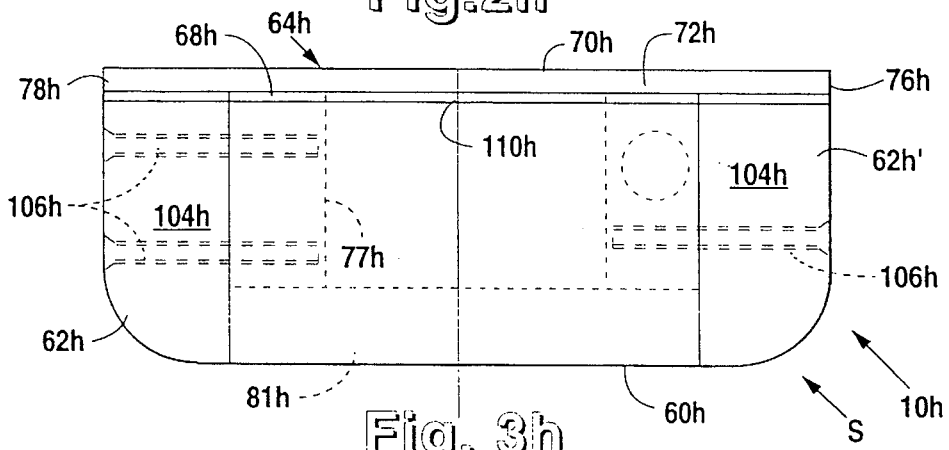
FIG. 3*h* is a bottom plan view of a four-piece mallet putter head of the present invention having a fully suspended faceplate, an echo chamber, improved alignment lines, and upper and lower rear overhangs.
Figure 4H:
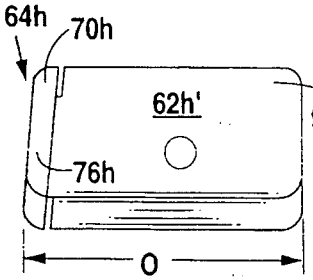
FIG. 4*h* is a heel end view of a four-piece mallet putter head of the present invention having a fully suspended faceplate, an echo chamber, improved alignment lines, and upper and lower rear overhangs.
Figure 5H:
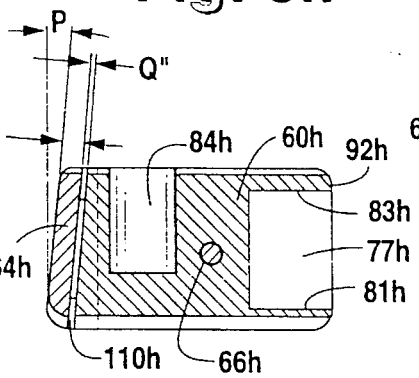
FIG. 5*h* is a cross-sectional view of a four-piece mallet putter head of the present invention having a fully suspended faceplate, an echo chamber, improved alignment lines, and upper and lower rear overhangs taken along line 5*h*—5*h* of FIG. 1*h*.
Figure 6H:
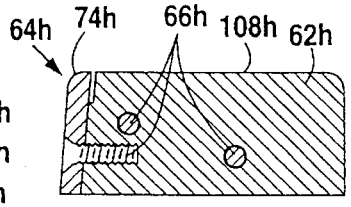
FIG. 6*h* is a top elevational view of a four-piece mallet putter head of the present invention having a fully suspended faceplate, an echo chamber, improved alignment lines, and upper and lower rear overhangs taken along line 6*h*—6*h* of FIG. 1*h*.
Figure 8H:
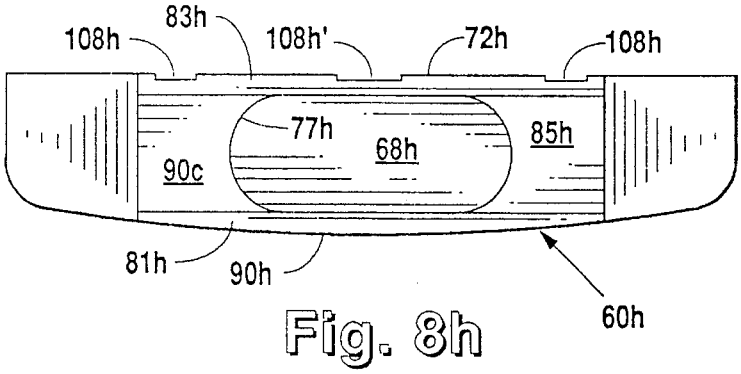
FIG. 8*h* is a rear elevational view of a four-piece mallet putter head of the present invention having a fully suspended faceplate, an echo chamber, improved alignment lines, and upper and lower rear overhangs.

As may be seen in FIG. 1h, there are three alignment lines placed on the top surface of the putter head (10h) and faceplate (64h). Inner and outer alignment lines (108h and 109h) are significantly wider than any indicia currently being marked on a putter. Center alignment lines (108h' and 109h') are even wider still. Inner and outer alignment lines (108h and 109h) are approximately 0.25" wide with a range of 0.234"–0.296". Center alignment line (108h' and 109h') is approximately 0.375" wide with a range of 0.328" to 0.424".

It should be understood that while the alignment lines (108h, 108h', 109h and 109h') are shown in FIGS. 1h, 2h, 7h, 8h, and 9h as being grooves on frame (60h) and faceplate (64h), these improved alignment indices may be merely marked on or affixed to the surface of the frame (60h) and faceplate (64h). However, the use of the wide grooves, particularly when shaded or colored to increase the contrast with the club head (10h), results in improved visual orientation for the golfer.

FIG. 12 illustrates the relationship of the alignment lines (108L and 108L') to a standard golf ball. The standard golf ball has a 1.68" diameter. It should be noted in FIG. 12 that center alignment line (108L') is most important. The center line (108L') is just wide enough to see the contour of the ball at the edges (151 and 152). The center line (108L') having a width of 0.375" is wide enough that when the putter head is set behind the ball, the golfer may see the circumference of the ball in the center line. This capability allows for improved alignment of the center line of the putter with the center line of the ball.

The distance between the inside edge of the outer and inner alignment lines (108h) is designated 12C. This distance is preferably 2" and a minimum of 1.93". This results in a clearance on each side of the ball (12A and 12B) of 0.125" when the ball is properly aligned. Thus, with the inner and outer alignment lines (108L) between 0.250" wide and space 2.00" apart, and in conjunction with the wider 0.375" center alignment line (108L'), the golfer may focus his eyes on the alignment lines and the ball and properly align the putter face (70L) and putter head (10L).

The three alignment lines (108L and 108L') are perpendicular to the putter face and parallel to each other, extending from the top edge of the putter face (70d) to the rear (92L) of the putter head (10L). As previously stated, the lines may be shaded or colored to contrast with the normally white ball. While FIGS. 12 and 13 utilize the "10L" embodiment of the putter head for illustration purposes, it should be understood that the same distances and relationships shown with the "10L" embodiment may be employed with the other embodiments illustrated.

Returning to FIGS. 1h–9h, it may be seen that overhangs (81h and 83h) have been formed into the rear of frame (60h). A slot 2¾"×⅝"×7/16" is cut across frame (60h) to form lower overhang (81h) and upper overhang (83h). In addition to allowing approximately 15 grams of weight to be removed from the frame (60h) and added to the end blocks (62h and 62h'), thereby increasing from 80% to 85% of the total putter head weight being within ¾" of the heel end and toe ends, improvement in the audible feedback is achieved with the overhangs. Further, the traditional aesthetics of a putter head are not reduced. The alignment lines (108h and 108h') on the frame (60h) still extend the full width of the frame providing improved putter alignment.

Figure 7H:
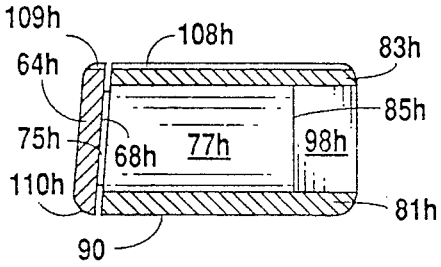
FIG. 7*h* is a cross-sectional view of a four-piece mallet putter head of the present invention having a fully suspended faceplate, an echo chamber, improved alignment lines, and upper and lower rear overhangs taken along line 7*h*—7*h* of FIG. 1*h*.

FIG. 7h illustrates the fully suspended faceplate (64h) attached to frame (60h) only at tabs (75h) resulting in full slot (110h) extending the full length (U) of the putter head along the top and bottom of the putter head (10h). Also seen in FIG. 7h are an echo chamber (77h), lower overhang (81h), and upper overhang (83h). Embodiment "10h" does not have a sound curtain and thus has acoustic energy characteristics similar to the "10d" embodiment discussed above.

FIGS. 1i–9i illustrate yet another arrangement of the variable elements of the present invention. The "10i" embodiment of FIGS. 1i–9i discloses a four-piece mallet putter head (10i) with a suspended faceplate (64i), as compared to a full suspended faceplate, but not attached to any tabs on the end blocks (62i and 62i'). However, the putter head (10i) has an echo chamber (77i) with a full sound curtain (111i), wide alignment lines (108i, 109i and 108i', 109i'), and upper overhang (83i) and lower overhang (81i). The "10i" embodiment has approximately 85% of the total putter head weight within ¾" of the heel end and toe end of the putter head.

As previously indicated where similar features are found in each separate embodiment it should be understood that they are sized to cooperate as has been discussed with other embodiments of the present invention.

FIGS. 1j–9j illustrate a four-piece mallet putter head (10j) having a suspended faceplate (64j) attached to forward extending end blocks (62j and 62j') to create the gap or slot (110j) as previously taught above. Putter head (10j) has an echo chamber (77j), a sound curtain (111j) with a single small opening (79j) exposing the rear surface (68j) of plate (70j) to the chamber (77j). Wide alignment lines (108j and 108j') on frame (60j) and wide alignment lines (109j and 109j') on the plate (70j) are also shown. Further, the 2¾"×⅝"×7/16" slot forming upper and lower overhangs (83j and 81j) is illustrated. The acoustic energy yield and acoustic signal patterns of the putter head (10j) are characteristic of the putter head in the "10f" embodiment discussed above but with a slightly different quality being achieved by the overhangs. The putter head (10j) has approximately 85% of its total putter head weight within ¾" of the heel end and toe end of the putter.

FIGS. 1k–9k illustrate a four-piece blade putter head (10k) with a suspended faceplate (116k). Notch (121k) is cut into the front face (138*k*) of frame (114*k*) to provide a 3/64" gap or slot (156*k*). As FIGS. 1*k*–9*k* illustrate, there is no echo chamber available with the blade type putter. However, the suspended face of the "10*k*" embodiment does result in a clicking sound. As with the previously discussed "106" embodiment, end blocks (112*k* and 112*k*') are generally rectangular precision constructed to provide a loft angle. The dimensions of the various components of the "10*k*" embodiment are the same as the "106" embodiment (see Table III above). Putter head (10*k*) has 95% of the total putter head weight within ¾" of the heel end and toe end. The main differences with the "10*k*" putter head are the notch (121*k*), and the wide alignment lines (155*k* and 155*k*') on the top edge of faceplate (116*k*) and on the top surface (132*k*) of base (114*k*). The size and placement of the alignment lines on the putter head (10*k*) are the same as those described above on the mallet-type putter heads.

Turning now to FIGS. 1L–9L a unique three-piece mallet putter head (10L) is illustrated. Brass or bronze end blocks (62L and 62L) are ¾" in length and constitute 82%–83% of the total putter head weight. These end blocks (62L and 62L') are attached to the putter head (10L) only at the outside of frame (60L). Frame (60L) is 2¾" long and made of very lightweight aluminum. With end blocks (62L and 62L') attached outside of frame (60L) the putter head (10L) has a total putter length (U') of 4¼". It should be noted that the front surface (100L) of the end blocks form a part of the overall putter face. There is no separate putter faceplate with the "10L" putter head.

Figure 7L:
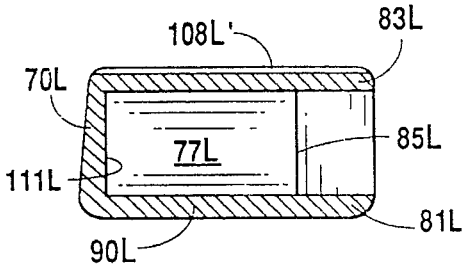
FIG. 7L is a cross-sectional view of a three-piece mallet putter head of the present invention having an echo chamber, improved alignment lines, and upper and lower rear overhangs taken along line 7L—7L of FIG. 1L.

Putter head (10L) has a rearwardly extending echo chamber (77L) with a front wall (111L) similar to the full sound curtain discussed above in embodiments "10*e*" and "10*i*". As with the "10*e*" embodiment the front wall (111L) is formed by milling out frame (60L) from the rear leaving 1/16" of aluminum material at the top, front of the frame and 5/32" at the bottom, front of the frame (see FIG. 7L). The front surface (70L) of this thin solid wall (111L) forms a part of the putter face, and when impacted by a golf ball produces audible feedback which reverberates in the chamber (77L).

Overhangs (81L and 83L) extend from the rear of frame (60L) and are similar to the overhangs discussed above in other embodiments. Wide alignment lines (108L and 108L') similar to those described above extend along the top surface (82L) of frame (60L).

The chamber (77L) and overhangs (81L and 83L) allow for the placement of more weight, in equal amounts, in the end blocks (62L and 62L'). When approximately 65 grams of weight is thus shifted to the end blocks, this creates 130 grams more in resistance to torque at the heel end (62L') and toe end (62L). This 130 grams of total resistance to torque yields more than ⅓ of the total putter head (10L) weight.

A three-piece blade putter head (10*m*) embodiment of the present invention is shown in FIGS. 1*m*–4*m*. The putter head (10*m*) has a very narrow faceplate (64*m*) and no bottom plate or frame. Putter faceplate (64*m*) is constructed from a lightweight composition having a high tensile strength in the range of 83,000–90,000 psi. One such material is a composition manufactured by Alcoa Company, known by the brand name ALCOA 7075-T6. This is a space-age aluminum with an ultimate tensile strength of 83,000–90,000 psi, weighing approximately 2.81 grams per cubic centimeter, and having a Burnell hardness of 150. With such a composition there is nearly zero flexing of the faceplate when striking a golf ball. The ⅛" thick faceplate (64*m*) vibrates upon impact with a ball and transmits 30%–40% more feel or touch to the hands of the golfer.

Other compositions for the faceplate (64*m*) may be high strength plastic compositions such as LEXAN 141, a trademark brand of General Electric Company, or a high strength titanium alloy. A high strength plastic composition having a weight of 1.20 grams per cubic centimeter may require a faceplate (64*m*) slightly thicker than ⅛" whereas a titanium alloy may result in a faceplate less than ⅛".

Figure 1M:
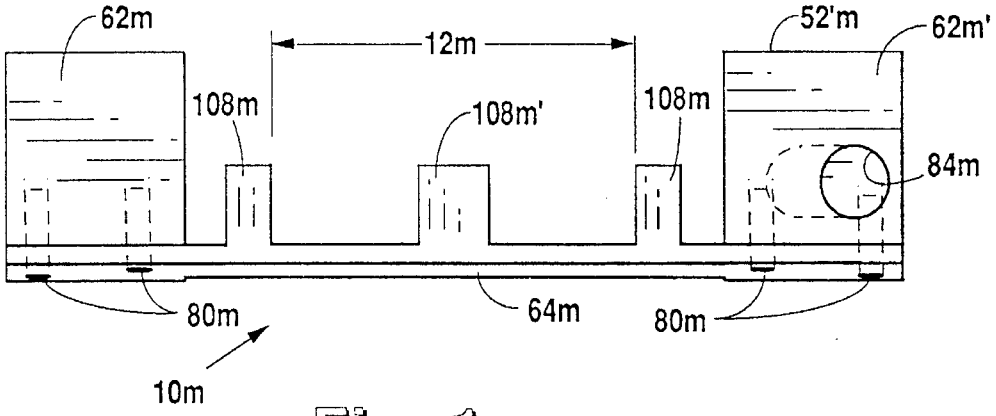
FIG. 1*m* is a top elevational view of a three-piece blade putter head of the present invention with a narrow faceplate and three improved alignment tabs.
Figure 2M:
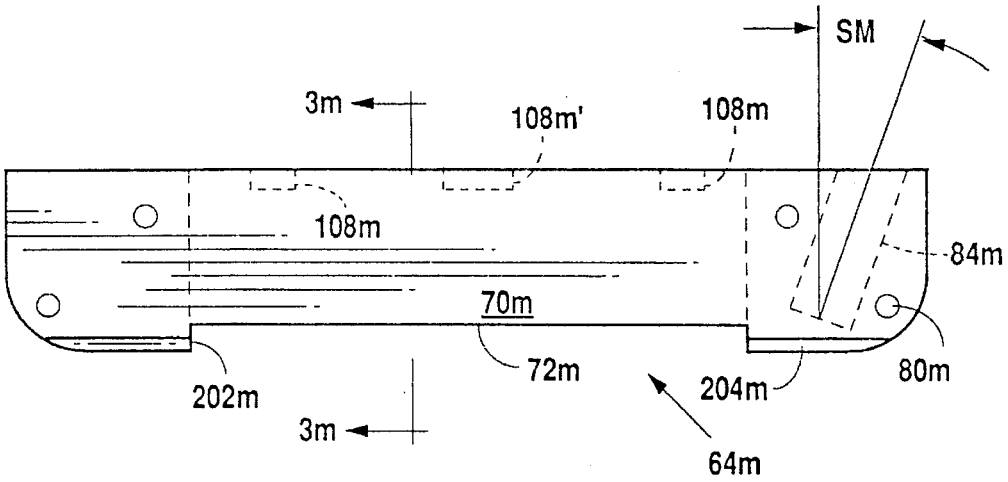
FIG. 2*m* is a front elevational plan view of a three-piece blade putter head of the present invention with a narrow faceplate and improved alignment lines.
Figure 3M:
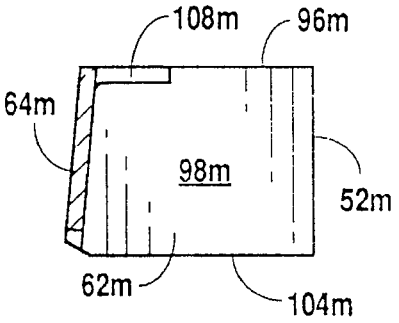
FIG. 3*m* is a cross-sectional view of a three-piece blade putter head of the present invention with a narrow faceplate and improved alignment lines taken along line 3*m*—3*m* of FIG. 1*m*.
Figure 4M:
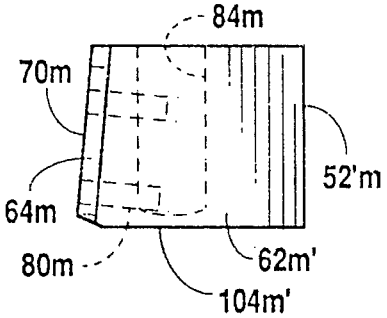
FIG. 4*m* is a heel end plan view of a three-piece blade putter head of the present invention with a narrow faceplate and improved alignment lines.

As may be seen in FIG. 1*m*, toe and heel blocks (62 and 62*m*') are affixed to only faceplate (64*m*). Heel and toe end blocks are constructed to rest directly on the putting green. Faceplate (64*m*) has a raised notch (202*m*) extending between the end blocks which is 0.125" above the bottom surfaces (104*m* and 104*m*') of the end blocks. This raises the bottom mid-section of the faceplate above the playing surface. The full length of the top surface of faceplate (64*m*) is even or level with the top surfaces of the end blocks as may be seen in FIG. 2*m*. FIG. 2*m* also illustrates that shaft receiving opening (84*m*) is bored into end blocks (62*m*') with a 0.370" bore at an angle (5*m*) of 20°.

Because end blocks (62*m* and 62*m*') are made of a heavyweight, dense material such as brass, bronze or lead, and faceplate (64*m*) is extremely lightweight, over 96% of the total putter head (62*m*) weight is within one inch of the heel end and toe end. In the "10*m*" embodiment, the faceplate (64*m*) is 5" in length and weighs approximately 13 grams. Heel and toe end blocks weigh approximately 185–185.5 grams each for a total putter head weight of approximately 384 grams. This weight distribution creates sufficient inertia to eliminate torque in a 3" hitting area and provides a realistic 2½" sweet spot. Putter head 10*m* is adjustable in weight from a G-3 to A-6 swing weight.

Another unique feature of the "10*m*" embodiment is the incorporation of alignment tabs (108*m* and 108*m*') attached to the top surface of faceplate (64*m*) and extending rearwardly 0.500" from the front edge of the faceplate (64*m*). Alignment tabs (108*m* and 108*m*') are sized to correspond to the alignment indices discussed above for the mallet type putter heads and noted in the discussion related to FIG. 12. Outer tabs (108) are 0.250" wide, while center tab (108*m*') is 0.375" wide and is centered along the length of faceplate (64*m*). The distances (12*m*) between the inside edge of the outer and inner alignment tabs is preferably 2" and a minimum of 1.93". This provides a clearance on each side of the ball of 0.125" when the ball is properly aligned.

Figure 5M:
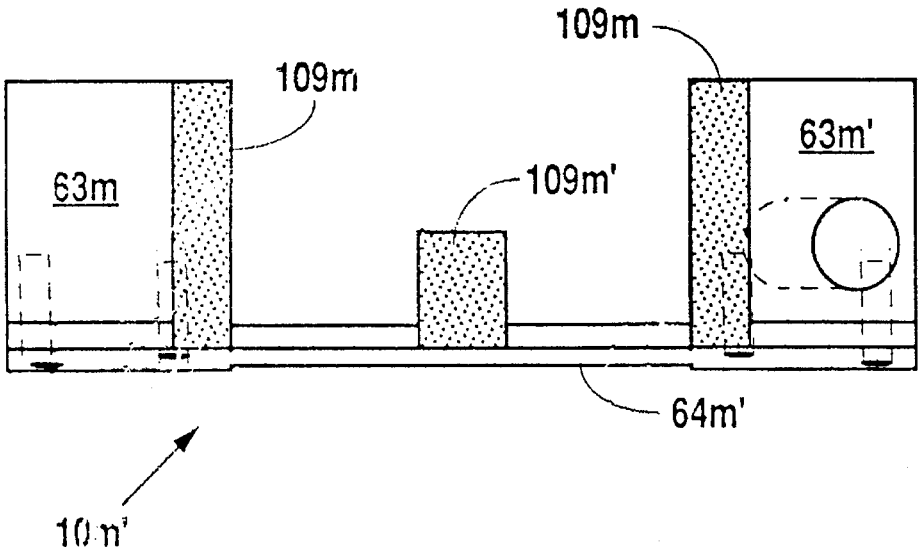
FIG. 5*m* is a top elevational view of a three-piece blade putter head of the present invention with a narrow faceplate and one alignment tab.
Figure 6M:
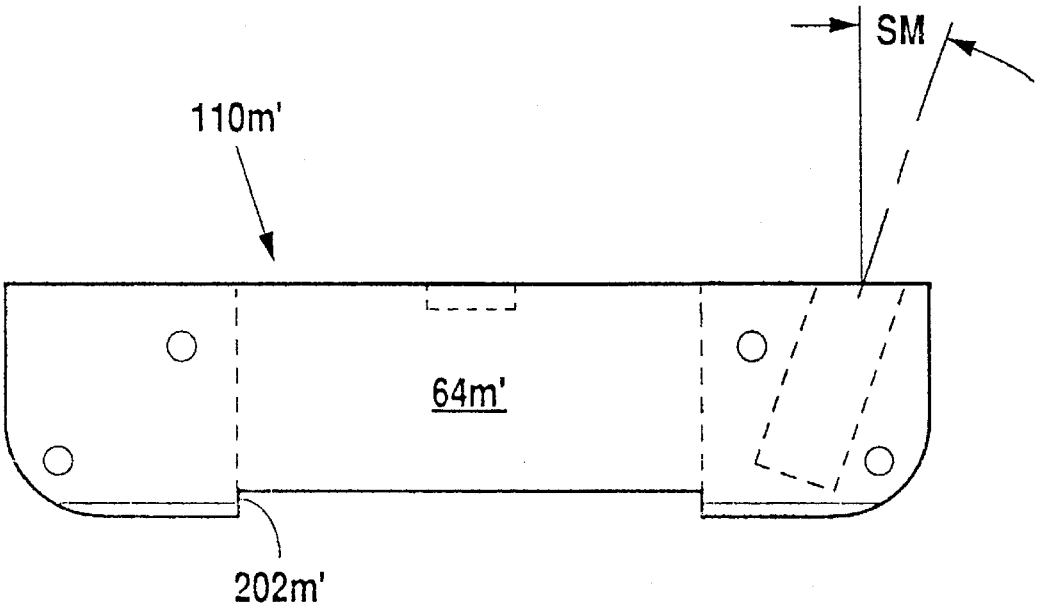
FIG. 6*m* is a front elevational plan view of the three piece blade putter head of the present invention with a narrow faceplate and one alignment tab.

FIGS. 1*m*–4*m* illustrate the relationship of the various elements of the three-piece blade putter head (10*m*) which has a 5" faceplate. FIGS. 5*m* and 6*m* illustrate a 4" three-piece blade putter head (10*m*') constructed similarly to the 5" three-piece blade putter head (10*m*). However, as may be seen in the figures, there is only one rearwardly extending alignment tab (109*m*'). Tab (109*m*) extends from the center of 4" faceplate (64*m*') in the same way as does tab 108*m*' in FIG. 1*m*. Outer alignment indices or lines (109*m*) extend along the top surface of heel and toe end blocks (63*m* and 63*m*'). The distance between the relationship of the alignment indices (109*m*) and tab (109*m*') are the same as discussed above for the 5" putter head (10*m*). Raised notch (202*m*') is 0.125" above the bottom surfaces of the heel and toe end blocks, and the entire length of the top surface of faceplate (64*m*') is even or level with the top surfaces of the heel and toe end blocks. The 4" three-piece blade putter head (10*m*') is constructed of the same type of materials as discussed with the 5" three-piece putter head (10*m*), but the overall putter weight for the 4" putter head (10*m*') is approximately 381 grams with approximately 371 grams in the heel and toe blocks. Thus, over 97% of the total putter head weight is within one inch of the heel and toe ends.

It should be understood that the putter head (10) illustrated in FIGS. 1–9 may be provided with L-shaped bracket (12) constructed of lightweight material composition having an ultimate tensile strength in the range of 83,000 psi to 90,000 psi (such as ALCOA 7075-T6). Use of such material composition results in a faceplate thickness (I) and base thickness (E) of only 0.093". When the width (D) of the base (16) is reduced to 0.427" and the length of the putter base (16) is reduced to 4.50" rather than 5" (face 18 remaining 5" in length), the end blocks (14 and 14') extend over the back of the base or sole plate (16) and extend beyond the base at the outside of the heel and toe end blocks. This allows for the easy removal of material from the end blocks to permit adjustment of the club swing weight in the range of 251 grams to 384 grams.

By modifying the L-shaped bracket (12) as discussed above, the bracket (12) may weigh 10.4 grams and with the total putter head weight being 384 grams, the weight distribution places 97% of the total putter head weight within one inch of the heel and toe ends. This results in creating sufficient inertia to eliminate torque in a 2½" area, and provides a realistic 2½" sweet spot.

As discussed above the improved alignment indices may be incorporated into the modified putter head (10).

Figure 2N:
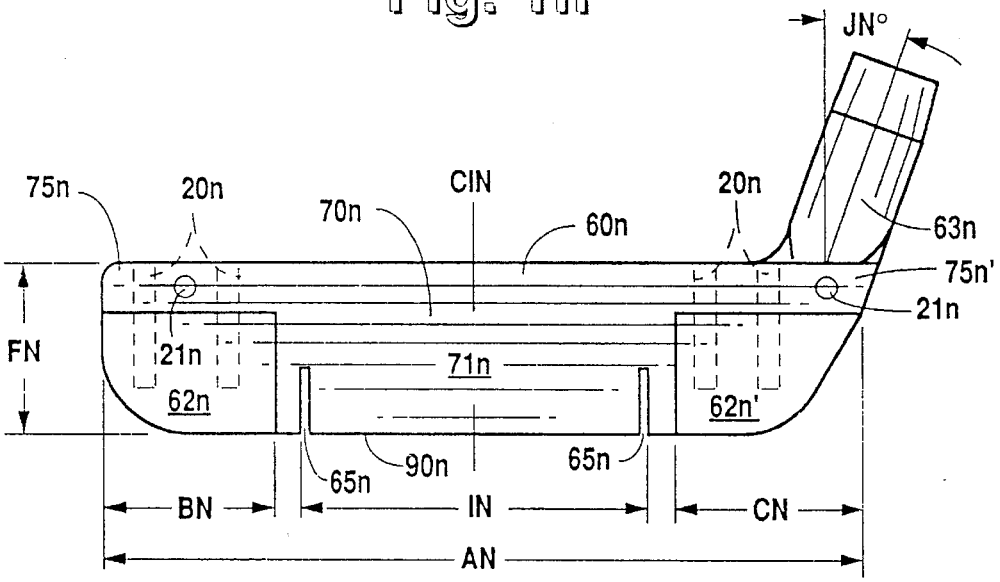
FIG. 2*n* is a front elevational plan view of a three-piece blade putter head of the present invention with a hosel and improved alignment lines.

FIGS. **1*n*–4*n* illustrate a three-piece full blade putter (10*n*) constructed of two materials, one high density metal such as brass or bronze and the other a strong, lightweight material such as aluminum. The aluminum L-shaped frame (60*n*) includes as one piece the base member portion or sole plate (16*n*), the T-shaped faceplate portion (70*n*) and the end mounted hosel (63*n*). T-shaped faceplate portion (70*n*) has outwardly extending horizontal crossarms (75*n* and 75*n*'). Faceplate portion (70*n*) is generally bilaterally symmetrical as seen in FIG. 2*n*. Toe end weight or block (62*n*) and heel end weight or block (62*n*') are mounted to frame (60*n*) only at the top portion of the T-shaped faceplate portion (70*n*) by fasteners (20*n* and 21*n*), and form a portion of the putter face (64*n*) and sole (90*n*) of the putter head (10*n***).

The end blocks (**62*n* and 62*n*') are mounted with front faces (100*n* and 100*n*') substantially flush with the front surface (64*n*) of the faceplate portion (70*n*). Fasteners (20*n* and 21*n*) hold shoulder surfaces (102*n* and 102*n*') of blocks (62*n* and 62*n*') abuttingly against the bottom surfaces of the crossarms (75*n* and 75*n*'). The inner surfaces of blocks (62*n* and 62*n*') abuttingly contact the base member portion or sole plate (16*n*). While the end blocks (62*n* and 62*n*') are machined, the entire L-shaped frame (60*n***) may be cast, forged or machined.

Figure 1N:
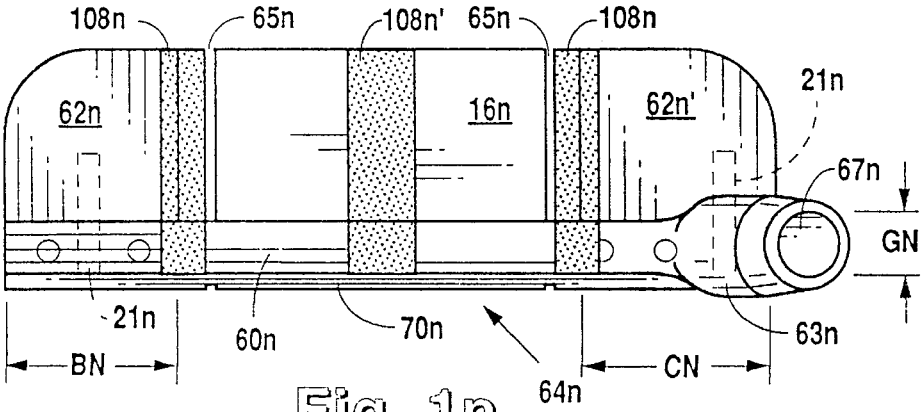
FIG. 1*n* is a top elevational view of a three-piece blade putter head of the present invention with a hosel and improved alignment lines.

FIG. **2*n* shows a central T-shaped striking face section (71*n*) of frame (60*n*) suspended between end blocks (62*n* and 62*n*'). FIG. 1*n* illustrates the rearwardly extending sole plate (16*n*) between end blocks (62*n* and 62*n*'). The T-shaped faceplate portion (70*n*) includes a striking face section (71*n***). The completely suspended striking face creates a vibration when striking the golf ball which transmits 50% more feel to the golfer's hands than a traditional putter head.

As may be seen in FIGS. **1*n*–4*n*, the frame (60*n*) fits over each of the end blocks (62*n* and 62*n*') each of which is held by two downwardly depending fasteners (20*n*) extending through the top of frame (60*n*) into the end blocks (62*n* and 62*n*') and by one rearwardly depending fastener (21*n*) extending through the front of frame (60*n*) to the end blocks. The end blocks are attached within one inch of the heel and toe ends of the putter head. Thus, these fasteners securely retain the end blocks in position when a golf ball is struck. A low center of gravity is produced for this putter head (10*n***).

The preferred dimensions AN–JN (as found in FIGS. **2*n*, 3*n*, and 4*n***) are set forth in Table IV and provide for approximately 92% of the total putter head weight to be located within one inch of the heel and toe ends.

TABLE IV

Figure 3N:
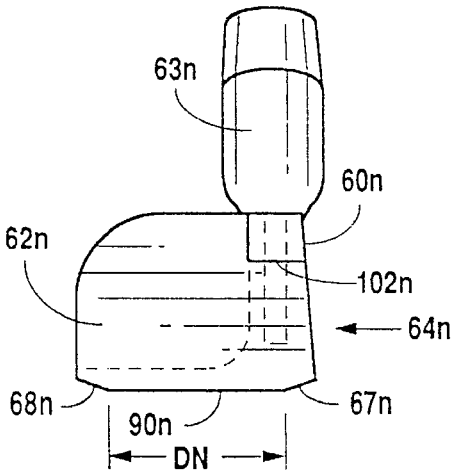
FIG. 3*n* is a toe end plan view of a three-piece blade putter head of the present invention with a hosel and improved alignment lines.
Figure 4N:
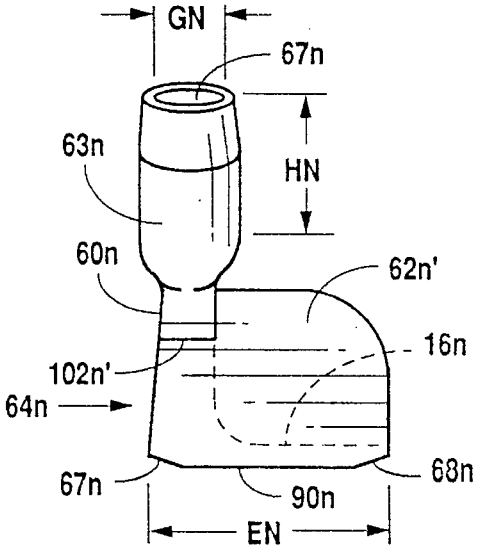
FIG. 4*n* is a heel end plan view of a three-piece blade putter head of the present invention with a hosel and improved alignment lines.

| LOCATION | REF. | DESCRIPTION | PREFERRED DIMENSION | PREFERRED RANGE |
|---|---|---|---|---|
| FIG. 2n | AN | Length of Putter Head | 4.375" | 4.00"–5.00" |
| FIG. 2n | BN | Length of Heel End Block | 1.00" | 1.00"–1.25" |
| FIG. 2n | CN | Length of Toe End Block | 1.00" | 1.00"–1.25" |
| FIG. 3n | DN | Width of Bottom Surface of Base | 1.00" | 1.00"–1.375" |
| FIG. 4n | EN | Width of Club Base, Including Face | 1.375" | 1.125"–1.50" |
| FIG. 2n | FN | Height of Face | 1.00" | 1.00"–1.25" |
| FIG. 1n | GN | Hosel Bore | .370" | .300"–.375" |
| FIG. 4n | HN | Hosel Depth | 1.00" | .250"–1.25" |
| FIG. 2n | IN | Length Between Grooves | 2.00" | 1.68"–2.50" |
| FIG. 2n | JN | Hosel Angle | 20° | 14°–24° |

The unique method and means for attaching the heel and toe blocks to the suspended face section allows for a contouring off from the back, top and bottom, and extreme ends of the end blocks to adjust the putter weight from 384 grams (G-3 swing weight) to 251 grams (A-6 swing weight). Further, as FIGS. **1*n*–4*n* show the lie angle at the bottom of the heel or toe end blocks may be adjusted by removing portions of the end blocks at the front (67*n*) or rear (68*n***) edges of said blocks.

Further, FIGS. **1*n*–4*n* illustrate the hosel preferably depth dimension of 1" and permits a 0.370" bore (GN). This is a uniquely short hosel (63*n*) which increases the lowering of the center of gravity. The hosel (63*n*) is formed as an integral part of the frame (60*n*) at the top of the face at the extreme heel end, and further recessed or tapers on both sides to ¼" to join with the ¼" thickness of the top of the frame (60*n***).

The three-piece full blade putter head (**10*n*) may be further modified by providing two 7/16" high, narrow grooves (65*n*) in frame (60*n*). Grooves (65*n*) are equidistantly spaced apart from the centerline (CLN) of the faceplate portion (70*n***).

Grooves (**65*n*) are 0.062" wide, spaced 2" apart from each other on the faceplate portion (70*n*) and extend upwardly a distance of 7/16" and cut through the entire thickness of the faceplate (70*n*) and extend rearwardly along the entire width of the sole plate (16*n*) and cut through the entire thickness of sole plate (16*n*). Thus, a doubly suspended face is achieved, i.e., the top of the face frame (60*n*) extends only ¼" deep all the way across the top. The center of the face (64*n***) is only attached at the top of the frame. The end blocks are completely suspended.

Again, it should be understood that the improved alignment lines (**108*n* and 108*n*') discussed above may be incorporated into the putter head (10*n***) as shown in the figures.

FIGS. **1*o*–4*o* illustrate a three-piece, semi center-mount blade putter. A center frame (60*o*) having a hosel (69*o*) is formed from one piece of strong, lightweight material such as aluminum. Heel end block (62*o*') and toe end block (62*o*) are composed of a high density metal such as brass or bronze. End blocks (62*o* and 62*o*') are secured to center frame (60*o*) by fasteners (80*o*) which extend through the lower portion of the end blocks (62***o* and 60*o*') and into frame (60*o*). As may be seen in the FIGS. 1*o*–4*o*, end blocks (62*o* and 62*o*') extend rearwardly beyond the rearward most back edge (91*o*) of frame (60*o*) by approximately ¼". Further, the leading and trailing edges (67*o* and 61*o*) respectively of end blocks (62*o* and 62*o*') and frame 60*o*) may be chamfered approximately 0.062".

The preferred dimensions AO–IO (as found in FIGS. 1*o*–4*o*) are set forth in Table V and provide for over 90% of the total putter head (10*o*) weight within one inch of the heel and toe ends.

TABLE V

Figures 1O, 2O, 3O, 4O:
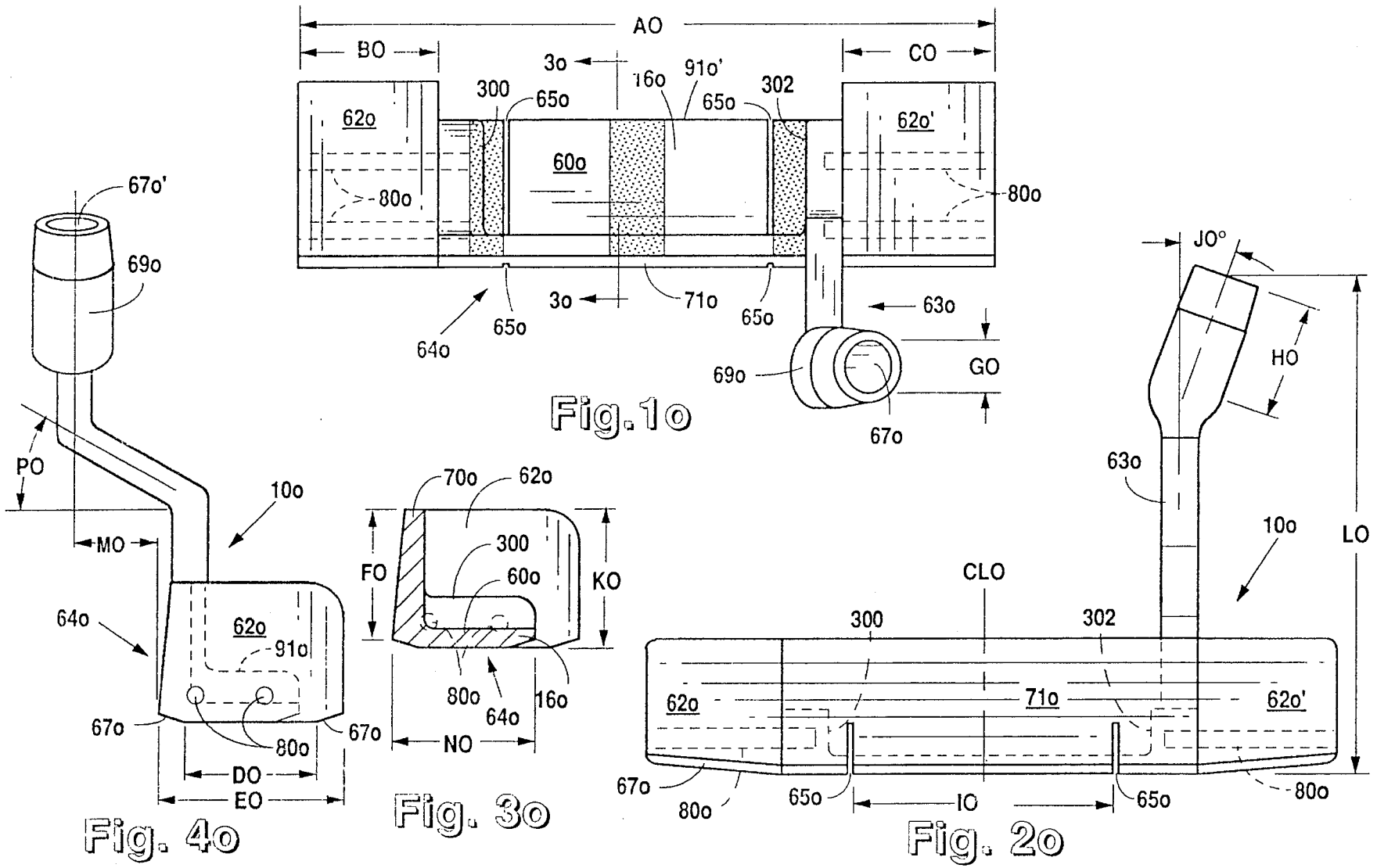
FIG. 1*o* is a top elevational view of a three-piece blade putter head of the present invention with an offset hosel and improved alignment lines.
FIG. 2*o* is a front elevational plan view of a three-piece blade putter head of the present invention with an offset hosel and improved alignment lines.
FIG. 3*o* is a cross-sectional view of a three-piece blade putter head of the present invention with an offset hosel and improved alignment lines taken along line 3*o*—3*o* of FIG. 1*o*.
FIG. 4*o* is a heel end plan view of a three-piece blade putter head of the present invention with an offset hosel and improved alignment lines.

| LOCATION | REF. | DESCRIPTION | PREFERRED DIMENSION | PREFERRED RANGE |
|---|---|---|---|---|
| FIG. 1o | AO | Length of Putter Head | 5.00" | 4.00"–6.00" |
| FIG. 1o | BO | Length of Heel End Block | 1.00" | 1.00"–1.25" |
| FIG. 1o | CO | Length of Toe End Block | 1.00" | 1.00"–1.25" |
| FIG. 4o | DO | Width of Bottom Surface of Base | .938" | .75"–1.00" |
| FIG. 4o | E0 | Width of Club Base, Including Face | 1.375" | 1.187"–1.500" |
| FIG. 3o | FO | Height of Face | 1.00" | .750"–1.125" |
| FIG. 1o | G0 | Hosel Bore | .370" | .300"–.375" |
| FIG. 2o | HO | Hosel Depth | .875" | .250"–1.00" |
| FIG. 2o | IO | Length Between Grooves | 2.00" | 1.68"–2.50" |
| FIG. 2o | JO | Hosel Angle | 20° | 12°–30° |
| FIG. 3o | KO | Height of End Blocks | 1.00" | .750"–1.125" |
| FIG. 2o | LO | Length of Hosel | 4.50" | 4.25"–4.50" |
| FIG. 4o | MO | Hosel Offset | .875" | .42"–1.00" |
| FIG. 3o | NO | Width of Base of Frame | 1.125" | 1.00"–1.25" |
| FIG. 3o | PO | Hosel Offset Angle | 30° | 30° |

As noted with the putter head (10*n*), the putter head (10*o*) of FIGS. 1*o*–4*o* may be provided with grooves or cuts (65*o*) which are equidistantly spaced apart from the centerline (CLO) on the faceplate portion (70*o*). Grooves (65*o*) are 0.062" wide, spaced 2" apart from each other on the faceplate portion (70*o*). Grooves (65*o*) extend upwardly a distance of 7/16" from the bottom surface (90*o*) of frame (60*o*) and cut through the entire thickness of the faceplate portion (70*o*) and extend rearwardly along the entire width (NO) of the sole plate (16*o*) and cut through the entire thickness of the sole plate (16*o*) resulting in a doubly suspended face as discussed above. Improved alignment indices may be incorporated on putter head (10*o*) as shown.

The swing weight of putter head (10*o*) may be easily adjusted by the removal of weight from the end blocks as noted above.

Hosel arm (63*o*) is a thin, ¼" square member, offset 0.875" from the face (64*o*) of the putter head and at an angle (PO) of approximately 30° to the horizontal. The 0.875" offset is equal to one-half the diameter of the standard golf ball. Thus, when the golfer sets the putter head (10*o*) behind the ball with the face (64*o*), and more specifically the center of alignment line (108*o*') centered on the ball, the center of the hosel (69*o*) will align with the center of the golf ball (in a vertical plane). The top portion of the hosel (69*o*) is tilted at 20° (JO) to provide a 20° lie to the putter head (10*o*). Thus, the center line of the putter head is properly aligned with the ball in both the horizontal and vertical planes.

FIGS. 10 and 11 show various shaft bends which may be utilized with the present invention or with a traditional golf club head. A shaft bend 1½" offset in front of the ball striking face or putter face (64*e*) (this offset is represented by distance 400A) is most preferable. Shaft bends may range from being flush with the ball striking face to 1½" offset in front of the ball striking surface. The shaft (400) has a generally rigid tubular body portion (402) having a first end (404) attached to club head (10*e*) near the heel end of the club head opposite the toe end. A second end (406) of the body portion (402) of the shaft (400) is connected to a grip for the shaft; all of which is well known in the art. The body portion (402) of the shaft has a generally S-shaped offset section (408) between the first end (404) and the second end (406). As may be seen in FIG. 10, the offset section has a first radius of curvature (400B) of approximately 2.7" as measured from a center of origin (410) approximately 1.50" forward (400A) and along a first line extending perpendicular the vertical plane of the leading edge of the ball striking face (64*e*) of club head (10*e*). This first line also lies in a first horizontal plane level with the top surface (82*e*) of the club head (10*e*). Offset section (408) has a second radius of curvature (400C) of approximately 2.7", as measured from a center of origin (412) approximately 2.6" rearward (400E) of the first center of origin (410) and along a second line extending perpendicular the vertical plane of the leading edge of the ball striking face of club head (10*e*). This second line also lies in a plane parallel and approximately 3.6" above (400F) the first horizontal plane.

The axial center line (CLE) of the second end (406) of the tubular body portion (402) of the shaft (400) is disposed at an angle of approximately 70° to the first horizontal plane level with the top surface (82*e*) of the club head (10*e*).

Table VI sets forth the preferred dimensions for such a bent shaft (400).

TABLE VI

| LOCATION | REF. | DESCRIPTION | PREFERRED DIMENSION |
|---|---|---|---|
| FIG. 10 | 400A | Shaft Offset | 1.500" |
| FIG. 10 | 400B | First Radius of Curvature | 2.765" |
| FIG. 10 | 400C | Second Radius of Curvature | 2.687" |
| FIG. 10 | 400D | Shaft Offset Angle | 5° |
| FIG. 10 | 400E | First Reference | 2.600" |
| FIG. 10 | 400F | Second Reference | 3.625" |
| FIG. 10 | 400G | Third Reference | .343" |
| FIG. 11 | 400H | Hosel Angle | 70° |

With the present invention the structural arrangement of the various pieces of each putter head offers the opportunity to customize the total putter weight and thus the swing weight of each putter to meet the particular needs of the user without resorting to disassembly and reassembly.

In the present invention, the location of brass at the heel and toe end blocks or weights and the method for the suspended attachment of the brass end blocks at the extreme ends of the heel and toe, positions the brass in an accessible position that allows the adjustment of weight and permits a variable head weight or mass to suit a golfer's desired swing weight.

In addition to the weight adjustment feature the accessible positioning of the end weights also permits a variable lie angle to be achieved by removing more or less material from either the toe or heel ends.

A weight variance from 394 grams or less to 251 grams may be achieved without distorting the overall putter balance by adjusting the high density metal end blocks as discussed. The end blocks are so situated that the reduction of mass may easily and quickly be accomplished by any user. Weight adjustment may be accomplished by removing equal weight by contouring at either/or the bottom, end, top and back of each heel and toe end block. Such adjustment can be achieved by sanding, filing, machining or by any other known method of removing or cutting metals.

By definition, swing weight is the balanced weight between a putter head and the shaft and grip. Swing weight determines the dynamic force that a putter head has when striking a golf ball. The putter head weight makes a significant difference in the way the ball rolls. A heavier head gives the golfer the ability to impart more roll to the ball; thus, a golfer does not have to use as much force in stroking the ball. The desired swing weight that a golfer needs depends on how much force he applies to the forward stroke through the ball. Therefore, if the golfer swings the putter hard, he need less swing weight; if he swings the putter with a smoother and softer stroke, he needs more swing weight.

Dead weight is the total weight of the putter including shaft and grip.

The size and weight of the putter grip makes very little difference in the swing weight of the putter head. Changing to a smaller grip will decrease the total dead weight of the putter only a few grams. In a like manner, changing to a larger grip will increase the total dead weight of the putter only a few grams. For example, if a golfer changes from a smaller grip, average weight 50 grams, to a larger grip, average weight 71 grams, and the weight difference of 21 grams would increase the dead weight of the total putter by 21 grams; this increases the swing weight by only two swing weights. Therefore, if one changes the putter grip weight drastically, this would not noticeably affect the swing weight of the putter.

The swing weight of the putter is more important and much more effective than the total dead weight of the putter.

In determining swing weight, the greater the weight of the club head, the greater the swing weight, assuming the shaft and grip remain the same. For example, the difference between a small grip and a large grip being 21 grams of weight increased the swing weight by two swing weights. However, if this 21 grams of weight is added to the putter head, instead of the grip, this 21 grams of weight increases the total putter swing weight by 9 swing weights.

The grip and the shaft does have a bearing on the swing weight; however, the weight of the putter head is the controlling swing weight factor.

Based on a Kenneth Smith official swing weight scale with a twelve inch fulcrum, which measures in ounces and grams, the gram weight illustrated is 2.33 grams=1 swing weight. Length of the golf shaft is 35"; grip is standard.

With the present invention, putter head weight may be adjusted from the maximum shown on the scale conversion table to the minimum shown on the scale conversion table (the lightest weight feasible of any putter) as follows:

384 grams=164.80686 total swing weights in grams or a swing weight of G-3;

251 grams=107.72532 total swing weights in grams or a swing weight of A-6 putter head weight in the present invention may be adjusted to any weight between 384 grams and 251 grams to achieve any desired swing weight.

The present invention with putter head weight of 349 grams is considered extremely heavy by most golfers in that the putter head on a 35" shaft has a swing weight of E-8.

Heretofore, a 314 gram putter head on a 35" shaft with a swing weight of D-3 was considered the ideal swing weight of almost all golfers.

However, the 349 gram putter head weight of the present invention is the ideal weight when 80% of the total putter head weight, consisting of brass or bronze, is located within ¾" to 1" of the heel and toe ends. The putter has perfect balance with an equal amount of weight on either side of the center of the putter head. The putter of the present invention will actually balance on the tip of an icepick.

With approximately 70%–97% of the weight within ¾"–1" at the heel and toe ends and fully exposed makes the brass or bronze ends very accessible for easy adjustment downwardly to the desired swing weight for 99% of all golfers.

After the total putter has been completely assembled, to include the shaft and grip, the total putter head weight may easily be adjusted by the purchaser to the exact weight he desires.

A shaft in-head mount center balanced putter balances across the palm of one's hand. Therefore, the weight may easily be removed in equal amounts from the heel and toe while the putter is kept in perfect balance.

This may be achieved as follows:

Starting with a 349 gram putter head, which is an E-8 swing weight, one may use sand paper, a file or a sanding machine to remove 7 grams off the heel and 7 grams off the toe. This reduces the head weight by 14 grams or six swing weights, making the putter an E-2 swing weight. One may check to see if he is keeping the proper balance by laying the putter across the palm of one's hand; the putter face should be parallel to the ground.

This illustrates how easy it is to adjust the weight of the putter head of the present invention to the exact swing weight to suit any golfer.

The unique placement of heel and toe end weights is adaptable to all golf club heads including drivers, irons, woods, wedges and the like. FIGS. 1*p*–3*p* illustrate the incorporation of high density metal end blocks (14*p* and 14*p*') on the rear of a #5 iron (10*p*). The #5 iron used is representative of drivers, irons, woods and wedges.

Club head (10*p*) is a three-piece head having a central frame (12*p*), one toe end block (14*p*) and one heel end block (14*p*'). The frame (12*p*) is machined from a single solid block of lightweight, high tensile strength wrought aluminum alloy having a density less than 2.82, a Burnell hardness of 150, and ultimate tensile strength of 73,000 psi to 90,000 psi. One such material composition is manufactured by Alcoa Aluminum under the brand name of ALCOA 7075-T6. Other comparable substitute materials may be used.

Frame (12*p*) has a generally L-shape with a face portion (18*p*) and a base section (16*p*). The face portion (18*p*) presents a multiplicity of discrete intersecting angular edges as may be seen in FIG. 3*p*. Hosel (63*p*) is a unitary part of the aluminum frame (12*p*).

The short hosel (63*p*) is designed to give the club head (10*p*) better aerodynamic characteristics. The hosel (63*p*) has a 0.370" bore and is 1.00" deep so as to mount any type of shaft. The hosel is significantly shorter and lighter than any known in the art.

The hosel to face angle (KP) and hosel approach angle (MP) vary for the various numbered clubs or irons. For example, the #5 iron has a KP of 31° and an MP of 59°. However, the size and weight of the end blocks (14*p* and 14*p*') are provided to ensure that approximately 80% of the total club head weight is within ¾" of the heel end (15*p*') and toe end (15*p*) of the club head (10*p*). When heel and toe end blocks (14*p*' and 14*p*) are extended to within ⅞" of the heel end (15*p*') and toe end (15*p*), 86% to 96% of the total club head weight is within ⅞" of the heel and toe ends of the club head (10*p*). The various numbered irons, drivers, wedges and the like have various total weights in the present invention with the total club head weight in the range of 218 grams to 308 grams. The frame portion (12*p*) is in the range of 70 grams to 90 grams. The end blocks range from 173 grams to 250 grams.

The sharp angular design of the club head (10*p*) and the raised cutting angle (JP) of 17° on the leading edge of the iron provides significant reduction of an estimated 15–20% in drag on the golf club as it swings through the air while insuring the maximum size hitting face area. When the golfer swings the angular club head (10*p*) through the air, it moves at a greater velocity with the angles keeping the club head moving in a straight line.

The incorporation of the angular features on the club face enable the club head to be as lightweight as possible. The angle CP at the top of the club face gradually increases as the loft of the iron increases and the depth of the face increases, whereas the angles at the bottom club face remain constant. The angles may vary slightly on a pitching wedge, sand wedge or lob wedge.

Figure 1P:
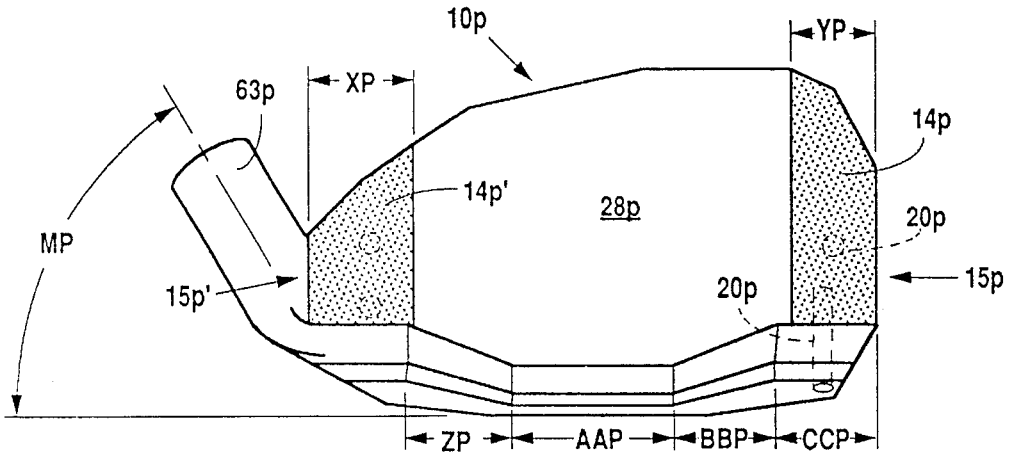
FIG. 1*p* is a rear elevational plan view of a three-piece iron club head of the present invention.
Figure 2P:
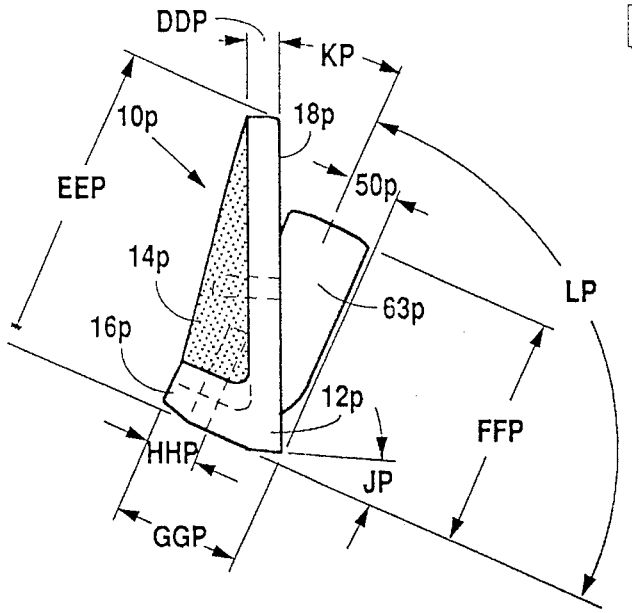
FIG. 2*p* is a toe end elevational plan view of a three-piece iron club head of the present invention.
Figure 3P:
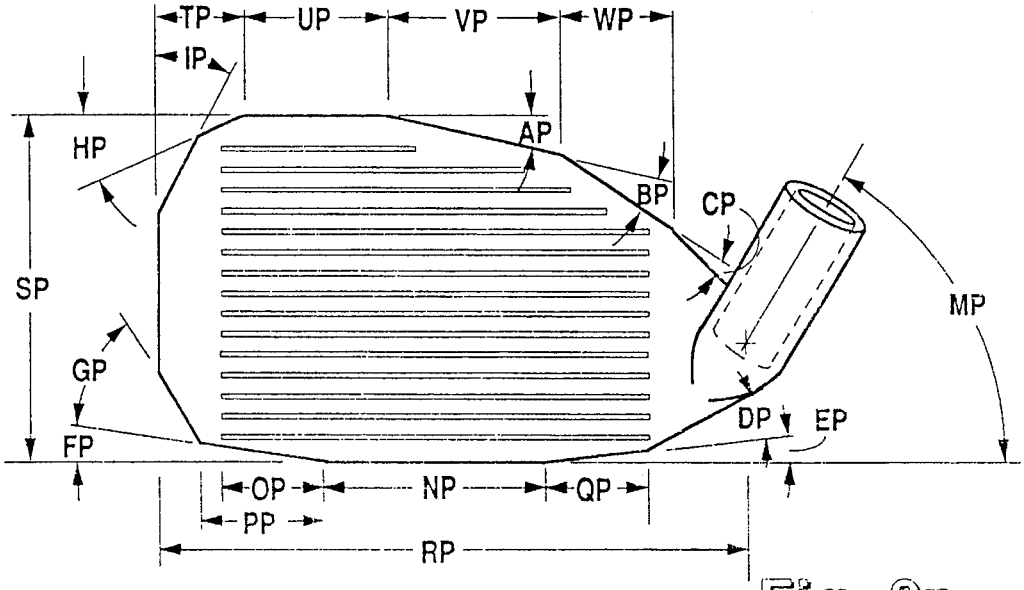
FIG. 3*p* is a front elevational view of a three-piece iron club head of the present invention.

The sole plate or base member portion (16*p*) narrows in the center portion as may be seen in FIG. 1*p*. This gives the sole plate (16*p*) less drag and permits a firm contact with the ball and a smoother stroke.

The sole plate (16*p*) on all irons of the "10*p*" construction is angular as illustrated in FIG. 1*p*. Sole plate (16*p*) has a 1.25" flat portion (NP) in the center and a 6° raised angle (EP) at the bottom of the heel and a 8° raised angle (FP) at the toe. This gives the golfer an automatic variable lie angle from a 26° flat lie to a 12° upright lie.

The location and degree or angles allows the golfer a greater selection of lies. The angular sole plate (16*p*) provides an infinity lie; flat, upright or regular lie because the flat area of slightly over 1" is in the center of the grooves in the sole plate and the angle is a 6° raised angle at the bottom of the heel and an 8° raised angle at the toe. The golfer can set the club at an angle he prefers without changing the dynamics, the balance or the sweet spot.

The club head (10*p*) has a 17° raised angle (JP) which creates a sharp leading edge on the sole plate which allows the club head (10*p*) to cut through the turf or rough.

With a pitching wedge and a lob wedge there is a very sharp leading edge created by a 25° upward angle and a 16° downward angle at the leading edge of the sole plate. This angularity helps keep the grass from getting between the ball and face of the club and helps pick the ball out of the rough.

In some circumstances it may be desired to construct club heads (10*p*) from only one metal, such as stainless steel. Thus, a one-piece construction may be provided by investment casting, pressure casting, forging or machining the club head. In such cases, separate heel and toe blocks of dense metal are not provided but the multiplicity of discrete intersecting angular edges around the faceplate portion and base member portions are utilized.

The preferred dimensions for the various numbered irons are set forth in Table VII, and when a three-piece club head (10*p*) is constructed according to these teachings, with the various irons, 79%–81% of the total club head weight is within ¾" or less of the heel and toe ends of the head.

TABLE VII

| | Club Number | | | | | | | |
|---|---|---|---|---|---|---|---|---|
| REF. | DRIVING IRON | #3 IRON | #4 IRON | #5 IRON | #6 IRON | #7 IRON | #8 IRON | #9 IRON |
| AP | 13° | 13° | 13° | 13° | 13° | 13° | 130 | 13° |
| BP | 20° | 20° | 20° | 20° | 20° | 20° | 20° | 20° |
| CP | 13° | 13° | 13° | 13° | 27° | 32° | 37° | 40° |
| DP | 21° | 21° | 21° | 21° | 21° | 21° | 21° | 21° |
| EP | 6° | 6° | 6° | 6° | 6° | 6° | 6° | 6° |
| FP | 8° | 8° | 8° | 8° | 8° | 8° | 8° | 8° |
| GP | 51° | 51° | 51° | 51° | 51° | 51° | 51° | 51° |
| HP | 24° | 24° | 24° | 24° | 24° | 24° | 24° | 24° |
| IP | 28° | 28° | 28° | 28° | 28° | 28° | 28° | 28° |
| JP | 17° | 17° | 17° | 17° | 17° | 17° | 17° | 17° |
| KP | 21° | 24° | 27° | 31° | 37° | 41° | 45° | 49° |
| LP | 90° | 90° | 90° | 90° | 90° | 90° | 90° | 90° |
| MP | 55° | 57° | 58° | 59° | 60° | 61° | 62° | 63° |
| NP | 1.250 | 1.250 | 1.250 | 1.250 | 1.250 | 1.250 | 1.250 | 1.250 |
| OP | .625 | .625 | .625 | .625 | .625 | .625 | .625 | .625 |
| PP | .750 | .750 | .750 | .750 | .750 | .750 | .750 | .750 |
| QP | .625 | .625 | .625 | .625 | .625 | .625 | .625 | .625 |
| RP | 3.406 | 3.406 | 3.406 | 3.406 | 3.406 | 3.406 | 3.406 | 3.406 |
| SP | 1.937 | 1.937 | 1.984 | 2.015 | 2.218 | 2.312 | 2.484 | 2.500 |
| TP | .500 | .500 | .500 | .500 | .500 | .500 | .500 | .500 |
| UP | 1.375 | 1.375 | 1.375 | 1.375 | 1.375 | 1.375 | 1.375 | 1.375 |
| VP | 1.000 | 1.000 | 1.000 | 1.000 | 1.000 | 1.000 | 1.000 | 1.000 |
| WP | .625 | .625 | .625 | .625 | .625 | .625 | .625 | .625 |
| XP | .625 | .625 | .625 | .625 | .625 | .625 | .625 | .625 |
| YP | .500 | .500 | .500 | .500 | .500 | .500 | .500 | .500 |
| ZP | .594 | .594 | .594 | .594 | .594 | .594 | .594 | .594 |
| AAP | .937 | .937 | .937 | .937 | .937 | .937 | .937 | .937 |
| BBP | .594 | .594 | .594 | .594 | .594 | .594 | .594 | .594 |
| CCP | .594 | .594 | .594 | .594 | .594 | .594 | .594 | .594 |
| DDP | .186 | .186 | .186 | .186 | .186 | .186 | .186 | .186 |
| EEP | 1.875 | 1.810 | 1.810 | 1.810 | 1.810 | 1.810 | 1.810 | 1.687 |
| FFP | 1.750 | 1.500 | 1.625 | 1.625 | 1.625 | 1.625 | 1.625 | 1.625 |
| GGP | .750 | .750 | .750 | .750 | .750 | .750 | .750 | .750 |

TABLE VII-continued

| | Club Number | | | | | | | |
|---|---|---|---|---|---|---|---|---|
| REF. | DRIVING IRON | #3 IRON | #4 IRON | #5 IRON | #6 IRON | #7 IRON | #8 IRON | #9 IRON |
| HHP | .312 | .312 | .312 | .312 | .312 | .312 | .312 | .312 |
| Bounce | 0° | 0° | 0° | 0° | 1° | 1° | 2° | 2° |

In some modifications to club head (10*p*), the hosel (63*p*) may be offset to enable the golfer to hit down through the ball slightly better than with a straight hosel. This gives the ball more back spin and causes the ball to raise slightly higher. The offsets (50*p*) found to be effective are ⅛" and 0.450" offsets.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position or manner in which the invention may be constructed or used.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. A golf club head for use with a golf club having a shaft, said head having a heel end ,and a toe end comprising:

a heel weight and a toe weight, said heel weight and said toe weight being of the same composition, similarly shaped and having substantially the same mass;

a frame for maintaining fixed, spatial relation between said heel weight and said toe weight, said frame including an opening for securing said shaft to said head;

a ball striking face, said face abuttingly attached by a first means for attachment to a first surface of said heel weight and by a second means for attachment to a first surface of said toe weight;

wherein said heel weight, said toe weight, said frame and said face are assembled into a unitary structure defining said club head wherein 70%–97% of the total weight of said club head is located within three-quarter to one inch of said heel end and said toe end.

2. The club head of claim 1 wherein said frame further comprises a rearwardly extending and open echo chamber.

3. The club head of claim 2 wherein said frame further comprises an upper and lower overhang extending rearwardly from said echo chamber.

4. The club head of claim 1 wherein said club head further comprises a first and a second outer alignment index and a central alignment index, said first and second alignment indices spaced apart and having a first width, said central alignment index having a mid-point coinciding with a centerline of said ball striking face and having a second width greater than said first width.

5. The club head of claim 4 wherein said first and second alignment indices are approximately 0.250" wide and spaced apart approximately 1.93" to 2.00", and said central alignment index is approximately 0.375 wide.

6. The club head of claim 1 wherein said ball striking face is abuttingly attached to projecting tabs on said heel weight and said toe weight so as to fully suspend said face.

7. The club head of claim 2 wherein a full front curtain extends across a front end of said echo chamber.

8. The club head of claim 7 wherein said front curtain has at least one opening in a central portion of said curtain.

9. The club head of claim 2 wherein said club head further comprises a first and a second outer alignment index and a central alignment index, said first and second alignment indices spaced apart and having a first width, said central alignment index having a mid-point coinciding with a centerline of said ball striking face and having a second width greater than said first width.

10. A three-piece golf club head for use with a golf club having a shaft, said head having a heel end and a toe end comprising:

a heel weight and a toe weight, said heel weight and said toe weight being of the same composition, similarly shaped and having substantially the same mass;

a thin vertical faceplate, without a sole plate portion, for maintaining fixed, spatial relation between said heel weight and said toe weight;

said heel end weight abuttingly attached by a first means for attachment at only a first side surface of said heel end weight to said faceplate, said heel end weight including an opening for securing said shaft to said head;

said toe weight abutting by a second means for attachment at only a first side surface of said toe weight to said faceplate;

wherein said heel weight, said toe weight and said faceplate are assembled into a unitary structure defining said club head wherein over 95% of the total weight of said club head is located within one inch of said heel end and said toe end.

11. A three-piece golf club head for use with a golf club having a shaft, said head having a heel and a toe end comprising:

a heel weight and a toe weight, said heel weight and said toe weight being of the same composition, similarly shaped and having substantially the same mass;

an L-shaped frame for maintaining fixed, spatial relationship between said heel weight and said toe weight, said frame having a T-shaped faceplate portion of uniform thickness and a base member portion, said T-shaped faceplate portion and said base member portion being generally tabular and disposed one to the other, integrally joined along adjacent edges thereof at an included angle, said T-shaped faceplate portion having outwardly extending horizontal crossarms and being generally bilaterally symmetrical;

means to mount said weights on removed ends of said frame; and means to mount said shaft to one of said crossarms;

wherein said weights are mounted with first faces thereof substantially flush with a front surface of said faceplate portion and second surfaces thereof abuttingly mounted with bottom surfaces of said crossarms, and third surfaces abuttingly contacting said base member portion and wherein more than 90% of the total weight of said club head is located within one inch of said heel end and said toe end of said club head.

12. The three-piece golf club head of claim 11 further comprising:

two narrow grooves equidistantly spaced apart from a center line of said T-shaped faceplate portion, said grooves extending upwardly for a distance through the entire thickness of said faceplate portion and rearwardly along an entire width of said hosel member portion and through the entire thickness of said base member.

13. The three-piece golf club head of claim 12 wherein said means to mount said shaft further comprises a short hosel having a depth in the range of 0.250"–1.25" and a bore in the range of 0.300"–0.375".

14. A three-piece golf club head for use with a golf club having a shaft, said head having a heel end and a toe end comprising:

a heel weight and a toe weight, said heel weight and said toe weight being of the same composition, similarly shaped and having substantially the same mass;

an L-shaped frame for maintaining fixed, spatial relationship between said heel weight and said toe weight, said frame having a faceplate portion of uniform thickness and a base member portion, said faceplate portion and said base member portion being generally tabular and disposed one to another, integrally joined along adjacent edges thereof at an included angle, said frame being generally bilaterally symmetrical;

means to mount said weights on removed ends of said frame; and means to mount said shaft to one end of said frame;

wherein said weights are mounted with first faces thereof substantially flush with a front surface of said faceplate portion and a second face thereof abuttingly mounted to said removed ends of said frames and wherein 90% of the total weight of said club head is located within one inch of said heel end and said toe end of said club head.

15. The three-piece golf club head of claim 14 wherein said means to mount said shaft further comprises a hosel arm offset in the range of 0.420" to 1.00" forward of said faceplate portion at an angle of approximately 30° from the horizontal.

16. The three-piece golf club head of claim 14 further comprising:

two narrow grooves equidistantly spaced apart from a center line of said faceplate portion, said grooves extending upwardly for a distance through the entire thickness of said faceplate portion and rearwardly along an entire width of said base member portion and through the entire thickness of said base member portion.

17. The three-piece golf club head of claim 14 wherein said weights are further mounted with third faces thereof extending rearwardly beyond a rearward most edge of said base member portion.

18. The three-piece golf club head of claim 14 wherein leading bottom edges of said frame and said weights are chamfered.

19. The three-piece golf club head of claim 14 wherein trailing bottom edges of said frame and said weights are chamfered.

20. A golf club head for use with a golf club having a shaft, said head having a heel end and a toe end comprising:

an L-shaped frame having a faceplate portion and a base member portion, said faceplate portion having a multiplicity of discrete intersecting angular edges around an outer surface of said faceplate portion, said frame having a leading edge of said frame raised a first cutting angle, said base member portion having a multiplicity of discrete intersecting angular edges around an outer surface of said base member portion, and said base member portion having a flat, horizontal central portion connecting a surface at said toe end raised a first angle and a surface at said heel end raised a second angle; and a means for mounting said shaft to said frame.

21. The golf club head of claim 20, further comprising:

a heel weight and a toe weight attached to a rear surface of said faceplate portion and a top surface of said base member portion;

wherein said heel weight, said toe weight, and said frame are assembled into a unitary structure defining said club head wherein approximately 80% of the total club head weight of said club head is located within ¾" or less of said heel and said toe ends.

* * * * *